US006206739B1

(12) United States Patent
Dadd et al.

(10) Patent No.: US 6,206,739 B1
(45) Date of Patent: Mar. 27, 2001

(54) MARINE DRIVE SYSTEM WITH IMPROVED DRIVE BELT

(75) Inventors: Paul M. Dadd, Mentor; Park French, Aurora, both of OH (US); Carl W. Rose, Jr., North Fort Meyers; Charles R. Anspach, Bokeelia, both of FL (US); John T. Venaleck, Madison, OH (US)

(73) Assignee: Ohio Associated Enterprises, Inc., Painesville, OH (US)

( * ) Notice: Subject to any disclaimer, the term of this patent is extended or adjusted under 35 U.S.C. 154(b) by 0 days.

(21) Appl. No.: 09/205,960

(22) Filed: Dec. 4, 1998

Related U.S. Application Data

(60) Provisional application No. 60/085,314, filed on May 13, 1998, provisional application No. 60/085,194, filed on May 12, 1998, and provisional application No. 60/070,030, filed on Dec. 8, 1997.

(51) Int. Cl.[7] ..... B63H 20/14
(52) U.S. Cl. ..... 440/75; 440/89
(58) Field of Search ..... 440/75, 89

(56) References Cited

U.S. PATENT DOCUMENTS

| | | | | |
|---|---|---|---|---|
| 743,700 | | 11/1903 | Dupuis . | |
| 2,345,689 | | 4/1944 | Snadecki . | |
| 2,741,351 | * | 4/1956 | Fletcher et al. | 440/75 |
| 3,088,430 | | 5/1963 | Champney . | |
| 3,153,397 | | 10/1964 | Mattson et al. . | |
| 3,185,122 | | 5/1965 | Pleuger . | |
| 3,207,119 | | 9/1965 | Holder . | |
| 3,403,655 | | 10/1968 | Warburton . | |
| 3,707,939 | | 1/1973 | Berg . | |
| 3,951,096 | | 4/1976 | Dunlap . | |
| 4,050,849 | * | 9/1977 | Sheets | 440/75 |
| 4,186,625 | * | 2/1980 | Chamberlain | 74/780 |
| 4,337,055 | | 6/1982 | Mackay et al. . | |
| 4,466,802 | | 8/1984 | Ojima et al. . | |
| 4,721,485 | | 1/1988 | Suzuki . | |
| 4,869,692 | | 9/1989 | Newman . | |
| 4,869,708 | | 9/1989 | Hoffmann et al. . | |
| 4,887,983 | | 12/1989 | Bankstahl et al. . | |
| 4,925,409 | * | 5/1990 | Johnson | 440/75 |
| 5,069,643 | | 12/1991 | Westberg et al. . | |
| 5,094,640 | * | 3/1992 | Burdick et al. | 440/89 |
| 5,178,566 | | 1/1993 | Stojkov et al. . | |
| 5,445,546 | * | 8/1995 | Nakamura | 440/75 |

* cited by examiner

*Primary Examiner*—Stephen Avila
(74) *Attorney, Agent, or Firm*—Renner, Otto, Boisselle & Sklar, LLP

(57) ABSTRACT

An outdrive system for water craft includes in an embodiment use of plastic or other relatively flexible material, e.g., compared to metal, as a housing material, and techniques which enable and/or at least facilitate use of such housing material. Several of those techniques employ a flexible member, such as a belt, to couple power between the input and output of an outdrive, and heat conducting back bending surfaces to urge the belt legs toward each other and to remove heat from the outdrive, an anti-shear stuffer or fence to reduce energy losses such as heat, and lubricant requirements, and/or an eccentric mechanical tensioning device for the belt. The invention also relates to use in a vehicle drive, especially for water craft, of housing materials a substantial part of which are not subject to corrosion, galvanic action and the like. Other features include a rotational shock absorber system, an output shaft support, an improved sprocket tooth profile, a water by-pass silencer, an L C (analogous to an electrical inductor and capacitor filter) exhaust silencer, a split eccentric tensioner, an active tensioner, a transmission and a transmission shift mechanism, tensioning protocol and a cooling method. Also, in an embodiment the housing may be made partly or entirely of thermally conductive material, such as, aluminum, which facilitates and enhances heat removal by conduction to the water in which the outdrive is immersed.

74 Claims, 34 Drawing Sheets

IDLE RPM = 800.0
STROKE TIME (sec.) = 0.00563
K.E. IN CENTER OF Iz SYSTEM (lb.ft.) = 60.00
MAX. TORQUE (ft.lb) = 400.00
MAX. PRESS. (psi) = 538.34
ANGULAR STROKE (degrees) = 17.19

| | VALUE | X | Y |
|---|---|---|---|
| R1 | 0.0280 | -0.0500 | 0.0280 |
| R2 | 0.0700 | -0.0360 | 0.0676 |
| R3 | 0.1900 | -0.0582 | 0.1420 |
| R4 | 0.0340 | 0.0 | -ROOT |
| R5 | 1.9210 | | |
| ROOT | 1.7920 | | |

MARINE DRIVE SYSTEM WITH IMPROVED DRIVE BELT

CROSS REFERENCE TO RELATED PATENTS, PATENT APPLICATIONS, AND/OR PROVISIONAL APPLICATIONS

This application claims priority under 35 U.S.C. 119(e) from Provisional U.S. patent applications Ser. No. 60,070,030, filed Dec. 8, 1997; Ser. No. 60/085,194, filed May 12, 1998; and Ser. No. 60/085,314, filed May 13, 1998.

Reference is made to U.S. Pat. No. 5,178,566.

TECHNICAL FIELD

The present invention relates generally to drive systems for vehicles, especially water craft. More particularly, the invention relates to outdrives for water craft.

In an exemplary embodiment of the invention, features include, among others, use of plastic or other relatively flexible material, e.g., compared to metal, especially as a substantial part of the housing material, and techniques which enable and/or at least facilitate use of such housing material. One of those techniques employs a flexible member, such as a belt, to couple power between the input and output of an outdrive and/or others include heat conducting back bending surfaces to urge the belt legs toward each other and to remove heat from the outdrive, a stuffer or fence to reduce energy losses, such as heat, and lubricant requirements, and/or an eccentric mechanical tensioning device for the belt. The invention also relates to use in a vehicle drive, especially for water craft, of at least some housing materials that are not subject to corrosion, galvanic action and the like. Other features include rotational shock absorber, output shaft support, oil, anti-shear fence, sprocket tooth profile, water by-pass silencer, L C exhaust silencer, split eccentric tensioner, active tensioner, transmission design, transmission shift mechanism, tensioning protocol and exhaust thermal barrier. A still further feature includes use of a thermally conductive outdrive housing, such as aluminum, to facilitate and to enhance conducting heat to the water in which the outdrive is immersed.

BACKGROUND

In an exemplary drive system for a vehicle, there usually is a power supply, an output mechanism, a power coupling system, and a housing and/or structural apparatus. The power supply typically is an engine or a motor, although other means also may be employed. The output mechanism converts power received from the power supply to motive force for the purpose of moving and directing the vehicle. In a boat, the output mechanism typically is a propeller. The power coupling mechanism couples, transmits or transfers power from the power supply to the output mechanism. Often the power coupling system includes one or more of a drive shaft, an output shaft, other coupling gears and shafts, a clutch, a transmission, etc. The housing and/or structural support apparatus typically holds one or more of the other components of the drive system in relation to each other in order to accomplish the appropriate interaction to effect the desired driving function. Additionally, the housing and/or structural support mechanism may provide, to the extent needed and/or desired, appropriate enclosure functions.

The present invention preferably relates to drive systems for boats. As it is used herein, the term "boat" is intended to mean virtually any type of water craft, vehicle, apparatus, device, etc., that is intended to be operated on, in and/or under water. The features of the present invention are particularly useful with surface craft, i.e., boats that float and/or are operated at the water surface, and especially drive systems therefor that are rated at from about 100 horsepower up to about 1000 horsepower and beyond 1000 horsepower, and especially in the range of from about 100 hp to about 250 hp. However, it will be appreciated that features of the invention may be used with other boat drive systems and at other power levels, e.g., those that are rated at less than 100 horsepower or more than several hundred horsepower, or even more than 1,000 horsepower, depending on the sizes of the several components of the outdrive.

Moreover, although the features of the present invention are particularly useful in and relate to boat drive systems, it will be appreciated, and it is intended, that features of the invention may be used in drive systems for vehicles other than boats and/or in other applications, too. For compactness, though, the following description is directed to application of the features of the invention in drive systems for boats; application of features of the invention in other drive systems will be evident to those having ordinary skill in the art in view of the disclosure hereof.

Conventional boat drive systems often are categorized by labels inboard, outboard, and inboard/outboard. In an exemplary inboard drive system the power supply, which will be referred to hereinafter for convenience as an engine although it may be a motor or some other source of power, and the majority of the power coupling system are located within the boat, which provides at least some housing and structural support functions. The propeller and at least part of the propeller shaft, of course, are located outside the boat in the water, as also is the case for outboard and inboard/outboard drive systems. One example of an inboard drive system is an in line system in which the engine, clutch, transmission and propeller shaft generally are in line facing from the front to the back of the boat, the propeller being at or near the back. Another example of an inboard drive system is referred to as a V-drive. In an outboard drive system typically the engine and the power coupling system are located outside or mostly outside the boat. Furthermore, in an inboard/outboard drive system an exemplary configuration employs an engine located in the boat and a power coupling system that has a substantial portion located outside the boat. The foregoing is exemplary; it will be appreciated that various hybrid combinations of the foregoing categories of boat drive systems, as well as other types of boat drive systems also exist and/or may exist in the future.

The present invention includes features that may be useful in the various categories or types of boat drive systems mentioned above and in others that may not be specifically identified. However, according to the preferred embodiment and best mode, as is described in greater detail below, the present invention has particular utility when employed in and/or with the outdrive portion of the power coupling system of an inboard/outboard boat drive system and of outboard boat drive systems. Features of the invention also are especially useful in V-drive systems.

The term outdrive typically means that portion of a vehicle drive system, usually excluding the engine, which is located outside the hull of a boat. The outdrive usually is part of or is the entire power coupling system of a boat drive system and also may include the output mechanism, typically the propeller. As they are used herein, the terms outdrive and power coupling system may be used synonymously, and such terms also may be used to designate non-overlapping parts or functions, i.e., not synonymously; the context will make the usage clear. For example, the engine drive shaft itself may be considered part of the power coupling mechanism, as is the universal joint, but only the latter usually would be considered part of the outdrive.

In a conventional outdrive type of power coupling system, power is coupled between the engine and the output mechanism, which for convenience is referred to below as the propeller. Typically during use, the engine drive shaft or at least the power input shaft for the outdrive and the propeller shaft are oriented generally in parallel horizontal directions and are vertically spaced apart. The conventional outdrive includes a rigid coupling shaft and associated gears to couple the rotary output from the drive shaft to the propeller shaft. Accurate positioning of the various parts of such a conventional outdrive is necessary in order to assure proper alignment and meshing of respective gears and shafts, as is well known. Relatively rigid metal castings typically are used as housings for such outdrives to provide the necessary stiffness to obtain the necessary accurate positioning functions mentioned.

The gears, coupling shaft, and metal castings employed as housings and/or other parts for such conventional outdrives are relatively expensive to manufacture and are relatively heavy. It would be desirable to reduce the expense of manufacturing an outdrive.

The gears and coupling shafts of such conventional outdrives are usually located in an oil filled chamber. The oil provides usual lubricating function. Heat developed by the rotating gears and shafts heats the oil, which is cooled by thermal conduction through the metal housing of the outdrive to the water in which the outdrive, and indeed the boat, are immersed.

An outdrive usually is mounted on a pivot housing and/or gimbal ring to allow for steering, trimming (e.g., thrust angle), and tilt (e.g., for storage).

One example of an outdrive which uses a flexible power coupling member in the form of a belt is disclosed in Dunlap U.S. Pat. No. 3,951,096. Such outdrive has a metal housing with two separate hollow down legs to enclose the two respective legs of the belt. Such hollow down legs extend between the upper housing portion where a drive sprocket is located and the lower housing portion (sometimes referred to as the torpedo) where a driven sprocket is located. The driven sprocket is coupled to the propeller. The present invention includes a number of improvements that may be employed with such a belt driven outdrive.

Outdrives have included kickup features so that the outdrive kicks up or tilts out of the way when it strikes an object, such as a log, rock, lake bottom, etc. to avoid damages to the outdrive and/or other parts of the drive system or boat. Usually hydraulic cylinders having high pressure hydraulic fluid therein hold the outdrive, especially the propeller, at a particular trim angle to obtain a particular thrust angle for desired boat operation. If the outdrive strikes an object, hydraulic fluid in such cylinders is forced through small orifices to allow the outdrive to kickup out of the way of such object. The speed with which the fluid flows is a function of orifice size and fluid pressure, which in turn is a function of the force applied to the outdrive by the object struck.

U.S. Pat. No. 5,178,566, which is incorporated entirely by this reference, discloses an outdrive using a non-metal housing and a belt to couple power between the input and output. It has been found that energy losses may occur due to vortices generated within the oil between the belt legs and/or other unnecessary oil pumping actions. It would be desirable to reduce such losses. It also was found that belt tensioning sometimes was difficult; it would be desirable to improve belt tensioning techniques. It also was found that improved heat removal techniques would be advantageous.

Several other improvements to outdrives, such as the outdrive described in the '566 patent and other outdrives, also would be advantageous and are disclosed herein.

SUMMARY

Briefly, according to the present invention, a power coupling apparatus, such as an outdrive or the like, employs a housing structure that is generally less rigid than a conventional metal casting (although, if desired, in principle it could be made equally rigid), such housing being formed in part, for example, of plastic or plastic-like material, together with a number of features which cooperate to enable and/or to facilitate the use of such housing material in an outdrive. The housing structure and the various features according to the present invention are described in detail below and are particularly pointed out and distinctly claimed independently and in combination in various ones of the claims (if appended or subsequently drawn).

Another aspect of the invention is to employ techniques that enable use of plastic, polymer, resin or other materials that have similar properties as the material from which the housing and/or possibly other parts of an outdrive may be made.

According to one feature of the present invention, the housing, or at least a substantial portion of the housing, for an outdrive is a relatively lightweight material, and is non-corroding, such as a plastic material or plastic-like material. Compared to primarily metal housings for outdrives, a number of advantages inure to the use of plastic material, including, for example, lightness of weight, convenience and low cost of manufacturing using molding techniques, insensitivity to problems due to corrosion, galvanic action, receptivity of paint (such as anti-fouling paint without associated galvanic corrosion problems, bottom paint, etc.), as well as others.

However, compared to metal material, plastic material usually is more flexible and more susceptible to creep. Metal is stiffer and less susceptible to creep. Also, plastic material usually is less thermally conductive than metal, which therefore makes it unlikely that adequate heat removal by conduction through the outdrive housing into the water would be possible. Such flexibility may result in lack of adequate stability and/or accurate maintaining of relative placement and/or location of conventional outdrive parts, such as the gears, shafts, and/or other parts that affect coupling of power in a conventional outdrive.

According to another aspect or feature of the invention, the down leg or housing portion for an outdrive is made of thermally conductive material, such as aluminum or some other material; such material facilitates and expedites (e.g., makes more efficient) the dissipation of heat, which is generated or develops in the outdrive, to the water in which the outdrive is immersed.

According to a feature of the invention, an improved flexible power coupling is used to couple power in the outdrive to obtain an effective transfer of power, for example, between the drive shaft and the propeller shaft. Also, an improved housing including some thermally conductive material, such as metal, especially aluminum, is used as a part of the housing to provide heat dissipation and strength to maintain belt tension.

According to a feature of the invention, the flexible power coupling may be a belt, a chain, or an equivalent flexible member, which is not so sensitive to precision alignment as that required for conventional power coupling apparatus that employ gears and shafts. The flexible member will be referred to below as a belt for convenience. However, it will be appreciated that other flexible members, such as chains or equivalent devices, may be used in place of the belt according to the principles of the invention.

Another aspect is to back bend an endless loop flexible drive member during use, especially by using generally non-moving surfaces. Another aspect is to remove heat from a drive system using such a flexible drive member.

Another feature of the invention includes a technique for streamlining or reducing the profile of an outdrive that uses such a flexible coupling. Therefore, the outdrive will have an external appearance that is generally aesthetically pleasing in that it will be the same or similar to that of a conventional cast aluminum outdrive, for example. Also, the reduced profile improves the hydrodynamic characteristics, especially by reducing drag, compared to a large profile single leg housing that would be needed to contain the two belt legs, for example.

Accordingly, a technique is employed to bend or to urge the belt legs back toward each other in at least part of the down leg of the outdrive housing, i.e., that zone between the upper housing portion and the lower housing portion (torpedo). To effect such back bending back benders are provided in the housing, and the belt slides across the back benders which urge the belt legs toward each other. A lubricant, such as an oil material, may be used to reduce friction at the sliding interface between the back benders and the belt. It has been found preferable that the belt floats on a layer of oil, e.g., as in a journal bearing, rather than having direct surface-to-surface engagement with the back benders or like surfaces. Such back bending reduces the space required for the belt between the upper and lower housing portions and, thus, reduces the cross-sectional size dimensions or profile of the outdrive presented transverse to the travel direction through the water. Drag tends to be minimized while efficiency tends to be maximized.

To avoid vortices in the oil between belt legs during operation a fence or stuffer is between the belt legs, thus also reducing space where oil can exist in the drive and the volume of oil required for operation.

To remove heat from the outdrive is another feature of the invention, particularly since the preferred housing material usually would be less thermally conductive than prior metal housings. To remove heat whether the housing is plastic or metal, a portion of the housing at, near and/or including the back benders is thermally conductive and is at least partly immersed in water in which the boat is operating to conduct heat out of to the water. The oil constantly is scrubbed against the back benders which avoids boundary layers and enhances the thermal transfer from the oil to the back benders.

It also will be appreciated that a preferred embodiment of the invention is described in detail below. However, the scope of the invention is intended to be limited only by the scope of the claims and the equivalents thereof.

As it is used herein the term "plastic" means the conventional definitions of plastic, such as polymer material, synthetic material and so forth. Plastic includes both thermoset type plastic and thermoplastic. Plastic includes a material that preferably can be molded or laid up. It includes a material that will not encounter the types of corrosion and similar problems that may occur to a metal material. Usually a plastic material will be less stiff or rigid than metal, i.e., plastic typically is more flexible than metal. Plastic also usually has a greater tendency to creep than does a metal. Further, plastic often does not have as efficient a thermal conduction capability as does metal.

Various examples of plastic material may be used in accordance with the present invention.

Another aspect of the invention relates to a drive system including a power input shaft, a power output shaft, an endless loop flexible mechanism for coupling power between the shafts, the flexible mechanism having plural legs extending between the shafts, and a bending device for bending the endless loop flexible mechanism so that at least one of the legs is bent toward the other and a fence or stuffer in part of the volume between the two belt legs to reduce energy losses and/or oil requirements.

Another aspect relates to a technique for removing heat from an outdrive or the like which has in part a relatively non-thermally conductive housing and in part a thermally conductive housing.

Another aspect relates to a system for pretensioning a flexible drive member, such as a belt, chain or the like, including an eccentric mechanical support.

Another aspect relates to a mechanism for actively applying tension to a flexible member, such as a belt, chain or the like.

Another aspect relates to an improved muffler for an engine using an LC filter type effect.

It will be appreciated that the various features of the invention may be employed alone and/or in combination with other features in plastic outdrive systems and in other drive systems for boats and/or other vehicles.

The foregoing and other objects, features, advantages and embodiments of the invention will become apparent as the following description proceeds.

The following description and the annexed drawings set forth in detail certain illustrative embodiments of the invention, these being indicative, however, of but a few of the various ways in which the principles of the invention may be employed. It is intended that the invention only be limited by the scope of the claims and the equivalents thereof.

BRIEF DESCRIPTION OF THE DRAWINGS

In the annexed drawings:

in FIG. 41 and subsequent drawings showing such side elevation views of the transmission in operative modes of forward, neutral or reverse, the views are not through straight vertical sections of FIG. 40, but rather are through sections sufficient to show the functional interrelation and operation of several parts which are angularly disposed about the transmission axis;

DETAILED DESCRIPTION OF THE INVENTION

Introduction

Figure 1A:
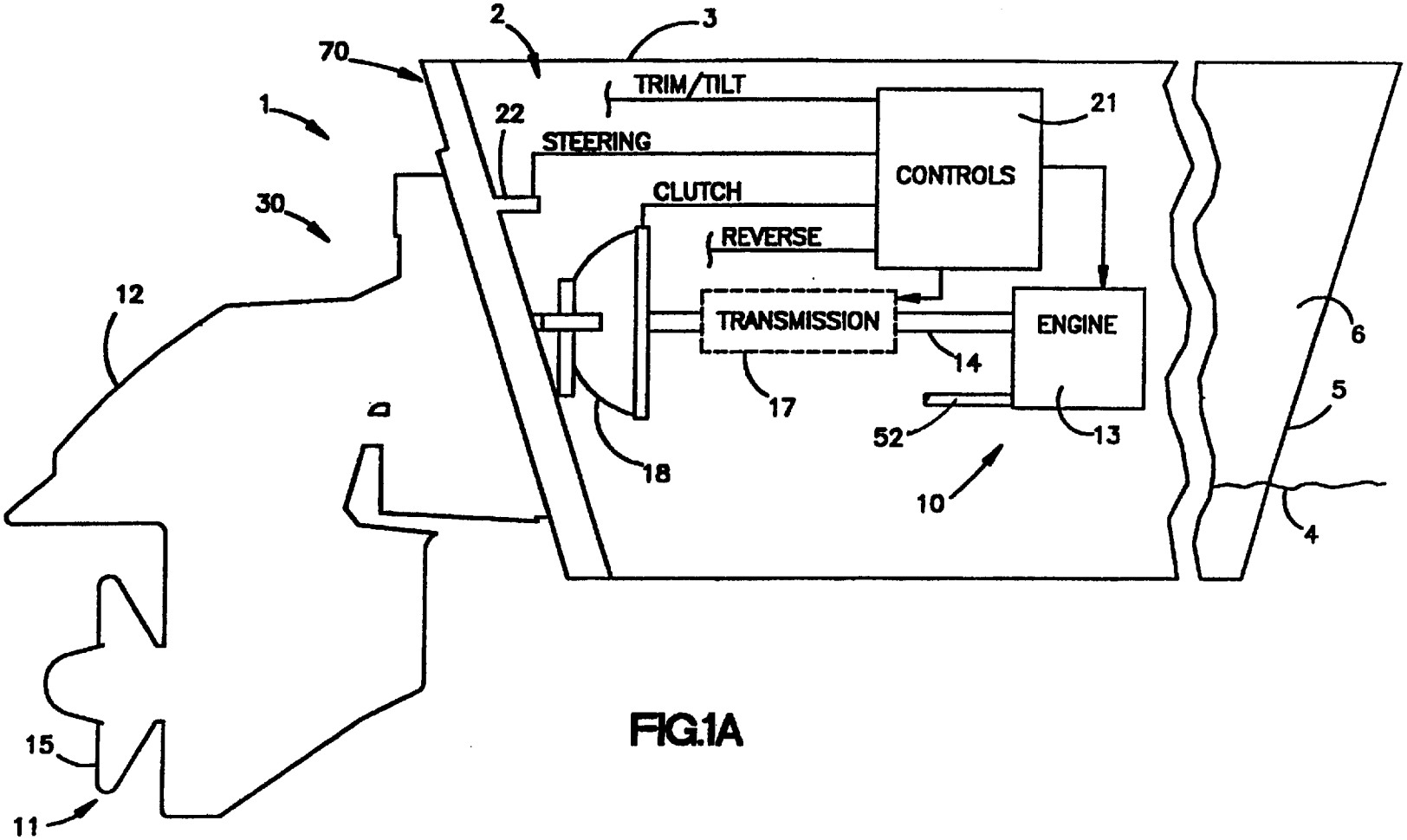
FIGS. 1A and 1B are schematic illustrations of a boat and an inboard/outboard drive system therefor, including an outdrive according to an embodiment of the invention.
Figure 1B:
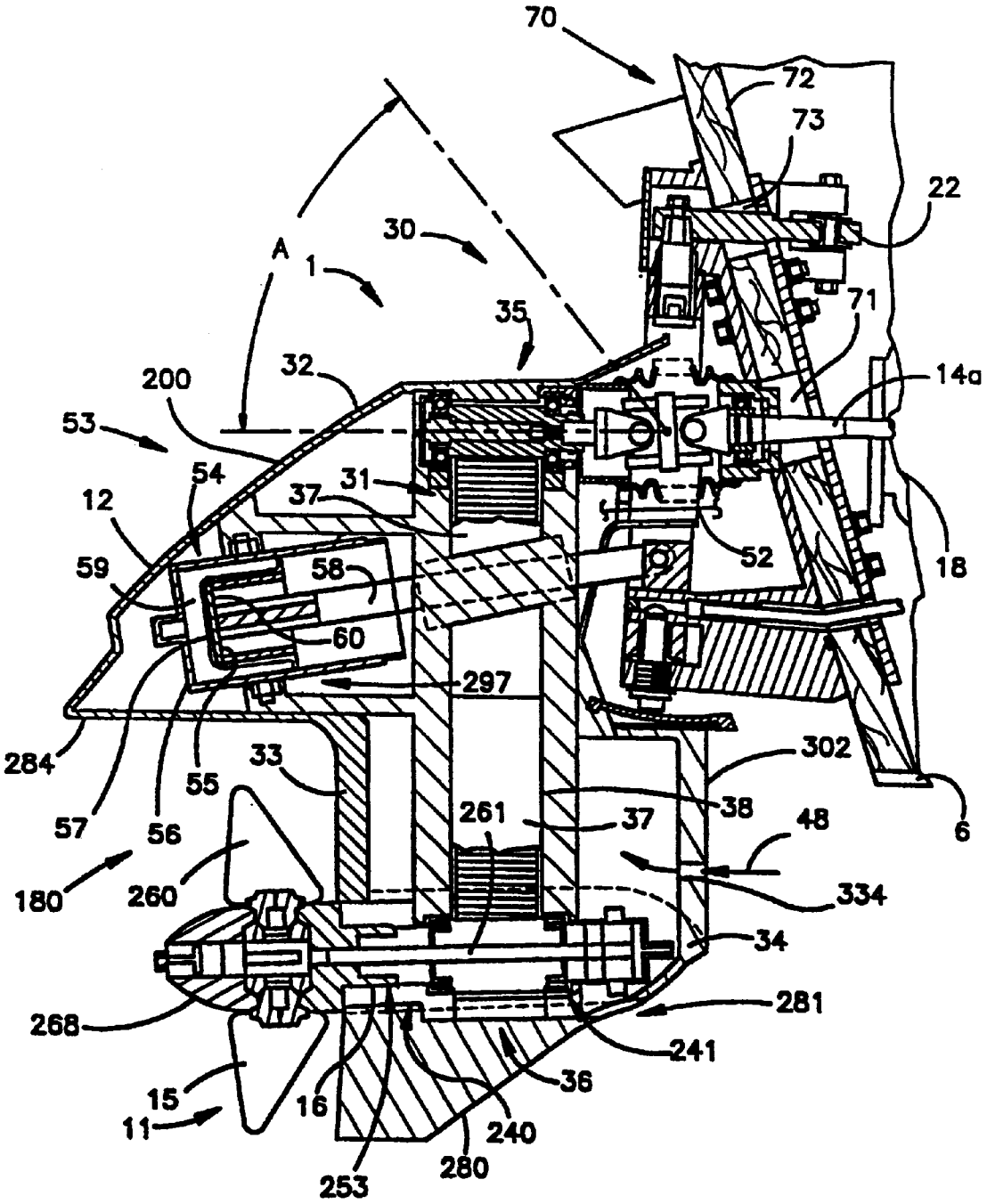
Figure 2:
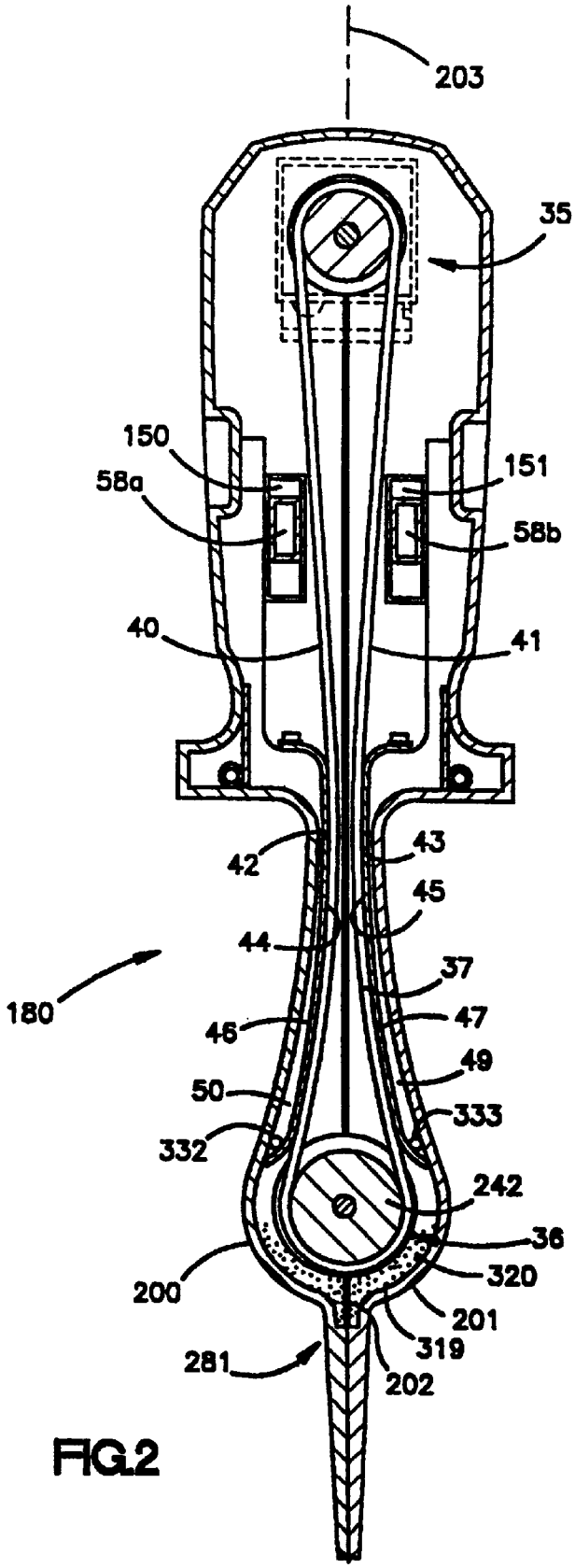
FIG. 2 is a front elevation view partly in section of the belt drive system with the back benders.

Referring in detail to the drawings, wherein like reference numerals designate like parts in the several figures, and initially to FIGS. 1A, 1B and 2, a power coupling system 1 in accordance an embodiment of the present invention is illustrated coupled in a drive system 2 of a boat 3 (or other water craft). An exemplary waterline is represented at 4 near the bow 5 of the hull 6 of the boat 3. The illustration of the boat is schematic and does not necessarily represent any specific boat or operational positioning or condition thereof, e.g., at rest, at slow or high speed, etc., relative to the water or otherwise. When the boat is at rest or is not at plane, the stern will be lower in the water than is illustrated, as is conventional.

The drive system 2 is of the inboard/outboard type, including a power supply 10, an output mechanism 11, the power coupling system 1, and a housing 12. The housing 12 provides functions of structural support, spacing and enclosing for the power coupling system 1 and the output mechanism 11. As was mentioned above, the power coupling system 1 of the invention may be employed with other types of drive systems 2 for boats or other vehicles.

Figure 24:
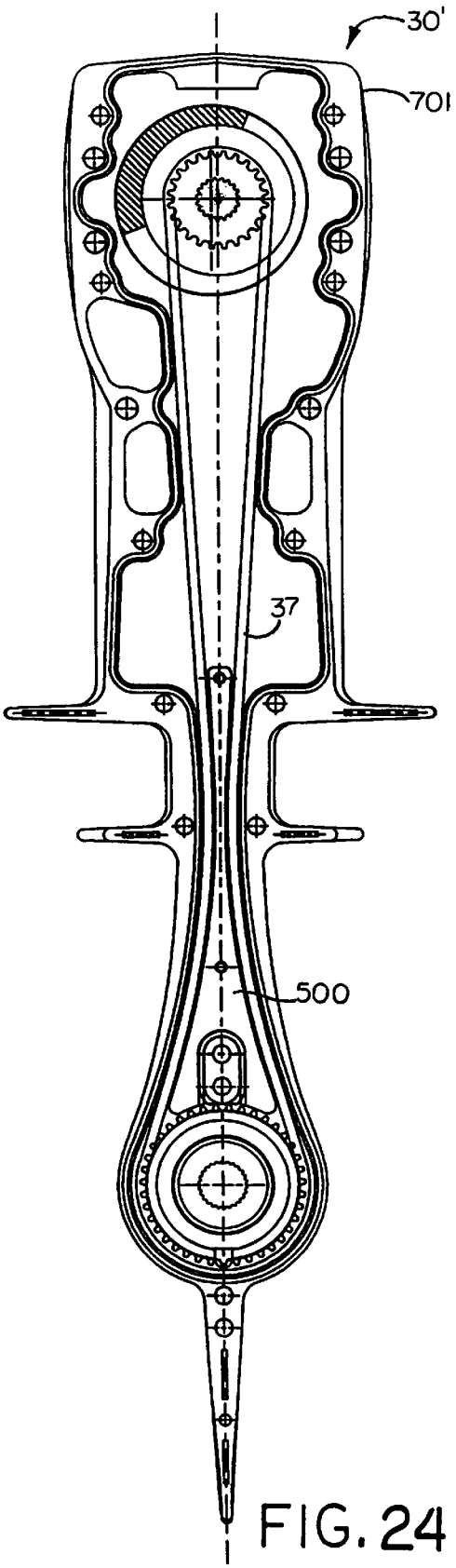
FIG. 24 is a front elevation view of the aft metal housing part.
Figure 25:
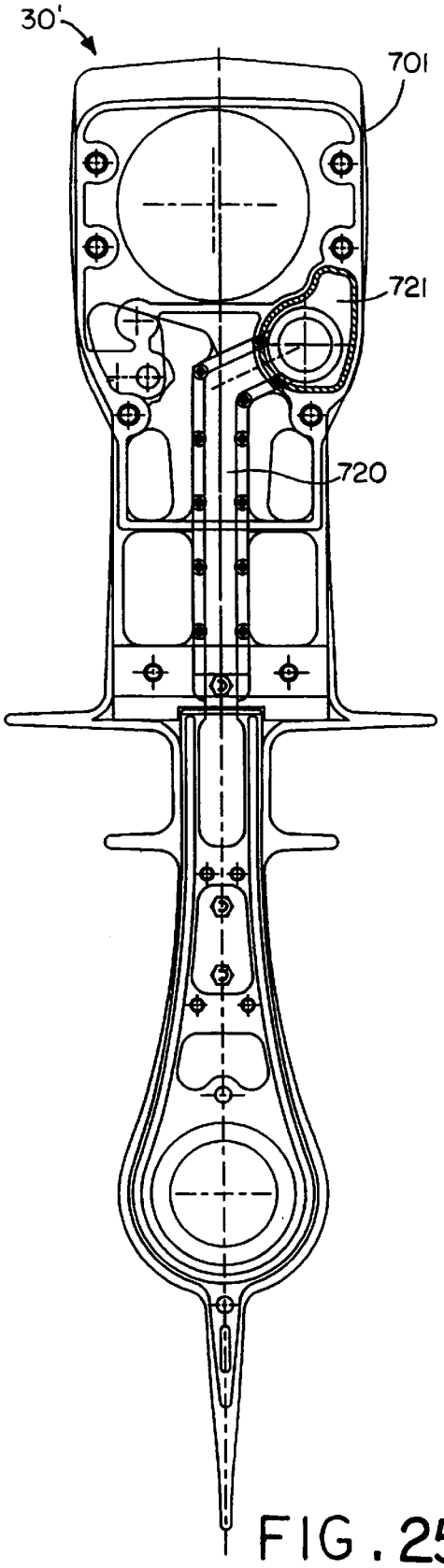
FIG. 25 is a front elevation view of the forward metal housing part.

As is described in further detail below, the invention employs a number of novel features. Several of these include back bending of a drive belt 37, a stuffer 500 (FIG. 22 and 24) to reduce energy losses, e.g., due to unnecessary pumping, cooling using a part of the housing that is thermally conductive substantially directly to the water in which the boat is immersed, and techniques for pretensioning the drive belt 37. These and other features are described below. Furthermore, a number of features in combination can be employed in accordance with the invention to provide an efficient and cost effective power coupling system for a boat drive 30 or the like. Several exemplary advantages of using primarily plastic material in the power coupling system of a boat drive 30 include the elimination or reduction of corrosion problems, galvanic corrosion interaction caused by anti-fouling paints, due to stray electric currents, and/or other sources, and/or the like, facility and low cost of manufacturing, lightness of weight, and so on, to name but a few. The housing 12 may be a hybrid, e.g., plastic and metal, the metal portion designated 12*a* (in FIG. 21).

Initially, reference is made to and an abbreviated description is presented here of the embodiments and features illustrated in FIGS. 1–20, which correspond to the disclosure in U.S. Pat. No. 5,178,566 which is incorporated by reference. Reference is made to the '566 patent for additional verbal description of such features which are only surveyed herein for brevity purposes. For convenience the same reference numerals are used in FIGS. 1–20 herein and in the '566 patent. Additional improvements and features are subsequently described herein, particularly with respect to FIGS. 22 through 51.

Since a belt drive 31 is used in the power coupling system, the housing therefor can be made of plastic, which is less stiff than metal. Back bending the belt 37, which is described in detail below, enables the power leg of the power coupling system, i.e., that portion which is in the water, for example, to have a relatively narrow profile or cross-sectional area transverse to the direction of travel through the water; and this characteristic improves hydrodynamics of the power leg, thus reducing drag in the water.

In the exemplary embodiment of the invention, then, the power supply 10 is an engine 13. The engine has a drive shaft 14 which is rotated by the engine to provide power that ultimately causes rotation of the propeller 15, which is mounted on a propeller shaft 16.

If desired, although not necessarily preferred, a conventional transmission 17 may be included in the power coupling system 1 for the conventional purposes provided by a transmission. For example, the transmission may include reverse, neutral and forward gears to determine the direction of rotation of the propeller 15 and/or whether it rotates at all, as the drive shaft 14 is rotated. The transmission 17 also may include additional gears or other mechanism to change the ratio of the rotational speed of the propeller 15 with respect to the rotational speed of the drive shaft 14. The transmission is shown in dotted outline in FIG. 1A because it is possible that such transmission may be omitted in the case that it is desired to have direct coupling of the engine 13 to the outdrive portion of the power coupling system 1.

A clutch 18 also may be included in the power coupling system 1 of the drive system 2. The clutch 18 may be a conventional clutch that serves conventional clutch functions. Exemplary clutches may be an automotive clutch, a dog clutch, or some other clutch of conventional or special design, as may be desired. The clutch 18 may be operated selectively to couple or to decouple the engine drive shaft 14 relative to the other parts of the power coupling system 1. Coupling would be effected, for example, when it is desired to turn the propeller 15 in order to move the boat 3. Decoupling would occur, for example, when the engine 13 is started, when it is desired to allow the engine 13 to run without turning the propeller 15, when gears in the transmission 17 are shifted, etc.

The power coupling system 1 may be considered as including the drive shaft 14, propeller shaft 16, transmission 17 and clutch 18, as those parts cooperate in the transmission of power from the engine to the propeller 15. The power coupling system 1 also includes other portions, as will be described further below.

A number of controls 21 (and, if desired, displays) of conventional electrical, mechanical, hydraulic and/or pneumatic type (or other type), may be included to operate and/or to control various functions of the drive system 2. For example, the controls 21 may be operated by the boat operator to start the engine 13 and/or to determine the engine speed. The controls 21 also may be coupled to the transmission 17 and to the clutch 18 to adjust gears and/or clutching functions in conventional fashion. Further, the controls 21 may be coupled to a power steering actuator which operates a tiller arm 22 to steer the boat. Still further, the controls 21 may be coupled to the power coupling system 1 to control trim and tilt functions, as are described in further detail below as well as locking to avoid tilting when driving in reverse. The controls 21 may include mechanical, electrical, hydraulic, and/or pneumatic controls and/or linkages, and so on, which are available to effect the desired control functions of the drive system 2. The controls 21, engine 13, transmission 17 and clutch 18 may be mounted in the boat 3 in a conventional fashion and are operative, for example, in conventional fashion, to supply power in the form of rotational energy via the various other portions of an outdrive 30 of the power coupling system 1 to rotate the propeller 15.

The Outdrive 30

A significant component of the outdrive 30 is the housing 12, and according to an embodiment that housing is made of plastic material or of a material that has the characteristics of plastic material. Since plastic ordinarily is less stiff than metal, such as an aluminum housing, and tends to creep more than metal would, a belt drive assembly 31 is used to couple power from the upper housing portion 32 through the down leg 33 portion of the housing to the lower housing portion or torpedo 34.

The belt drive assembly 31 includes a pair of upper and lower sprockets 35, 36 and a flexible belt 37, for example of rubber or polymer material, which is rotated about and between the sprockets 35, 36. The belt 37 runs in a chamber 38 in the housing 12. A belt drive 31, especially the belt 37 itself, is more forgiving as to positional alignment or tolerances than is a gear and shaft drive typically used in conventional outdrives. To avoid the need for two down legs, as is shown in the above U.S. Pat. No. 3,951,096, while minimizing the cross-sectional area of the down leg 33 required to house the legs 40, 41 (FIG. 2) of the belt 37 and presented transversely of the direction of travel through the water, the belt legs 40, 41 are bent toward each other. Such bending is effected by back benders 42, 43, which in the preferred embodiment are of metal material that have smooth surfaces 44, 45 over, on, across, etc., which the belt 37 slides.

It will be appreciated that a belt 37 is but one form of flexible coupling member that may be employed in the invention, as was mentioned above. Preferably that flexible coupling member is in the form of a continuous loop or endless loop and is able to transmit rotary motion, torque, and, thus, power from the power input portion to the power output portion of the outdrive 30. An exemplary belt 37 is sold by Gates Rubber Company under the model or brand Polychain, GT or GTX.

Figure 22:
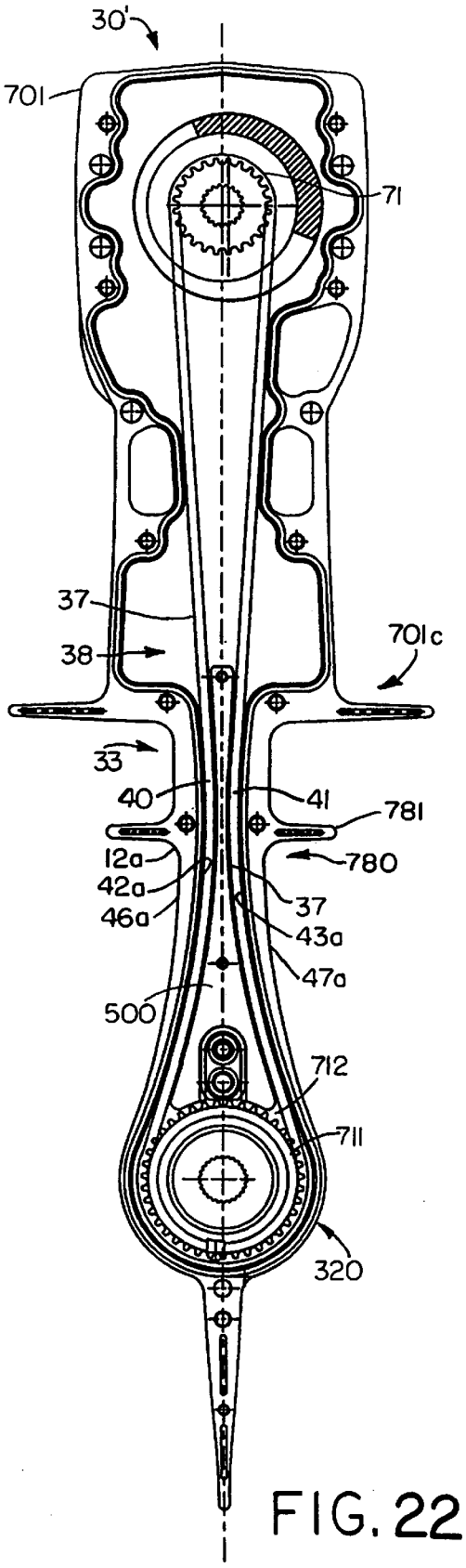
FIG. 22 is an aft elevation view of the forward metal housing part of the hybrid housing.

Heat may be developed in the outdrive 30, for example by the belt 37 as it is bent and flexed by the back benders 42, 43 and the sprockets 35, 36 and as it slides on the back benders 42, 43. Heat also may be developed at other parts of the outdrive 30, for example, at the respective sprockets 35, 36 due to friction losses or the like. The back benders 42, 43 may be metal plates to conduct heat to cooling liquid, e.g., water, flowing in contact with surfaces 47, 48 in chambers 49,50 (FIG. 2). Alternatively, the back benders 42, 43 may be an integral part of the housing 12a wall 46*a*, 47*a* as shown in FIGS. 22 ans 24, for example. The surfaces 46*a*, 47*a* are exposed to the external ambient, e.g., the water, (i.e., outside relative to inside the belt chamber 38) to remove heat from the back benders 42, 43 and, thus, from the outdrive 30.

As is shown in FIG. 2, fluid 51, for example, oil 712, in the belt chamber 38, which provides a lubricating function for the belt 37 and, if desired, for the sprockets 35, 36, transfers heat from the outdrive 30 to the back benders 42, 43, for example at the surfaces 44, 45. Whether the fluid 51 provides boundary lubrication or fluid film lubrication, e.g., depending on thickness of the lubricant between the belt 37 and back bender 42, 43 surfaces 44, 45, it has been found that there is adequate heat transfer to the back benders 42, 43. The belt 37 tends to scrub the oil 712 against the back benders 42, 43 to avoid boundary layers and to achieve good thermal transfer.

Preferably the back benders 42, 43 are made of a relatively efficient thermally conductive material, such as metal, especially aluminum. Cooling flow 48 (FIG. 1B) of water in the outdrive 30 also may provide cooling for the outdrive 30. The source of the cooling water flow 48 may be from the water in which the boat is immersed. For example, an opening in the housing 12 may provide an inlet for such water. The water flow 48 usually would have adequate cooling capacity after having removed some heat from the back benders 42, 43, so the flow paths (chambers) 49, 50, may be joined at 52 (FIG. 1B) and directed to couple the water flow to the engine 13 for cooling the engine in conventional fashion.

An exemplary trim, tilt and kickup mechanism provided the outdrive 30 is shown at 53. Further details are described in the '566 patent. Other conventional trim, tilt and kickup mechanisms alternatively may be used.

The outdrive 30 is included in the power coupling system 1 and, for convenience, also may be considered to include the output mechanism 11, namely, the propeller 15. The outdrive 30 is mounted at the stern 70 of the boat 3 attached, for example, to a conventional pivot housing assembly and/or gimbal ring. The engine drive shaft 14, or at least an extension portion 14*a* thereof on the output side of the clutch 18 (if such clutch, the transmission, or some other part(s) were used between the engine and the outdrive 30), passes through an appropriate opening 71 in the stern transom 72 of the boat to couple rotary power to the outdrive 30, as is described in greater detail below. Moreover, steering functions for the outdrive 30 are effected via the tiller arm 22, which also is coupled to the outdrive 30 via an appropriate opening 73 in the transom 72. Other connections such as for hydraulic lines, pneumatic lines, mechanical connections, and electrical connections, etc., also may be provided to the outdrive 30 via appropriate openings through the rear transom 72 of the boat or may be otherwise provided to the outdrive 30, as may be desired.

The outdrive mounting structure 80 for mounting and supporting the outdrive 30 from the boat 3 is illustrated in FIGS. 1 and 3–8, is described in detail in the '566 patent, and is summarily described below.

Figure 3:
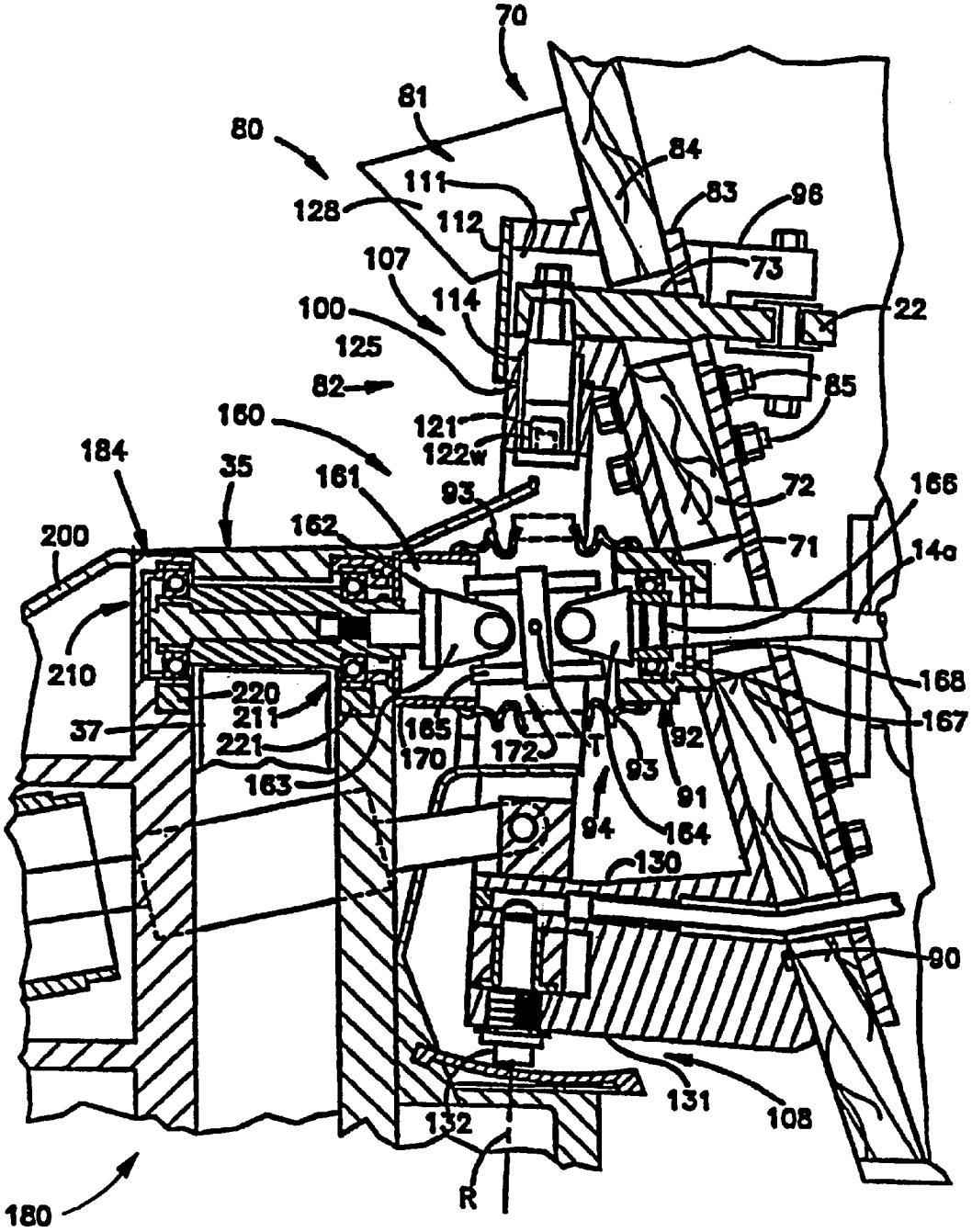
FIG. 3 is a schematic section view looking in side elevation showing the coupling of the outdrive to the transom of a boat.
Figure 4:
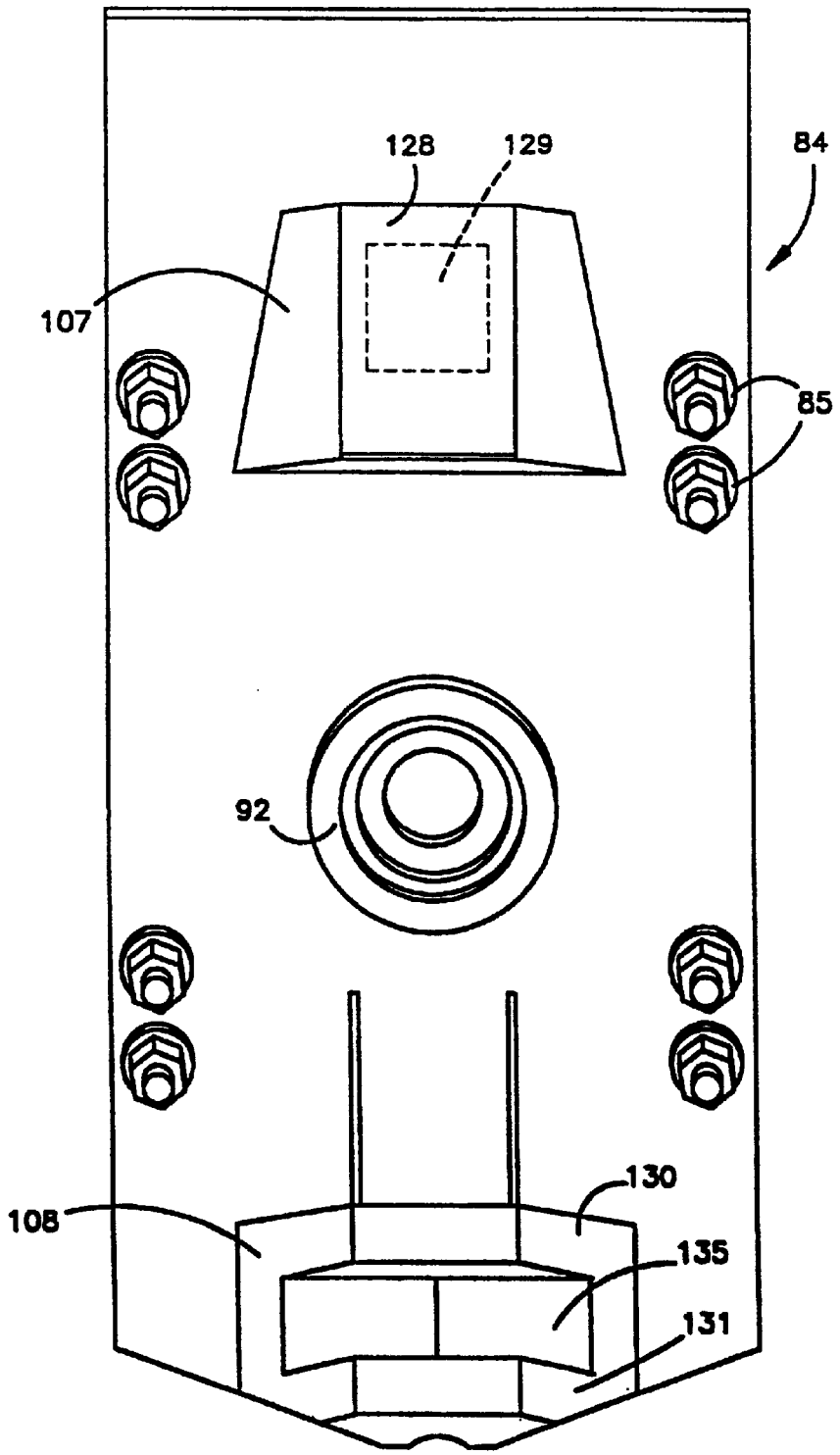
FIG. 4 is a plan view of the outer transom housing.
Figure 5:
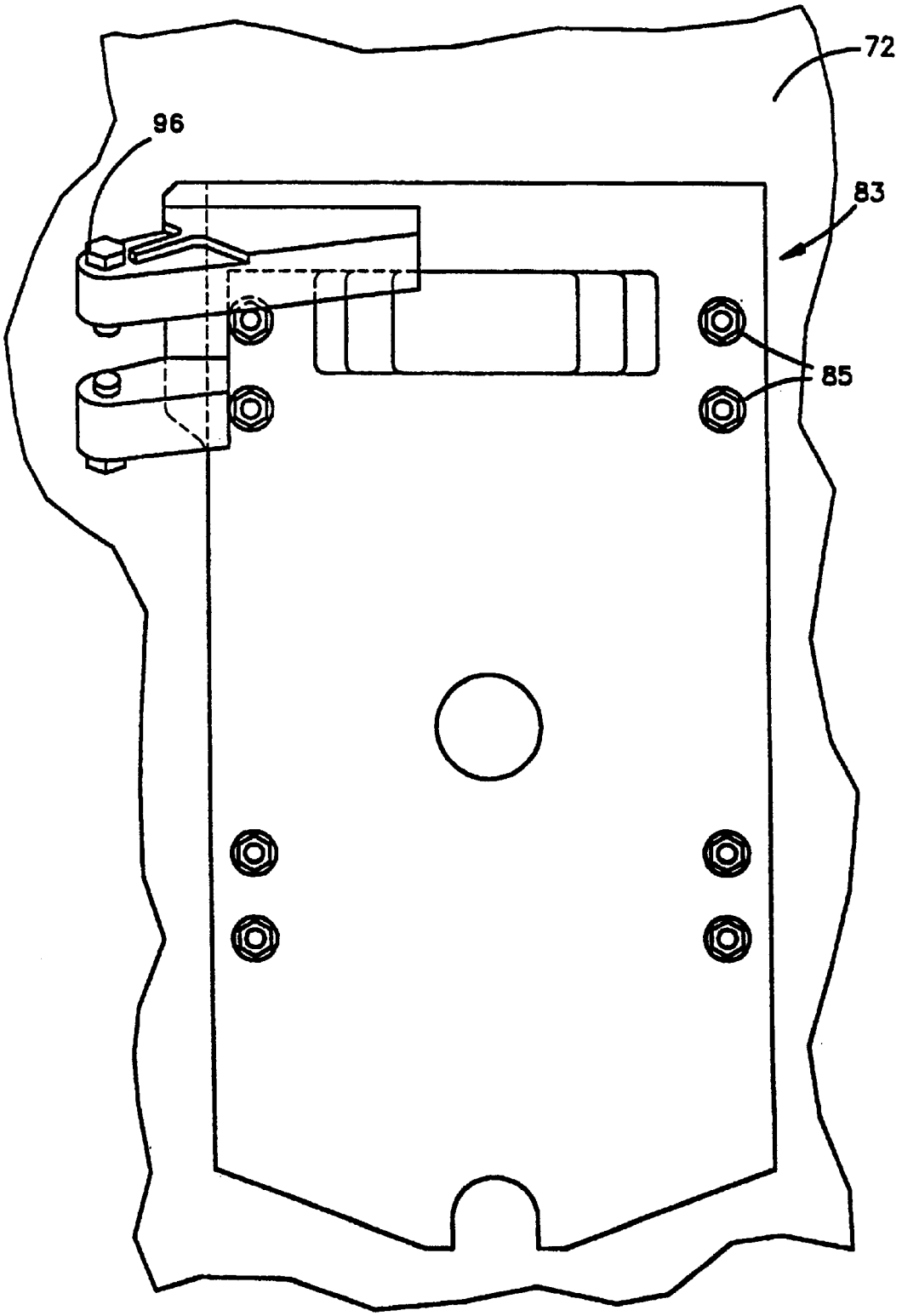
FIG. 5 is a plan view of the inner transom housing.
Figure 6:
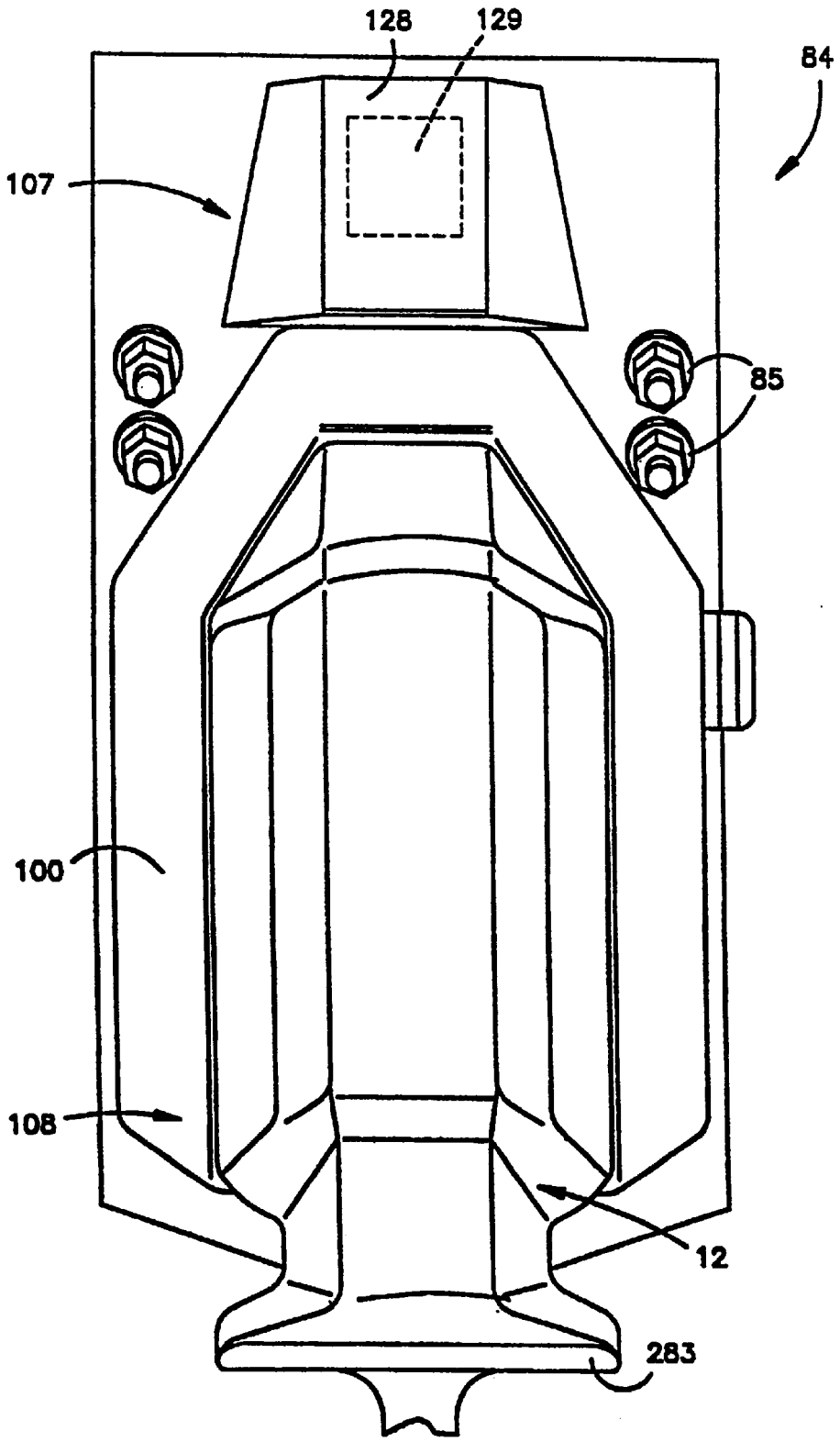
FIG. 6 is a plan view of the gimbal ring and outdrive positioned in the outer transom housing.
Figure 8:
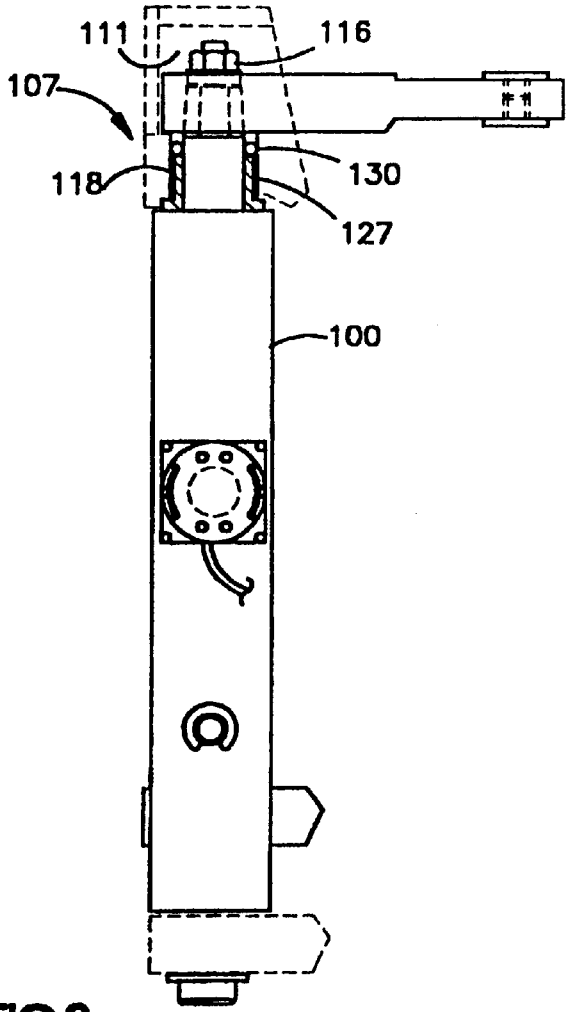
FIG. 8 is a side elevation view of the gimbal ring in section.
Figure 7:
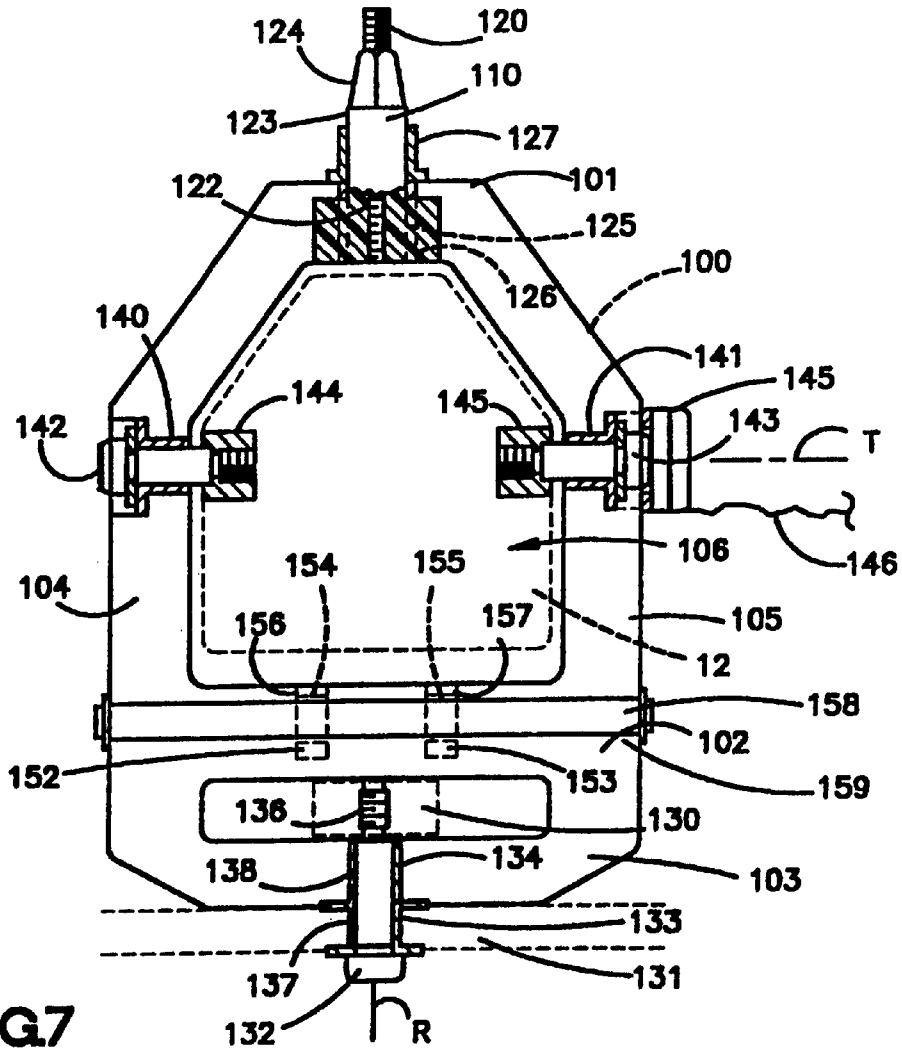
FIG. 7 is a front elevation view of the gimbal ring in section.
Figure 7A:
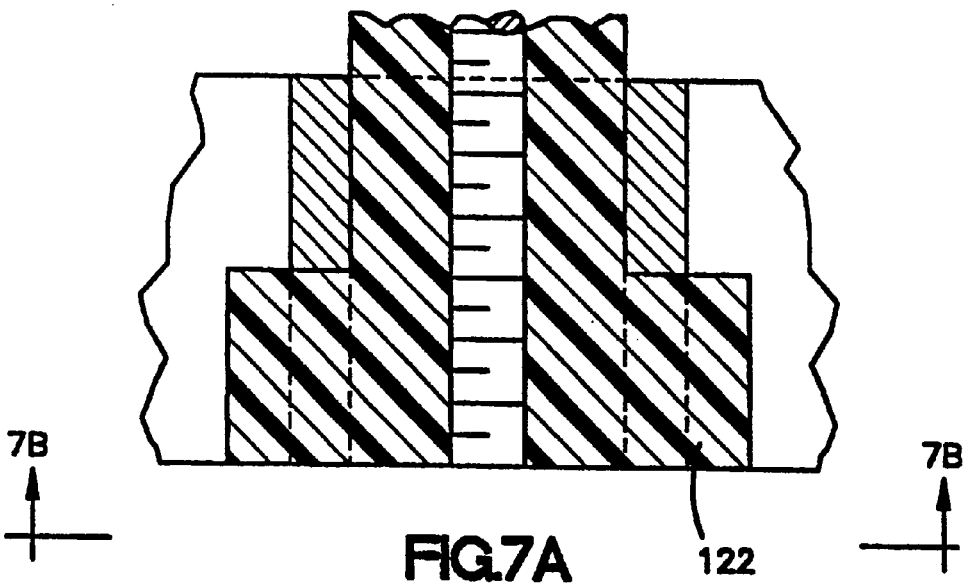
FIG. 7A is an enlarged side elevation-fragmentary view of the gimbal ring and upper rudder pin.
Figure 7B:
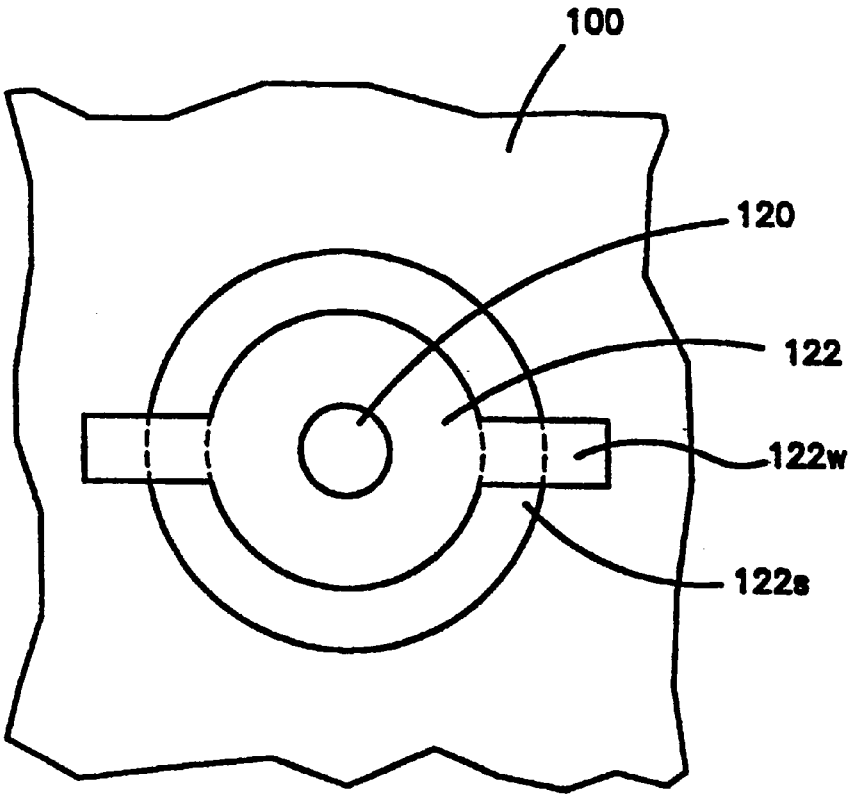
FIG. 7B is a fragmentary bottom view of the gimbal ring and upper rudder pin of FIG. 7A.
Figure 9:
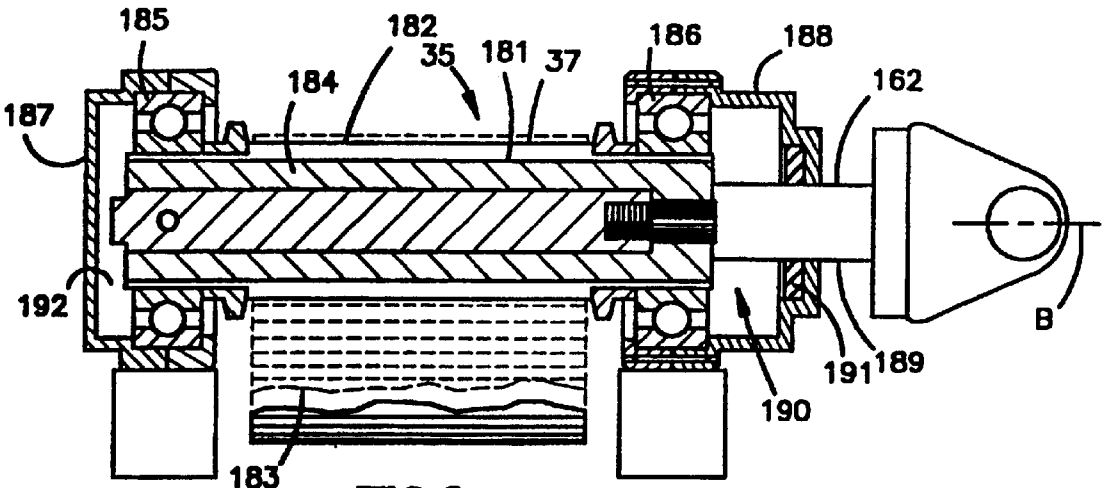
FIG. 9 is a side elevation view, partly in section, of an upper sprocket assembly.

Referring to FIG. 3, a main gasket extends about the outer transom housing 84 facing the boat and prevents water leakage into the boat. The drive shaft 14a passes through a gimbal bearing 91, which is enclosed in a gimbal bearing housing 92 that is part of the outer transom housing; and the drive shaft 14, 14*a* is covered by a water tight flexible boot 93, for example, of rubber, at the connection thereof to the power input 94 for the outdrive 30. The gimbal bearing housing 92 and boot 93 prevent water leakage at the drive shaft 14a. The tiller opening 73 also is made water tight to prevent water leakage into the boat.

Continuing to refer to FIG. 3, mechanical power is supplied the outdrive 30 via the outdrive power input 160, which includes a conventional universal joint 161, the gimbal bearing assembly 91, engine drive shaft 14, 14a as an input shaft, and a rotatable shaft 162 at the output side of the universal joint. The universal joint 161 is a conventional device having respective input and output connectors 163, 164, which are respectively coupled to the drive shaft extension portion 14a and rotatable shaft 162 and are coupled to each other via the universal joint housing 165. As is conventional, the universal joint 161 couples rotary motion between the input and output connectors 163, 164 thereof while also permitting relative movement of those connectors in one or more planes and/or along one or more axes. The center of pivot of the universal joint 161 is located at the intersection of the rudder axis R and the tilt axis T. This arrangement permits freedom of rotation for the outdrive 30 about the rudder axis R and/or tilt axis T without interfering with the coupling of rotary power or torque through the universal joint 161.

A power input chamber 170 of the housing 12 circumscribes the connector 164 of the universal joint 161 and part of the shaft 162. The flexible boot 93 circumscribes the universal joint 161 and associated parts and is fastened between the outdrive housing 12 at the power input chamber 170 and the gimbal bearing housing 92 primarily to prevent water and dirt from entering the area 172 where the universal joint and associated parts are located. The flexible boot prevents water from entering such area 172 and from there gaining access into the boat. The flexible boot 93 permits the outdrive 30 to tilt about tilt axis T and to rotate about rudder axis R while still maintaining the function of enclosing the area 172.

Outdrive 30 Power Leg 180

The outdrive 30 includes a so-called power leg portion 180 intended to transfer or to couple power received via the outdrive power input 160 to the propeller 15. In the illustrated embodiment of the invention, the propeller 15 is a constant pitch propeller. Therefore, rotation of the propeller in one direction will tend to drive the boat forward and rotation of the propeller 15 in the opposite direction will tend to drive the boat in reverse direction. Reversing of the propeller 15 rotation direction can be achieved by appropriate adjustment of the transmission 17. Alternatively, other means may be provided to change or to reverse the pitch, rotational direction and/or direction of thrust of the propeller 15.

Upper Sprocket Assembly 35

Figure 10:
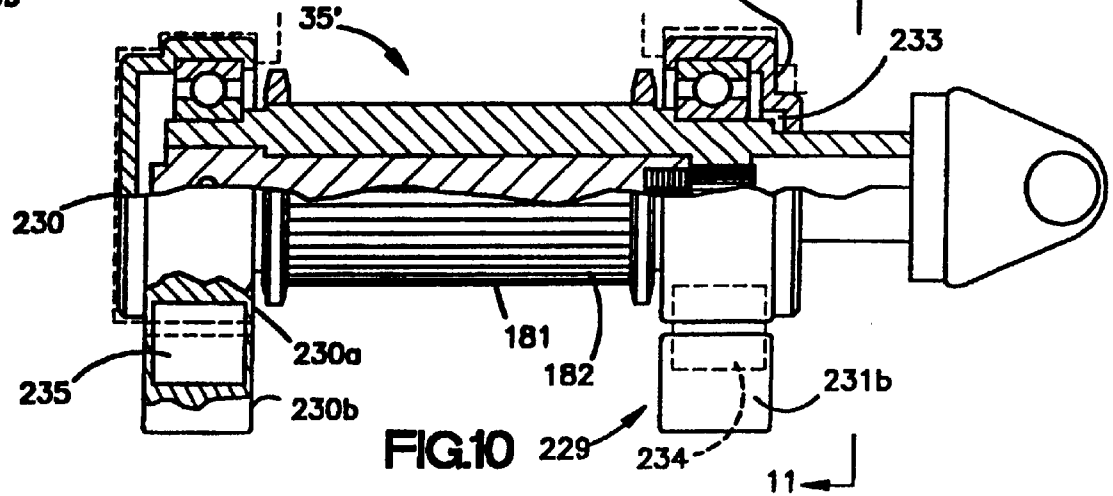
FIGS. 10 and 11 are, respectively, side elevation view, partly in section, and end view of a dynamic tensioning upper sprocket assembly.
Figure 11:
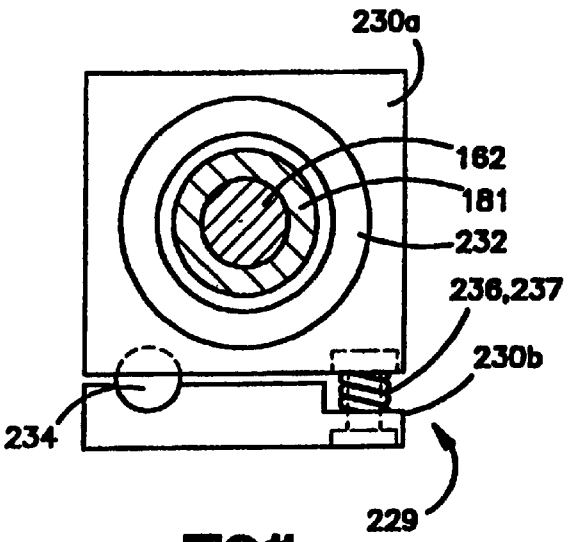
Figure 12B:
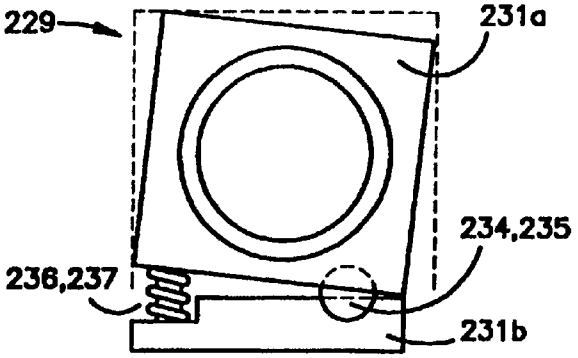
FIGS. 12A and 12B are, respectively, schematic illustrations depicting operation of the dynamic tensioning mechanism of the sprocket assembly of FIGS. 10 and 11.
Figure 12A:
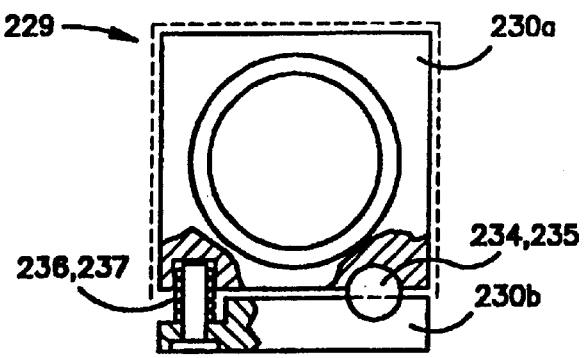

One example of the upper sprocket assembly 35, which is seen in FIGS. 1, 2, 3 and 9, includes a sprocket 181 having a plurality of teeth or grooves 182 intended to cooperate with the teeth 183 (shown in FIG. 9) in the belt 37 to move the belt 37, such motion being referred to as rotation of the belt 37, as the upper sprocket assembly 35 is turned. In this regard, the rotatable shaft 162 from the universal joint 161 is coupled to the upper sprocket assembly 35 to turn the same and, thus, the belt 37. Various parts and operation of the upper sprocket assembly 35 and a dynamic tensioning mechanism therefor, e.g., as is illustrated in FIGS. 10–12, are described in further detail in the '566 patent.

The upper sprocket assembly 35 is mounted in the mechanical eccentric 901 described further below.

The various portions of the upper sprocket assembly 35 may be made of plastic material or of metal. For example, one or more of such parts may be made of various plastic materials so as to be relatively strong, relatively light in weight and not subject to corrosion. Preferably such parts can be made using relatively inexpensive methods, such as molding or extruding. The seal 191 may be of rubber, plastic or other material that provides an adequate sealing function for the described purpose.

Lower Sprocket Assembly 36

Figure 13:
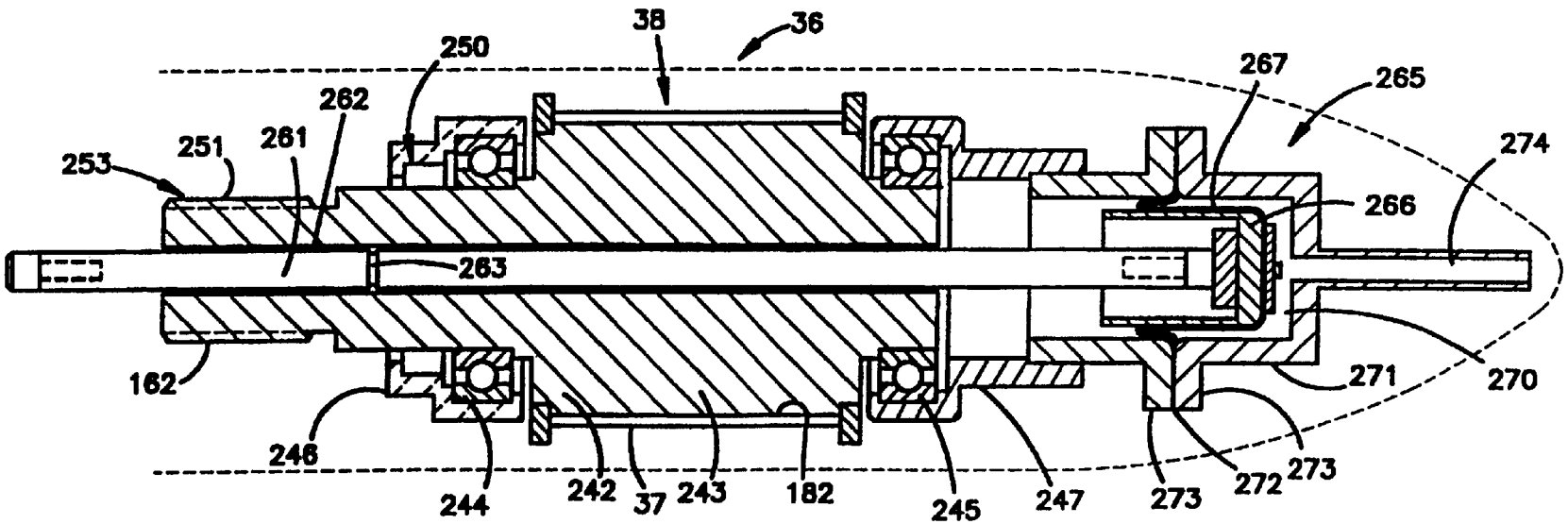
FIG. 13 is a side elevation view, partly in section, of the lower sprocket assembly.
Figure 14:
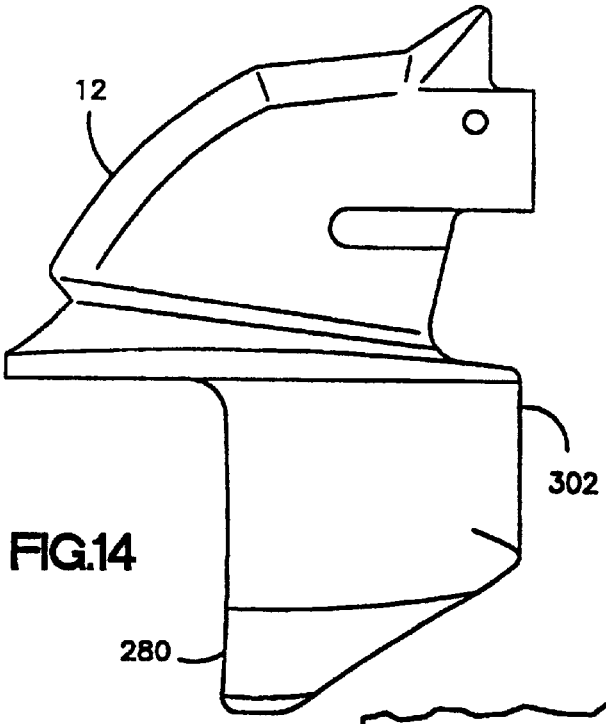
FIGS. 14, 15, and 16 are, respectively, side, front and back views of the outdrive housing.
Figure 15:
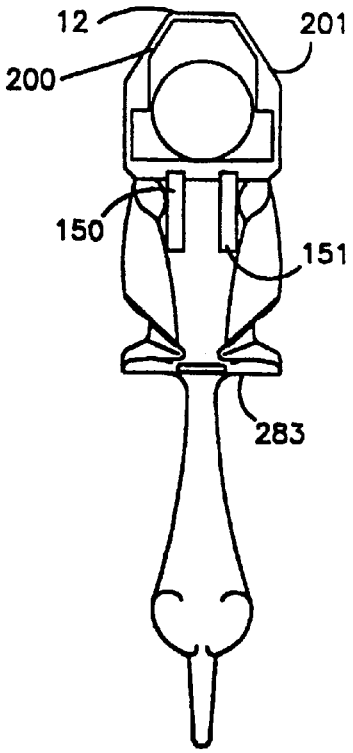
Figure 14A:
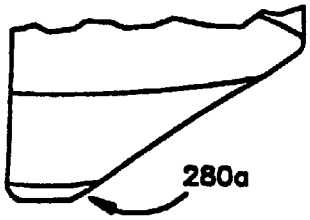
FIGS. 14A and 16A are, respectively, fragmentary side and back views of the bottom area of the outdrive housing showing a winged skeg arrangement of an alternate embodiment of the invention.
Figure 16:
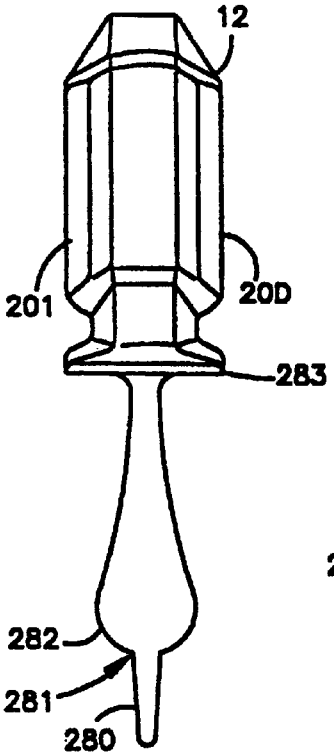
Figure 16A:
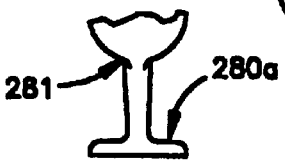
Figure 17:
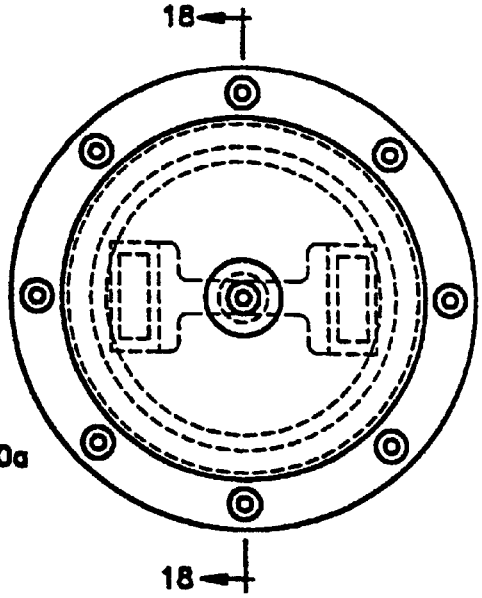
FIGS. 17 and 18 are, respectively, end and section views of the trim, tilt and kickup actuator assembly.
Figure 18:
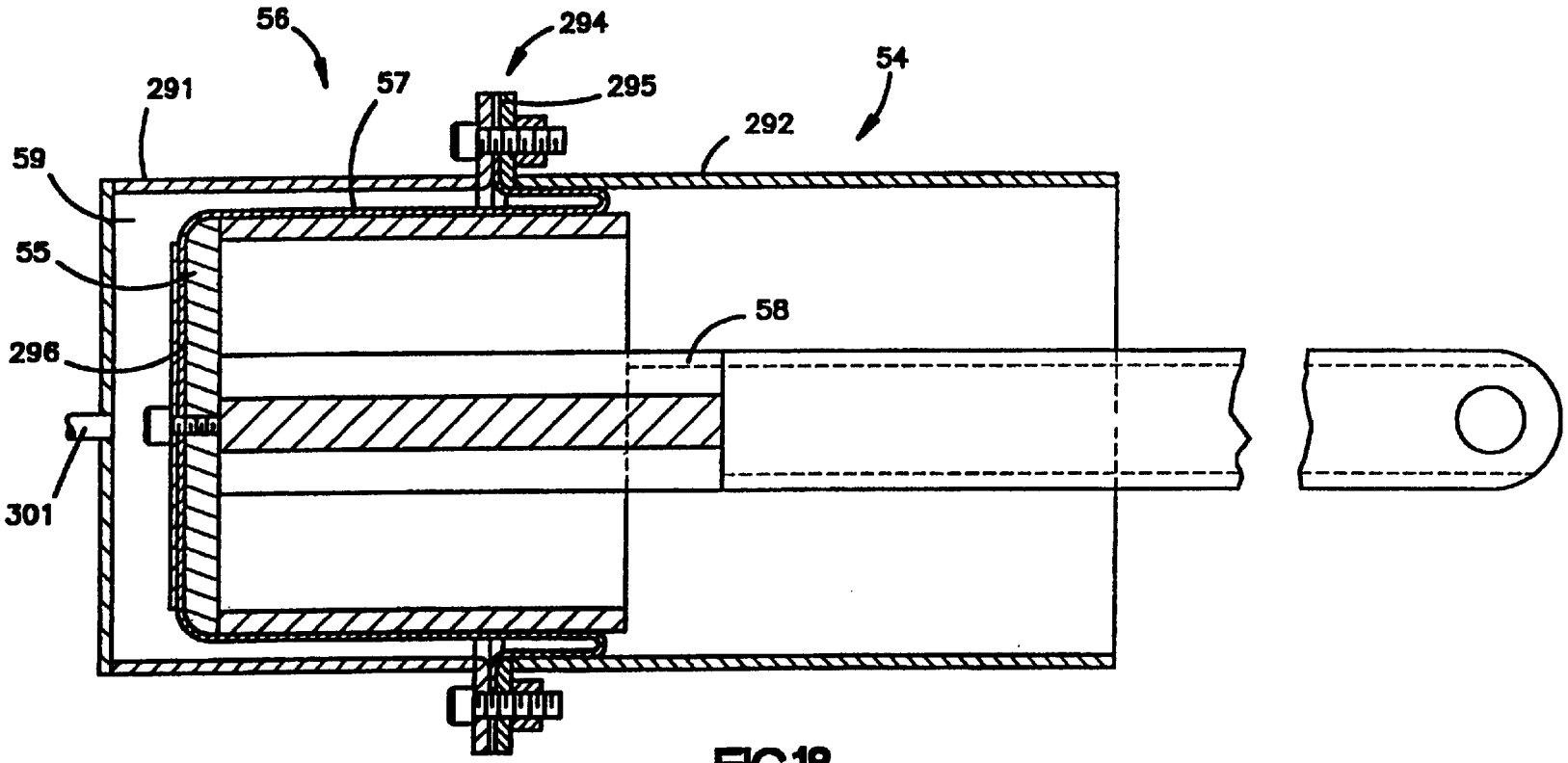
Figure 19:
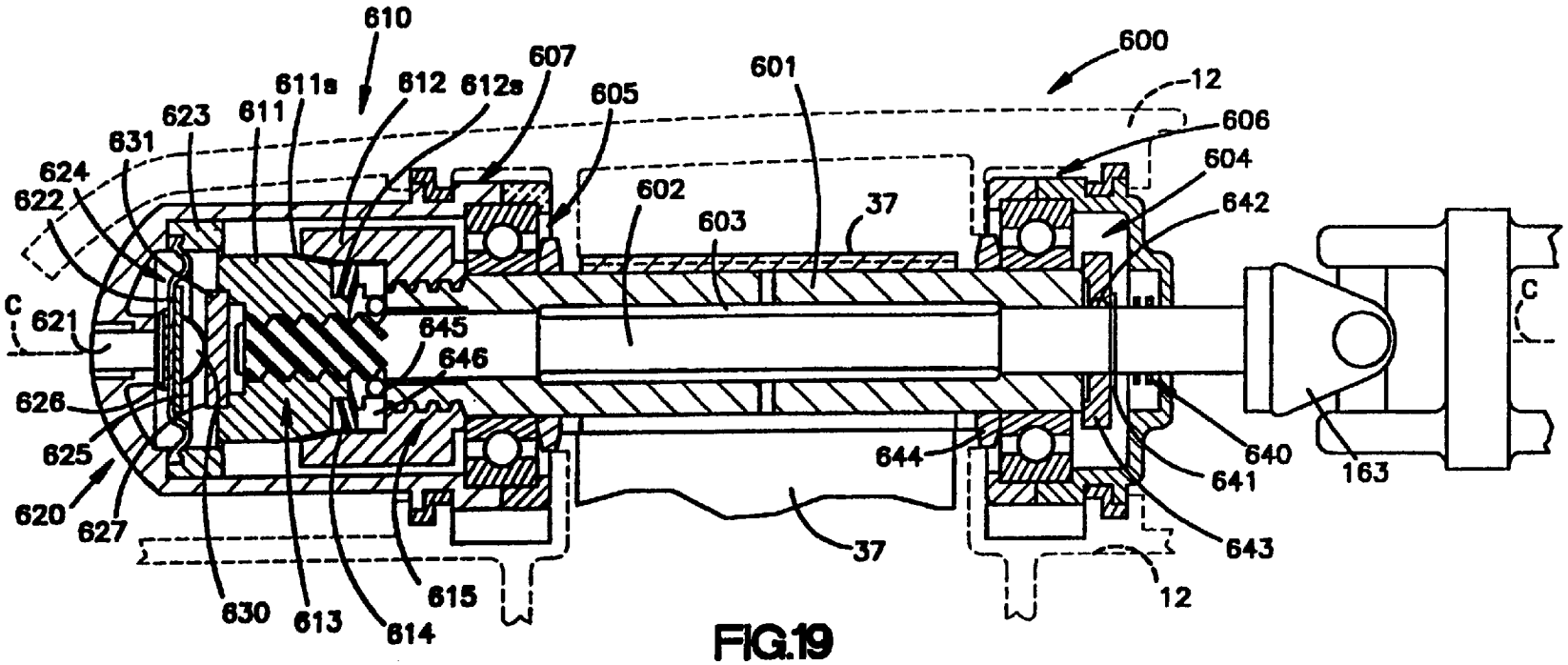
FIG. 19 is a side elevation view, partly in section, of a cone clutch assembly used with the upper sprocket assembly.
Figure 20:
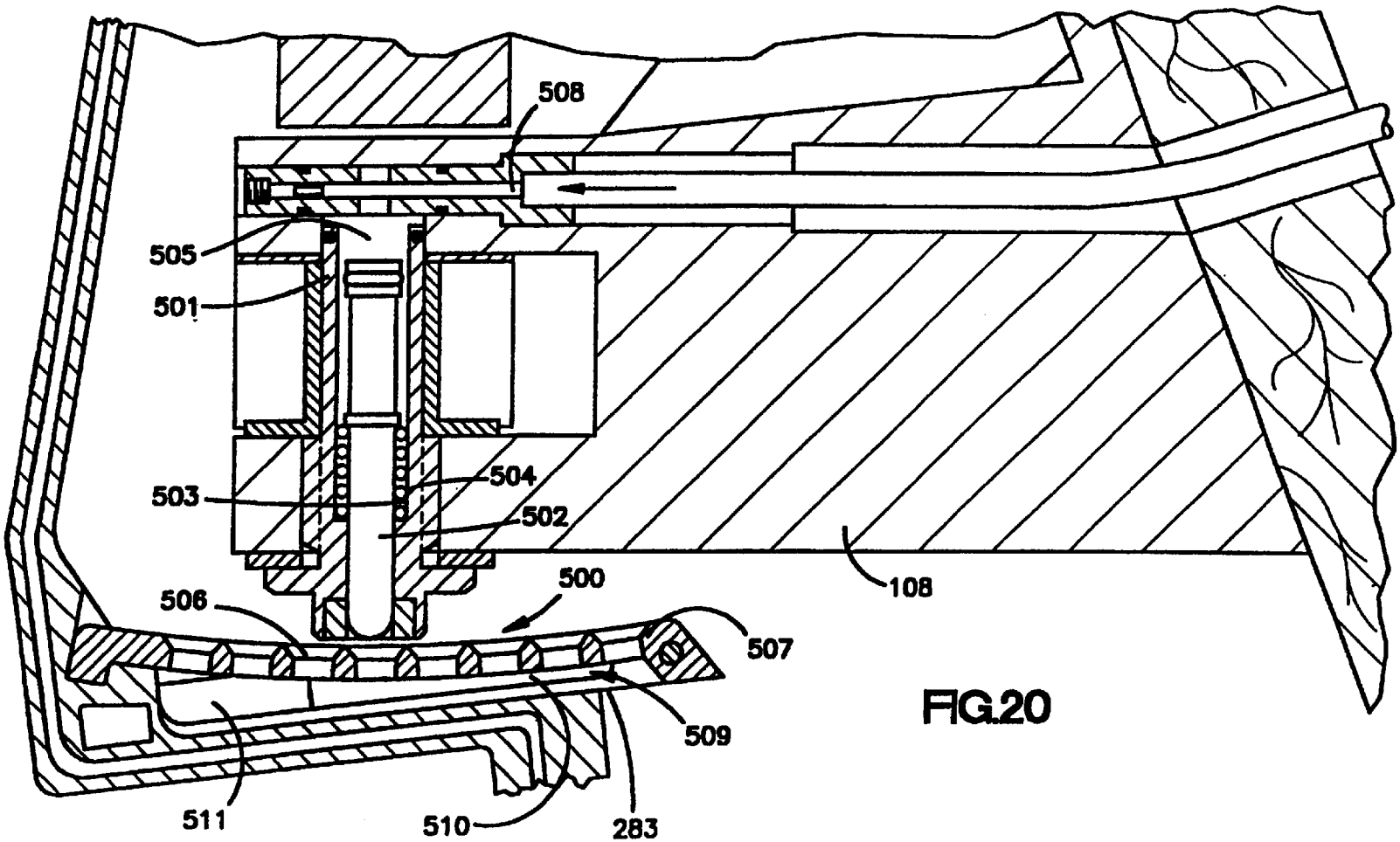
FIG. 20 is a schematic illustration of a locking mechanism to prevent inadvertent kickup of the outdrive power leg when operating to provide reverse thrust.

Referring to FIGS. 1 and 13, which are summarily described below and are described in further detail in the '566 patent, the lower sprocket assembly 36, too, preferably is generally of a cartridge design mounted in the housing 12 by pairs of horizontal and vertical bosses 240, 241 that form rails with respect to the upper sprocket assembly 35. The lower sprocket assembly 36 includes a sprocket 242 that has a plurality of teeth 243 which mesh with the teeth 183 of the belt 37. The diameter of the lower sprocket 242 is generally larger than the diameter of the upper sprocket 181 and the sprocket assemblies 35, 36 have a correspondingly different number of teeth. Therefore, a rotational speed reduction is effected between the rotatable shaft 162 and the propeller 15 due to the ratio of the diameters and number of teeth on the respective sprockets 181, 242. Using different ratios, different speed reduction effects can be obtained without using additional gears, transmissions, or the like. Of course, if desired, a 1:1 ratio of diameters and teeth also may be used. Further, if a non-toothed belt 37 were used, the sprockets 35, 36 preferably would not have teeth. Preferably the space between teeth on the upper and lower sprockets 181, 242 is about the same and the ratio of the number of teeth on the larger to the smaller is from about 2:1 to about 1:1; and more preferably from about 1.7:1 to about 1.5:1. In an example, the lower sprocket 242 may have on the order of 39 teeth and the upper sprocket 181 may have on the order of 22 teeth. Using the sprockets to effect a reduction in speed between the rotatable shaft 162 and the propeller 15 provides a desired speed reduction of the type accomplished in the past by conventional gears in prior art outdrives.

The sprocket 242 is supported for rotary motion by a pair of bearings 244, 245, which are secured in position in the manner illustrated by respective cartridge housing portions 246, 247 and generally in the manner described above with respect to the upper sprocket assembly 35. The lower sprocket 36 preferably is fixed and does not move for adjustment. At the rear end of the sprocket 242 are a pair of seals 250 which circumscribe part of a stepped-down diameter output shaft portion 251 of the sprocket 242 to prevent water from reaching the bearing 244 and/or other interior portions of the sprocket assembly 36 and the belt chamber 38. The seals also help to prevent lubricant or other fluid material intended to be in the belt chamber 38 from leaking out. The propeller 15 may be mounted directly onto the output shaft portion 251 of the sprocket 242, for example, by using a threaded fastening connection, a conventional screw fastener, or adhesive material placed at the interfacial area 253 of connection between the propeller 15 and the shaft 251. Other means also may be employed to secure the propeller 15 onto the shaft 251.

It will be appreciated, then, that as the engine produces a rotary output, which is coupled by the drive shaft portion 14*a* to the universal joint 161, the upper sprocket 181 is rotated to cause the belt 37 to be rotated. As the belt 37 is rotated, the lower sprocket 242 is rotated, which then turns the propeller 15.

Variable pitch and reversible pitch propeller 15, external features of the outdrive 30, trim, tilt and kick up features of the outdrive 30, cone clutch sprocket assembly, and tilt lock mechanism (to avoid tilting when operating in reverse) are shown in FIGS. 14–20 and are described in greater detail in the '566 patent.

Back Benders 42, 43

It is desirable that an outdrive 30 have a relatively small cross-sectional area transverse to the direction of travel through the water. See FIGS. 2, 15 and 16. A potential disadvantage in using a belt 37 or other flexible member which has two legs 40, 41 is that space is required to house each of the belt legs 40, 41. In the past such space requirement would have required a relatively broad cross-section or two down legs 33 as in the above Dunlap patent.

However, it has been discovered in accordance with the present invention that the belt 37 can be bent backwards to compress the legs 40, 41 thereof toward each other in a way that tends to minimize the cross-sectional area profile of the outdrive 30 transversely to the direction of travel through the water.

The surfaces of the back benders 42, 43 may be bent or curved in the manner illustrated so as to form a segment of an arc of a circle. Such circle preferably if extended would be tangent or approximately tangent with the travel direction of the belt 37 about the lower sprocket 242. The back benders 42, 43 may be of other shape.

A lubricating medium 51, such as oil, transmission fluid, gear oil, or the like, is in the belt chamber 38. The belt chamber 38 is coupled to a sump 320, which extends from the bottom of the lower sprocket 242 part way up along the sides thereof, between the belt 37 and the housing 12, as is illustrated in FIG. 2. It has been found that an adequate amount of lubricant is available when the sump 320 is filled to a level that is less than about one-half the diameter of the lower sprocket 242. Preferably the fluid 51 is relatively light weight, such as 5 weight or 10 weight. Preferably the fluid provides the lubricating functions and thermal conduction functions described herein. Moreover, it is desirable that the fluid be functional to reduce both static friction and dynamic friction occurring in the outdrive 30.

Transmission

The transmission 930, which may be used for the transmission 17 of FIG. 1A, may be made at least in part out of powdered metal parts, relatively inexpensive parts. The reason is that, it usually spends from 95% to 98% of its life in forward or neutral. In forward or neutral, none of the gears are in motion. They are placid. So most of the time the gears are not used for anything. The only time they are used for anything is when going backwards. One ordinarily does not go at full power in reverse.

Figure 21:
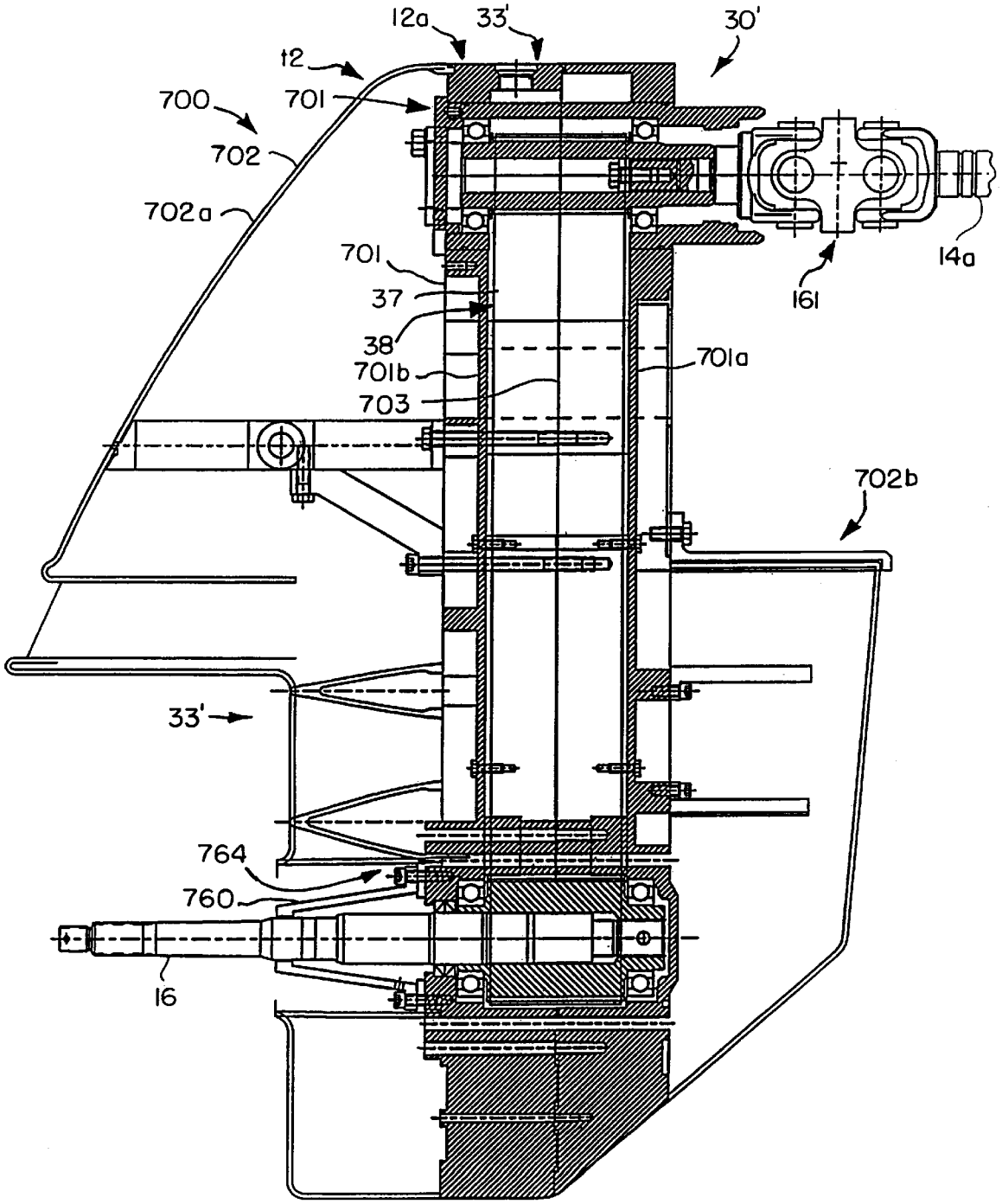
FIG. 21 is a schematic side elevation view, partly in section of another embodiment of outdrive with a hybrid housing.
Figure 23:
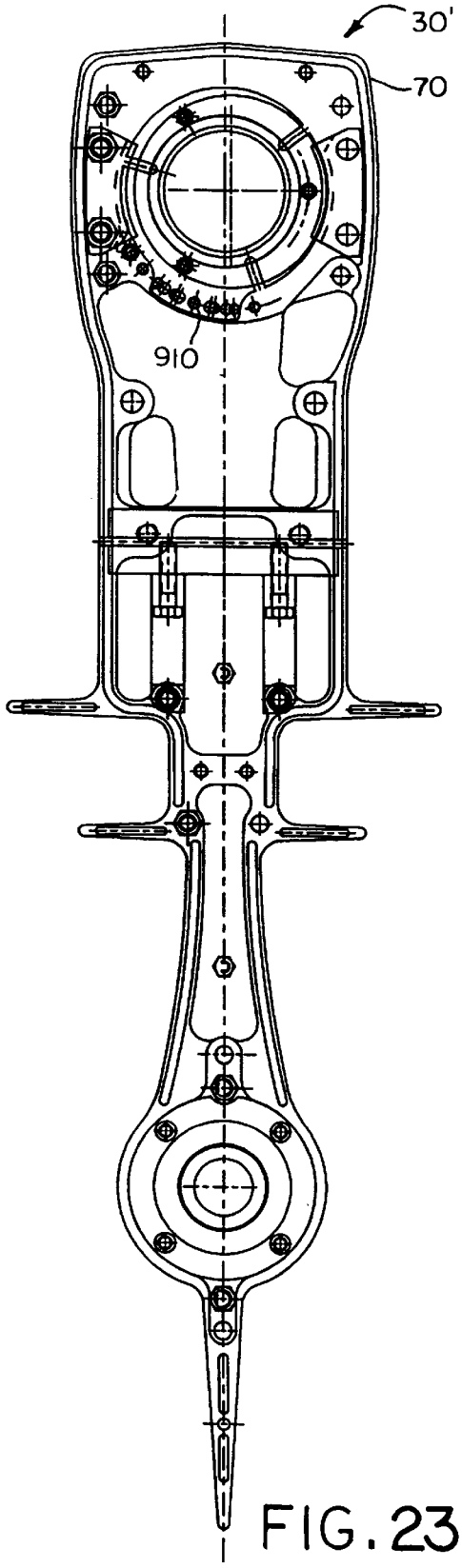
FIG. 23 is an aft elevation view of the aft metal housing part.

Turning to FIGS. 21–23, another embodiment of outdrive 30' uses an hybrid housing 12*a*. The hybrid housing 12*a* has a metal portion 701 and a plastic or polymer portion 702. The metal 1 portion 701 is selected of a material that is a relatively good conductor of heat compared to the material of which the polymer portion 702 is formed. Using a metal housing portion 701, including at least a part of which is exposed to the water in which the outdrive 30' is immersed, the removal of heat developed in the outdrive 30' during operation can be facilitated, expedited and enhanced. Such heat may be transmitted directly through the metal housing portions 701 into the water in which the outdrive 30' is immersed. The proportion of the outdrive 30' of which the metal housing portions 701 is constituted may vary, depending on the amount of heat required or desired to be transferred through the metal housing portion 701 and dissipated into the water, temperature considerations, and so forth.

The metal housing portions 701 may be, for example, aluminum, which has good strength, relatively light weight, and other desirable properties, such as resistence to corrosion, especially when appropriately coated or painted, and so forth. Other metal materials also or alternatively may be used. Furthermore, materials that are other than metal or may include metal and something else may be used provided such material provides the desired heat conduction properties and, of course, strength characteristics.

In the embodiment of outdrive 30' illustrated in FIGS. 21–23, the metal housing portion 701 is formed in two parts 701*a* and 701*b*, which may be bolted together or otherwise sealed together along a parting line 703. A chamber 38 is located in the metal housing part 701 and the belt 37 moves in that chamber as was described above to transfer power from the engine drive shaft 14*a* via the universal joint 161 to the propeller shaft 16 and propeller 15.

The polymer housing portion 702 may be made out of various polymer, plastic, resin, or other materials. Preferably such materials are sufficiently strong to maintain shape, but usually such materials as used in conjunction with the hybrid housing 12*a* do not require the strength necessary to support tension of the belt 37 and stiffness for the down leg 33' of the outdrive 30' to maintain the shape thereof as power is transmitted to the propeller 15 and the boat to which the outdrive 30' is attached is propelled. In the illustrated embodiment of FIG. 21, for example, the polymer housing part 702 includes a cover 702*a* for the aft part of the outdrive 30', leading cover portions 702*b* at the forward end, and various other trim portions, etc.

The hybrid housing 12*a* has a hydrodynamic body that has a profile, shape, etc. similar to conventional outdrives 30', such profile being established by the combination of the metal housing part 701 and the plastic housing part 702. The hybrid housing 12*a* is a structural component of the outdrive 30'; it carries the load of the tension on the belt 37 as well as the weight of the outdrive 30' itself. For example, the tension on the belt 37 may be in the neighborhood of 800 to 1,000 pounds and the overall force on the housing 12*a* may be approximately 1,600 pounds when not immersed. The recommended amount of tension that the belt manufacturer suggests is about 2,800 pounds for the belt 37 mentioned elsewhere herein. Thermal expansion of the housing 12*a* and thermal contraction of the belt 37 (mentioned above) further increases the load. Adjustments may be made to accommodate such expansion and contraction characteristics while still avoiding excess belt tension beyond that recommended by the belt manufacturer. If the housing 12*a* of the down leg 33' were primarily or exclusively plastic material, it is possible that some additional skeletal components inside the housing 12*a* may be required to increase structural load strength. However, the housing 12*a* using a metal housing part 701 ordinarily adequately supports the forces mentioned above without additional skeletal support components, although these may be added if desired.

In an embodiment of the invention illustrated in FIG. 21, the outdrive housing 12*a* uses about 60% polymer housing part 702 and about 40% metal housing part 701. These are exemplary numbers only and may vary widely depending on thermal transfer requirements for a the outdrive 30'. For example, the polymer housing part 702 may be from 20% to 80% and the metal housing part 701 may be from about 80% to about 20% from the housing 12*a*.

The back benders 42*a*, 43*a* of the hybrid housing 12*a* are integral with the metal part 701. Thus, the surfaces of the back benders 42*a*, 43*a* in engagement with respective legs of the belt 37 actually are surfaces of the metal housing part 701. Those surfaces are at the areas where the lead lines associated with the respective back bender reference numerals 42*a*, 43*a* point.

The belt 37 is moved in the chamber 38 by the upper sprocket 710, which in turn is rotated directly or indirectly by the engine. The belt 37 turns the lower sprocket 711. The lower sprocket 711 is coupled to the propeller shaft 16 to turn the propeller 15. Oil 712 is in a sump area 320, for example, similar to the oil 712 and sump arrangement described above with respect to FIG. 2. The purpose of the oil 712 is to lubricate the belt 37 as it rides against the back benders 42*a*, 43*a* and also to lubricate the bearings 245 in the down leg 33', for example, those associated with the respective sprockets 710, 711. The oil 712 lubricates the back of the belt 37 and the combination of the back benders 42*a*, 43*a*, the oil 712 and the belt 37 is similar to or like a journal bearing. Test data has shown vary little wear between the belt 37 and the back benders 42*a*, 43*a*.

In addition to providing a lubricating function, the oil 712 transfers heat to the back benders 42*a*, 43*a*. The heat is transferred by conduction through the metal housing part 701 to the exterior surfaces 46*a*, 47*a* for dissipation and transfer into the water in which the down leg 33' is immersed. Thus, the metal housing part 701 serves as a heat exchanger for the oil 712. The oil 712 forms a film between the back benders 42*a*, 43*a* and the belt 37 and the heat from the oil 712 which is engaged with the back bender 42*a*, 43*a* wall surfaces is conducted directly into the metal housing part 701 for dissipation out through the surfaces 46*a*, 47*a* into the external water, thus providing a good heat transfer capability.

On the back side of this belt 37 are some transverse ribs. Those transverse ribs end up being bearing pads. There is oil 712 trapped in between pads, so the belt 37 transports oil 712 like a pump. The oil 712 is trapped in between the pads and is scrubbed at very high velocity over the cool surface of the back benders 42*a*, 43*a*. There is no boundary layer because the boundary layer is mechanically scrubbed away and as a result there is good heat transfer.

It will be appreciated that the metal housing parts 701 is a very efficient heat exchanger, having the back benders 42*a*, 43*a* having the oil 712 contact with the back benders 42*a*, 43*a* and also having the external surfaces 46*a*, 47*a* in direct contact with the water going by the boat so that heat is easily dissipated by conduction through the housing to the outside water to which the boat is immersed. Usually when the outdrive 30' is running and the boat is moving through the water, about 40% of the housing 12*a* is submerged so that there is a relatively large amount of the surface area 46*a*, 47*a* that is in such direct contact with the outside water.

It will be appreciated that the back benders 42*a*, 43*a* and the surfaces 46*a*, 47*a* preferably are of good heat conducting material, such as the mentioned metal, especially aluminum or some other metal material. The upper portion of the metal housing part 701, such as that portion which is ordinarily not submerged, may be made of a material other than metal, such as plastic, for example, as such upper portion ordinarily does not have a primary heat transfer function as the lower portion.

Stuffer 500

A fence or a stuffer 500 is in the chamber 38 between the two legs 40, 41 of the belt 37. The stuffer 500 may be of metal, plastic or some other material. Primarily the stuffer 500 is located at the lower portion 701*c* of the metal housing part 701, as is seen most clearly in FIGS. 22 and 24. It may be bolted to one or both metal housing parts 701*a*, 701*b*; it may be in one piece or split, e.g., along a common split line or plane with the housing parts 701a, 701b.

At such lower portion 701*c* of the metal housing part 701, oil 712 tends to be pumped and moved by the belt legs 40, 41. The stuffer 500 serves as a fence or as an anti-shear device to prevent shearing effect (vortices) between oil 712 drawn up by one belt leg 40, 41 relative to oil 712 drawn down by the other belt leg 41, 40. Further, the stuffer 500 takes up space in the chamber 38 where the oil 712 is providing its lubricating and heat removal functions in association with the belt 37 and back benders 42*a*, 43*a*, and, therefore, stuffer 500 displaces some of the oil 712 and, accordingly, reduces the volume of oil 712 required to provide the indicated functions.

It was found in the past that vortices were created in the oil 712 located between the belt legs 40, 41, particularly due to the mentioned shearing effect at the lower portion of the metal housing part 701 and/or due to unnecessary pumping of the oil 712. Such vortices tended to waste energy and to create heat, which resulted in an energy loss for the outdrive 30'. The stuffer 500 eliminates those losses by taking up a portion of the space between the belt legs 40, 41 and by at least in part isolating those legs 40, 41 from each other so the opposite direction pumping action occurring as the two legs 40, 41 move in opposite directions do not confront each other and create vortices.

During operation of the outdrive 30' shown in FIGS. 21–25, oil 712 will come down along one of the back benders 42*a*, 43*a*, being drawn by the teeth of one of the belt legs 40, 41. The oil 712 also will come down between the belt leg 40, 41 and the stuffer 500 and will be introduced into the area of the sump 320 and be introduced in the area between the lower sprocket 711 and the belt 37. The oil 712 that gets between the lower sprocket 711 and the belt 37 will be squeezed out of the way so that the belt 37 can fit onto the sprocket 711 as it goes around. This is a pumping action that preferably is starved by reducing the amount of oil 712 in the sump 320 and also by making it difficult for oil 712 to get to the sump 320, the stuffer 500 providing that function. The stuffer 500 also helps to reduce the amount of oil 712 that is in the area between the two belt legs 40, 41 in the lower half of the metal housing part 710 and also which reaches the upper half of the metal housing part 711 in the chamber 38 above the portion of the back benders 42*a*, 43*a* and stuffer 500 are located. By reducing the amount of pumping required and the amount oil 712, losses are reduced, too.

In an embodiment of the invention, there is a clearance of about 0.030" between the stuffer 500 and the closest confronting surfaces (the flats of respective belt teeth 183, for example). This is only one example and other clearances also may be provided. Test data has shown that oil 712 in the outdrive 30' of FIGS. 21–25 tended to heat relatively rapidly without the stuffer 500 in place. However, using the stuffer 500 to reduce the amount of oil 712 in the chamber 38 and, thus, reducing the work being done on that oil 712, the temperature rise in the oil 712 was reduced.

Tests were conducted of an outdrive 30' in accordance with the invention using a belt 37 that has a 4" width and rated to run approximately at a rating of about 250 horsepower. The outdrive 30' was run satisfactorily for about five or six hours while being driven by an engine rated at 250 horsepower.

It will be appreciated that in the embodiment of outdrive 30' illustrated in FIGS. 21–25, at least a portion of the hybrid housing 12*a* of the outdrive down leg 40, 41 is metal, such as aluminum, or other thermally conducted material that is relatively strong and sufficiently stiff to support the belt 37. The amount of surface area presented by the metal housing portion 701 is sufficient to dissipate the heat that is a product of the losses in the outdrive 30'. It will be appreciated that other means will be used to dissipate heat from the outdrive 30', such as using the cooling functions behind the back benders 42*a*, 43*a*, as is described with respect to the flow chambers 49, 50 and flow passages 332, 333 in the embodiment illustrated in FIG. 2 and described above. As another alternative, the housing part 701 may be made of a material other than metal, provided the material has sufficient strength and stiffness characteristics for the intended mechanical functions and suitable means are provided to dissipate heat. One example is the use of a thermally conductive polymer. However, most modern thermally conductive polymers have metal plates in them, and those plates may corrode, which may make such materials unuseful in the invention. It is anticipated that in the future there may be a polymer that will have sufficient thermal conductivity without corrosion, which may be used for the metal housing part 701. Another embodiment may utilize a plastic or polymer housing for the metal housing part 701. Such housing having metal or other thermally conductive pads or plates on the outside surfaces analogous to the surfaces 46*a*, 47*a* to conduct heat to the exterior water. Bolts, rivets or some other means may be used to connect the back benders 42*a*, 43*a* to such plates thereby to conduct heat from the back benders 42*a*, 43*a* to the plates for such dissipation.

Still other embodiments of housing for dissipating heat energy may include a plastic housing substituted for the metal housing part 701, for example, and having passages through the housing wall to allow oil 712 to engage a metal plate outside the wall; the oil 712 transfers heat to the plate, and the plate transfers the heat to the water in which the outdrive 30' is immersed. Alternatively, the plate may replace the plastic part itself. Still further alternatively, a part of the plate may extend through the mentioned passages or be coupled to thermally conductive bolts, rivets or the like to transfer heat from within the chamber 38 to the exterior water.

Additional cooling may be provided by the water 48 flowing directly through the housing 12*a*. For example, as is described above, a water intake is provided for water 48 to flow into the housing 12*a* (see FIG. 1B) such inflow of water 48 may be directed through a flow passage 720 (FIG. 25) for delivery via a fluid conductor port 721 to the water pump (not shown) associated with the engine 13 (FIG. 1A). The water 48 may be used to cool the engine. The water 48 may also provide a cooling function for at least part of the outdrive 30' through which the water 48 flows. The water 48, after having provided the engine cooling function, may be discharged through the exhaust flow path of the engine.

It is desirable to pretension the belt 37 so the belt 37 does not become slack and start skipping teeth as the belt 37 enters the sprocket 710, 711 or so the belt 37 does not try to climb over teeth. The manufacturer of the belt 37 mentioned herein ordinarily recommends a specific pretensioning of the belt. However, it has been found that the outdrive 30' having the configuration, geometry, and/or conditions, e.g., using back benders and oil as illustrated in FIGS. 21–25 runs better with about 50% of that recommended pretension. Further, it has been found as the metal housing part 701, especially such a part made of aluminum, heats up, the belt tension tends to increase because the housing 701 expands and grows in length; therefore, the center to center distance between the sprockets 710, 711 increases. Furthermore, although many materials expand (get longer) as they heat, the exemplary belt 37 mentioned herein includes Kevlar cord material, which tends to shorten or to shrink in length as it heats. Kevlar material has a negative coefficient of thermal expansion. Accordingly, not only does the housing 701 swell (expand with the heat), but as the expanded housing increases the center to center distance between the sprocket 710, 711, the belt 37 is shrinking. Therefore, it has been found better to pretension the belt 37 at a lower level for the exemplary belt 37 thereby to accommodate such housing expansion and belt contraction.

Back Benders 42*a*, 43*a:*

Back benders 42*a*, 43*a* are considered fundamental to the employment of belt technology. Not only do they cause the drive 30' to have a hydrodynamically clean profile, but they act significantly as a heat exchanger to cool the drive 30'.

Cooling Method:

The Patent specifically teaches the use of oil 712 not only as a lubricant to reduce the friction in the drive 30', but as a heat transfer medium in conjunction with the action of the back benders 42*a*, 43*a*. Oil 712, which is trapped between the back benders 42*a*, 43*a* and the belt 37 is scrubbed against the surface of the back benders 43*a*, 43*a* and is forced to give up its heat by virtue of this action. We have found that cooled back benders 42*a*, 43*a* are virtually transparent to heat, causing temperature differences between the coolant surface and the oil temperature of only a few degrees. Coupled with a reasonable velocity of water at the coolant surface, this heat exchange configuration is extremely effective. The prototype drive 30', currently running at about 205 hp, has an oil temperature of approximately 30-degrees F above the water temperature. This means that at twice that power, say 410 hp, the temperature rise would be on the order of 60-degrees F. For water temperatures of 90-degrees F (Amazon River water), an extremely high and unlikely temperature, the belt 37 would be reaching oil temperatures of 150-degrees F, well within the operating limitations of this belt 37.

Active Tensioning:

The Patent specification teaches the need for an active tensioning device when a belt 37 is used with a composite or plastic housing 12*a*. Belts 37 used for transmitting high horsepower will require operating tensions of very large proportion. Tensions on the order of 3,000 and 4,000 pounds are not unusual. If these tensions are applied passively to the drive 30', the housing 12*a* will have to resist this tension, not only during operation, but permanently around the clock. Such large forces sustained continuously by a plastic member, during storage, possibly at elevated temperatures, will cause distortion and creep of the material. Since these belts 37 are very stiff, a small change in center distance will cause a substantial change in pretension, degrading ultimate performance.

Figure 26:
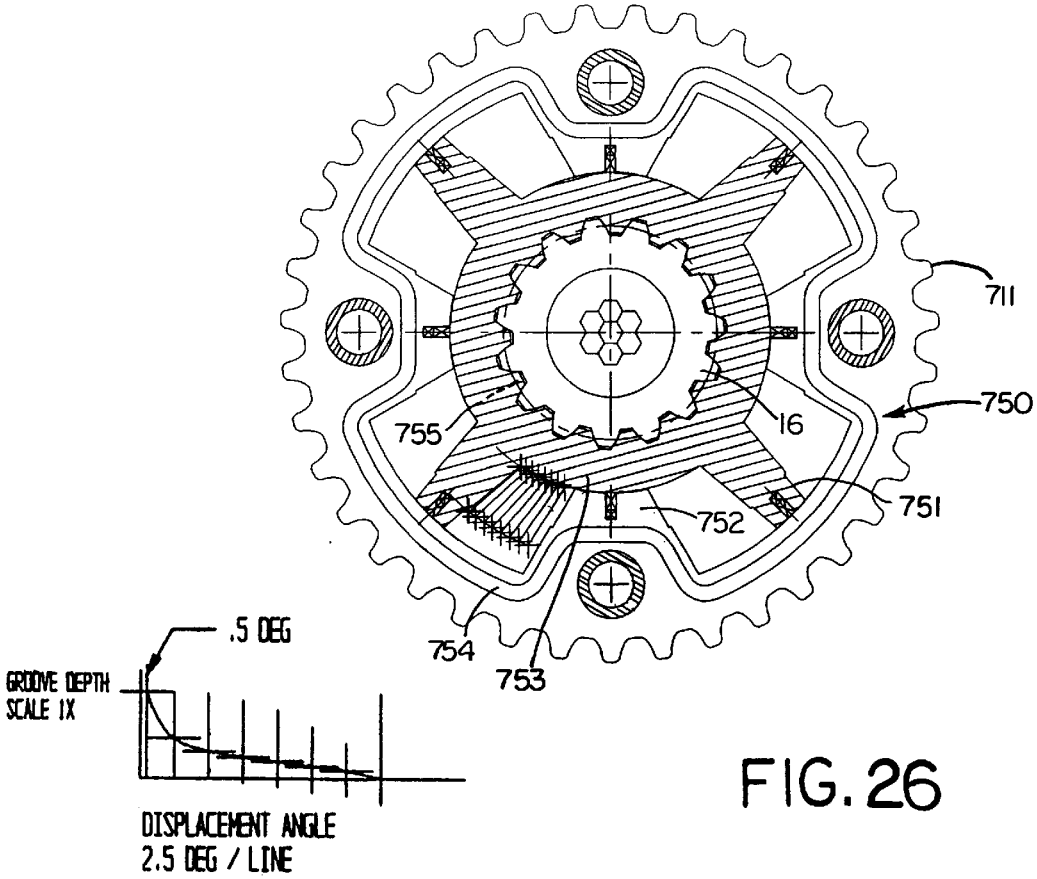
FIG. 26 is a schematic plan view of a rotational shock absorber for the propeller shaft.

Rotational Shock Absorber (FIG. 26)

When clutching the drive transmission, either into forward or reverse gears; and, especially, when going directly reverse to forward, a large rotational energy spike must be accommodated. This is true particularly when using clutches with little or no slip as in dog clutches or cone clutches. This energy spike will cause very large stresses to occur that could ultimately break the drive 30'. In the past, energy absorbing rotational couplings have been used at the input and output ends of the drive 30'. This coupling employed room between the flywheel and the drive 30' in the bellhousing area and in the hub of the propeller 15. Calculations have shown, that for these absorbers to be effective, an active rotation within the absorber of about ±20-degrees is necessary. Since shaft drives are much stiffer than this, energy absorbers are necessary. So too, belt drives 31 prove to be too stiff, absorbing only about one fourth of the rotation necessary for good shock attenuation.

Figure 27:
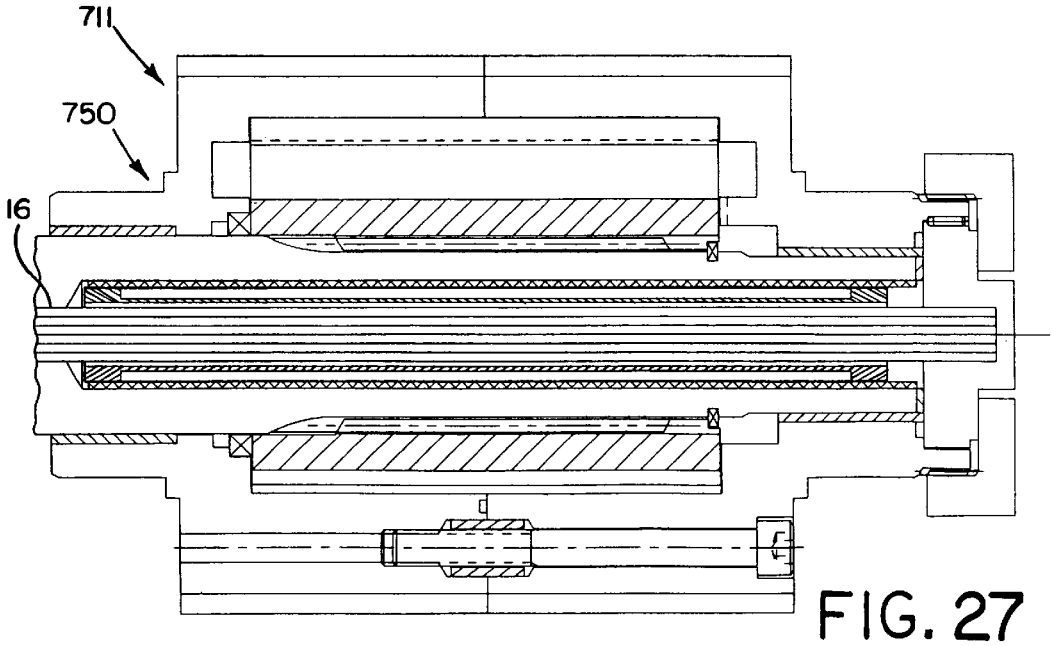
FIG. 27 is a side elevation view partly in section of the shock absorber of FIG. 26.
Figure 28:
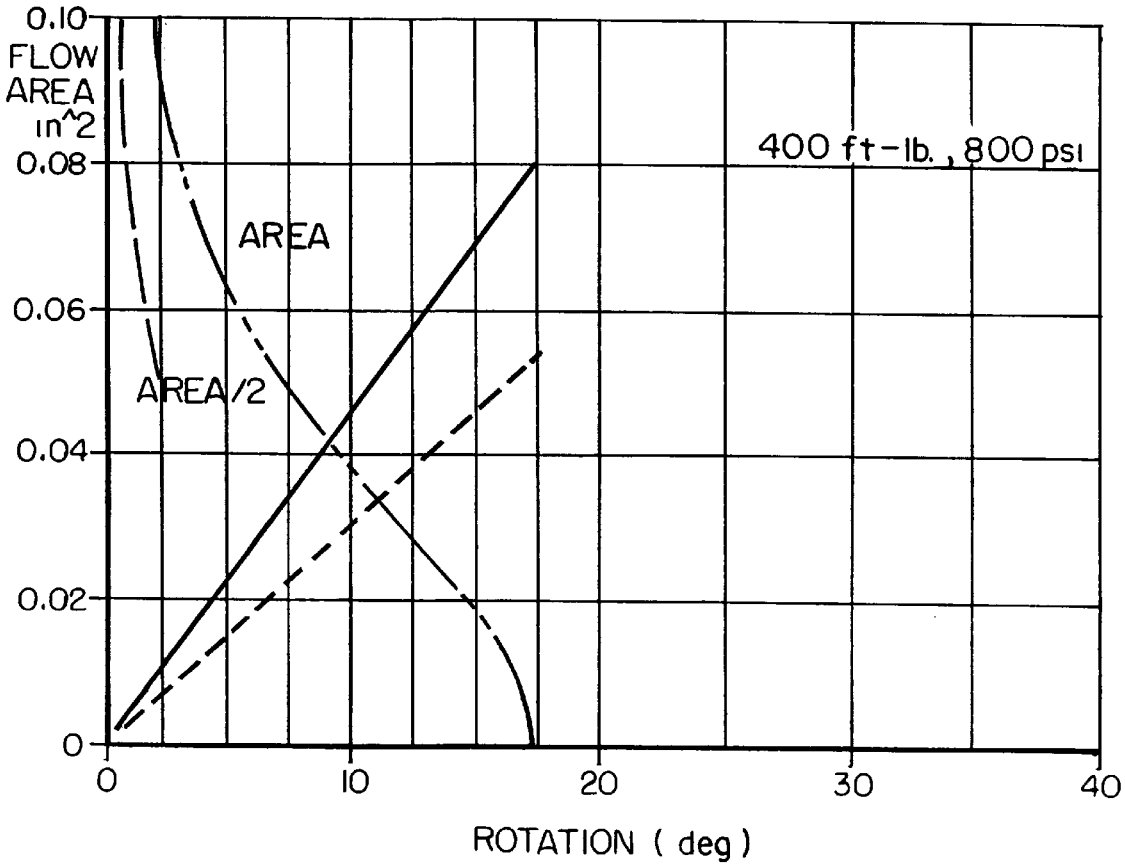
FIG. 28 is a graph of operation of the shock absorber.
Figure 29:
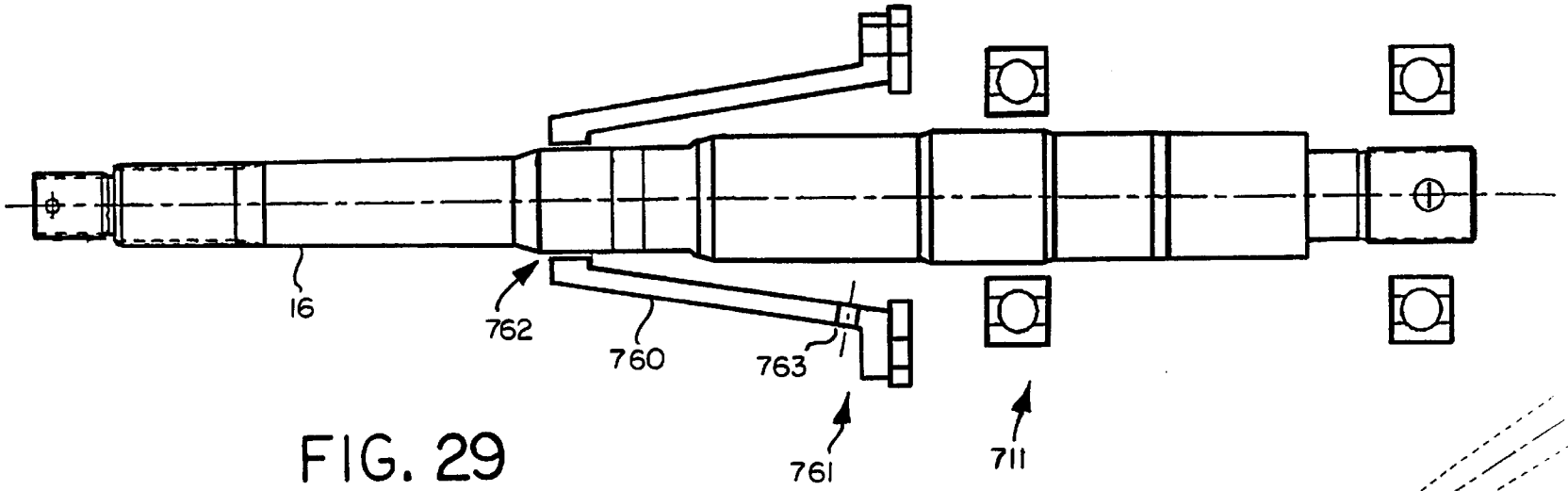
FIG. 29 is a schematic view of an output shaft support for the propeller shaft.

The rotational shock absorber mechanism of FIGS. 26–28 accommodates the above difficulty. Essentially, a closed four (4)-vane pump 750 is housed in the output sprocket 711. This is the ideal location for the absorber because the reduction ratio of the drive 30' enhances its effectiveness. This location for the absorber also precludes the necessity for a compliant hub in the propeller 15, making that element less costly to manufacture. Additionally, this location for the absorber frees up space behind the flywheel to accommodate a transmission mechanism.

The four (4)-vane pump 750 shown in the accompanying drawings is sealed and filled with a heavy oil 712. Oil is pumped from one side of the vanes 751 to the other through a variable restriction 752 on the end plates. This restriction can be tailored to allow various characteristics; however, generally, it is designed to give increasing resistance to rotary motion with increasing rotational displacement. At the extremes, ±20-degrees, the chambered oil 712 has been displaced and the rotor 753 and stator 754 are bottomed and locked in rotational engagement. When torque is removed, as in shifting the drive transmission through neutral, a torsional spring 755 restores the rotor 753 to a central position arming the absorber for the next cycle. Since this device is rotationally symmetrical, shifting shocks will be attenuated for either forward or reverse cycles.

FIG. 28 shows a graphical representation of the operational characteristics of the rotational shock absorber.

Output Shaft Support 760 (FIG. 21)

When the propeller 15 strikes a foreign object, it has been found by calculation, that peak stresses on the output shaft 251 of a typical gear-driven outdrive 30' occur somewhat inboard of the aft bearing.

Also, with the large loads applied by belts 37, it has been found desirable to keep the shaft support bearing close to the output sprocket 710, 711. With this configuration, peak stresses from a propeller strike occur at approximately the same place, as the geared shaft with an outboard bearing.

In order to make the shaft 16 less vulnerable to bending from a propeller strike, a deflection limiter 760 was constructed. This device bolts at 761 to the main housing 12*a* and continues aft to just before the propeller flange 16. The output shaft 251 passes through this truncated conical member 760 and has a clearance 762 large enough to allow normal running deflection, but small enough so that shaft 16 deflection will be limited to lower than shaft material yield strengths. A drain hole 763 is provided at the forward bottom to prevent water entrapment when the drive 30' is out of the water.

A second function of this device 760 is that of a structural washer to capture the after plastic housing 702 at 764 (see FIG. 21).

A third function is that the device 760 is manufactured from an aluminum material and not protected such that it acts as a sacrificial anode surrounding the cathodic stainless steel shaft 16. In this manner, the main housing 12*a*, and especially the metal housing part 701 structure is protected from the major source of galvanic corrosion, the shaft 16, and potentially, the propeller 15, if it is also stainless steel.

Figure 30:
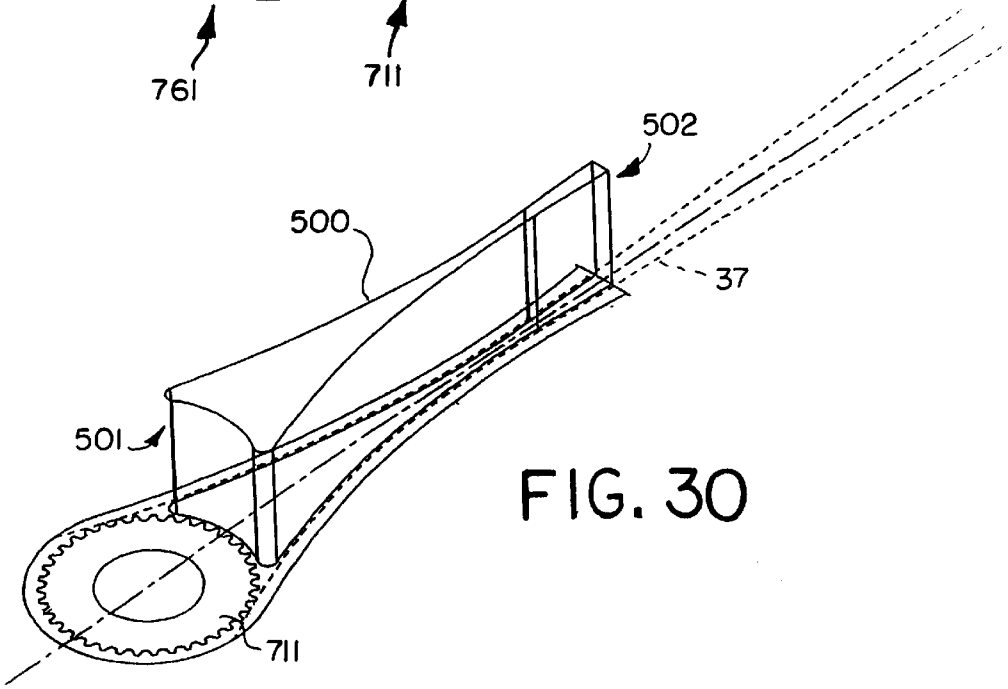
FIG. 30 is a schematic partial isometric view of an anti-shear stuffer/fence.

Anti-Shear Fence/Stuffer 500 (FIG. 30)

It was found through calculation and observation that two mechanisms contribute to the energy loss resulting in rapid oil temperature rise.

First, the belt 37 being urged together by the back benders 42*a*, 43*a*, has a down-going side and an up-going side in close proximity. Oil 712 that is in the middle of the belt 37 sees a shear from these belt legs 40, 41. The result is a suspended vortex which has no circulation; and, therefore, is not cooled by the back bender 42*a*, 43*a*. The shear losses in this trapped vortex cause the temperature to rise rapidly.

Secondly, oil 712 trapped in the down-going leg 40, 41 of the belt 37 is forcibly displaced by the sprocket 711 teeth and is pumped laterally out of the interstices. This loss mechanism also seems to be affected by the amount of oil 712 in the drive 30'. That is, more oil 712 yields more losses.

It is desirable to have sufficient oil 712 in the drive 30', say one or two pints, so that frequent oil change is not necessary. The above results demanded that oil 712 be kept to a minimum, say one-half pint. The fence or stuffer device 500 was designed that could hold oil inventory out of direct engagement with the drive 30', and eliminate the shear loss at the same time minimizing the tooth-pumping losses. The fence also may be a two (2)-piece hollow thin-walled vessel, open at the top and capable of holding oil 712.

The fence 500 fills the space between the belts 37 from approximately halfway down the down leg 33 to the bottom sprocket 711. A controlled leak 501 at the bottom near the up-going belt leg 40, 41 allows the oil inventory to circulate.

The open top 502 accepts replenishment oil 712. This design accomplishes all the objectives set above. The shear vortices are eliminated, the oil content 712 trapped in the teeth is minimized, and an extra amount of oil 712 is inventoried not in direct involvement with the belt 37.

Figure 31:
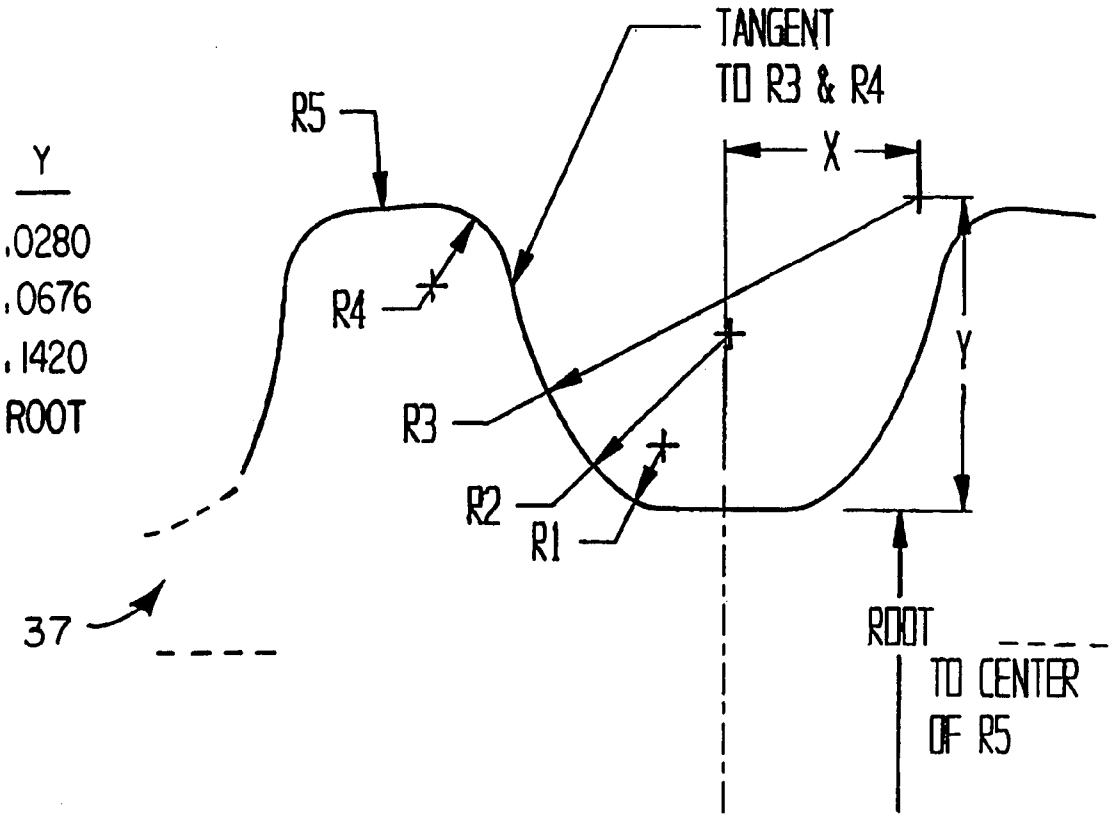
FIG. 31 is a schematic partial view of a tooth profile of the belt.

Sprocket Tooth Profile (FIG. 31)

A Sprocket Tooth profile is illustrated in FIG. 31. The profile has been proven, having been used in test drives. Excellent belt wear and performance have resulted. The resulting profile can be described as a series of arcs with prescribed centers and tangencies. The accompanying drawing shows this design. This profile is exemplary and may be modified, especially to accommodate varying numbers of teeth.

Power Steering Eliminator

Present practice uses power steering on all outdrives 30' coupled with engines over 150 hp. The reason for this is that at the higher horsepowers; and, typically, at higher speeds, say 50 mph, the propeller 15 is ventilated by separation of the water at the down-leg strut. The separation entrains air and this aeration causes a difference in the propeller effectiveness above the rotational center as opposed to below the rotation center. The effective density of the water is larger below center than above. Accordingly, the propeller 15 will produce a side thrust acting as a paddlewheel, causing the drive 30' to be displaced laterally. This lateral displacement forces the boat into a turn not intended by the pilot of the vessel. Forces are great enough to make manual correction uncomfortable and; hence, power steering is widely used.

A significant change in the above characteristics can be achieved directly as a result of the use of back benders 42*a*, 43*a*, for example. As can be appreciated, the lateral profile of the drive 30' disclosed herein just beneath the ventilation plate is significant to the above phenomenon. With current outdrives 30', this thickness, when compared to the hydronamic chord at this location yields thickness-to-chord ratios of between 13 percent and 15 percent. The use of gears, shafts and vertical bearings demand sufficient thickness to accommodate them. As a consequence, the downleg is thicker just before the ventilation plate than an equivalent belt drive 31 with back benders 42*a*, 43*a*. In fact, back bender 42*a*, 43*a* geometry dictates that this location 780 (FIG. 22), just below the ventilation plate 781, is the minimum thickness, yielding the optimum condition to combat the side thrusts inherent in present outdrives 30'. A prototype drive 30' has a thickness-to-chord ratio of less than 10 percent. This geometry is sufficient to eliminate all side thrust due to the separation phenomenon and preclude or reduces the necessity for power steering—a significant cost savings.

Figure 32:
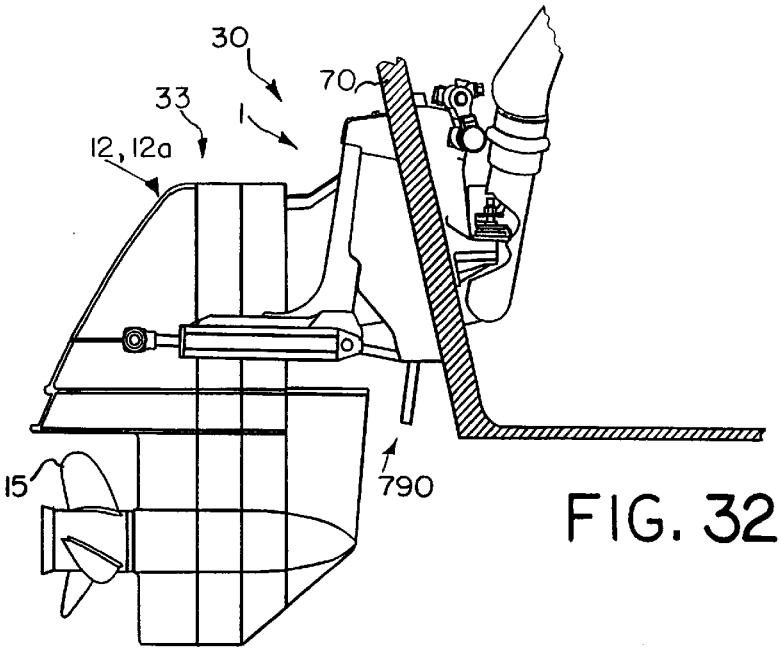
FIGS. 32–34 are schematic views of a water bypass silencer.
Figure 33:
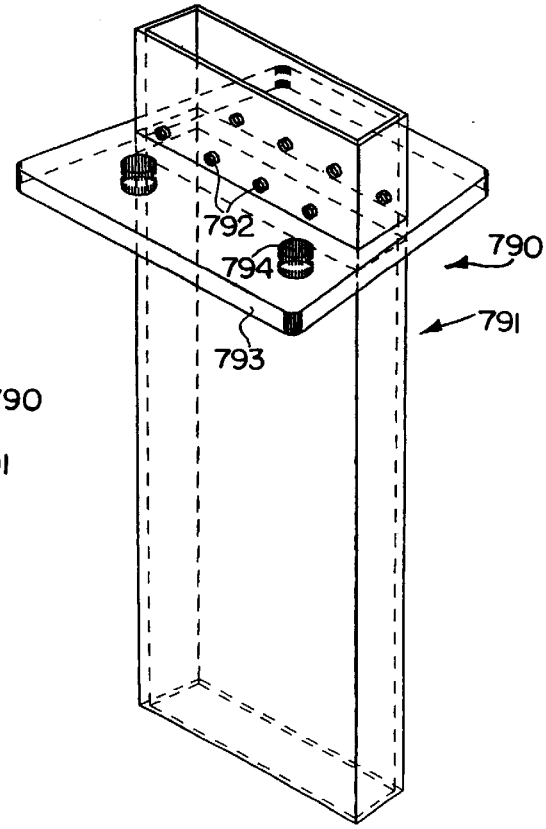
Figure 34:
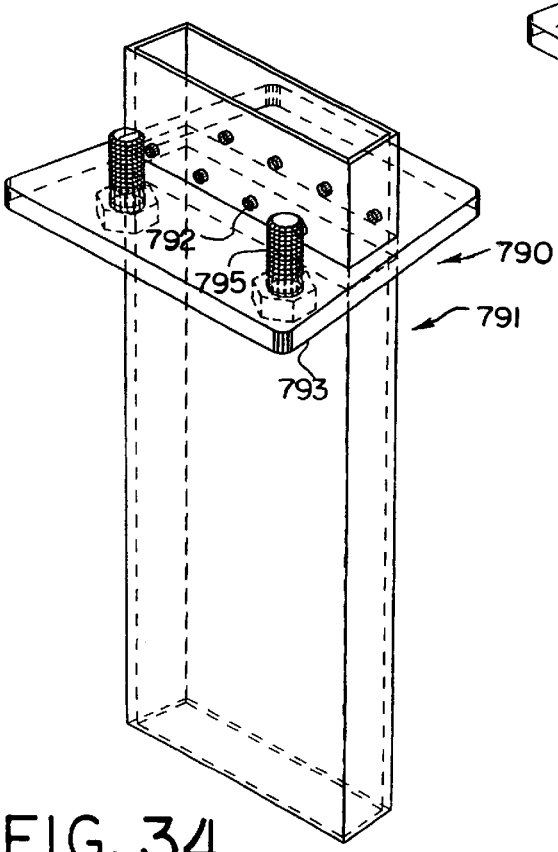

Water By-pass Silencer 790 (FIGS. 32–34)

Common practice for outdrives 30' is to provide a passage, near the junction of the y-pipe as the exhaust passes through the transom housing to eliminate most of the water entrained in the exhaust. This is desirable since the entrained water increases the backpressure through the outdrive 30' and causes net power losses. Also, this By-pass allows some portion of the exhaust gas to escape, further reducing the backpressure and enhancing the power available.

A negative side effect of this feature is that the exhaust noise also escapes here and is reflected by the transom. This reflection acts as a concentrator causing a large increase in noise when the boat is going away from the recipient. The noise inside the boat is also affected by this feature.

A water-bypass silencer device 790 shown in FIGS. 32–34 can by-pass water without the accompanying noise problem. In fact, this device has means of tailoring the fraction of water removal so that an ideal amount of water still remains entrained without causing exhaust backpressure. The device 790 consists of a tubular extender 791 which carries the exhaust vertically downward close to the surface of the water while the boat is on plane and underway. Here, the exhaust admixes with the turbulent water surface and any noise generated dissipates substantially before any reflection from the hard transom surface can occur.

Some portion of the tubular member 791 protrudes into the main exhaust channel causing a portion of the water to by-pass this exit. Since the location of this device 790 is substantially a low area in the main exhaust passage, and since the water-laden exhaust gases have just made a sharp turn after traversing vertically downward through the "y" pipe, a substantial portion of the water will accumulate at the bottom of this exhaust passage. Given that the device 790 extends vertically upward, somewhat into this passageway, a portion of the water by-passes this exit and become re-entrained further downstream. Small holes 792 in this protrusion adjust the amount of water that escapes here. Water that is carried through the drive 30' greatly enhances the muffling effects within the powerleg, but also contributes to the drive's 30' cooling load. Exhaust water at about 160-degrees F is generally 50-degrees hotter than the drive 30'; so when less water is passed through, the drive 30' runs cooler.

Various shapes and geometries have been tested. Present designs have demonstrated considerable effectiveness. Tests have shown a cockpit attenuation of 2d*b* down and a goingaway attenuation of a huge 10d*b* down! Passby testing at 50 feet shows attenuation on the order of 6d*b*! Additionally, the noise spectrum is modified to yield a much more pleasant to the ear noise, making the 2d*b* cockpit attenuation more significant than the meter reading would indicate. One such design is shown in the accompanying drawings. The down leg 791 is attached to a flange 793 having holes 794. Bolts 795 through the holes 794 can attach the device 790 to the drive 30' at the "y" pipe as described.

Figure 35:
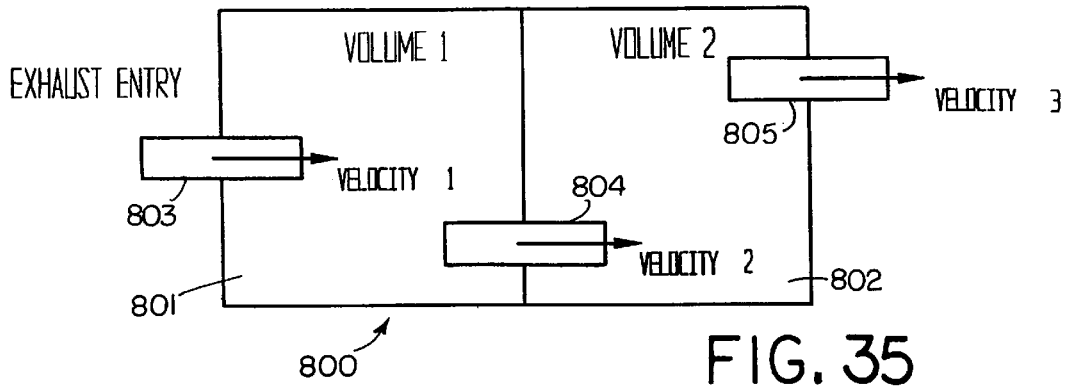
FIG. 35 is a schematic view of a two stage LC muffler.

L C Exhaust Silencer (FIG. 35)

The design of a muffler system for an internal combustion engine for marine use must accommodate two conflicting requirements. First, the noise resulting from exhaust pressure pulsations produced by the engine must be strongly attenuated to accommodate the limits set in accordance with use or legislation. Second, the exhaust manifold pressure rise resulting from exhaust gases flowing through the muffler system must be small enough so that engine output is not adversely affected appreciably. Small diameter piping gives good noise control, but restricts engine power. Conversely, open piping yields good engine power, but provides little noise control. However, very satisfactory results can be obtained in both areas by following the approach described here, which uses inertial effects to limit the transfer of acoustic power.

Referring to FIG. 35, to first order, the exhaust header and piping system 800 for a marine engine constitutes a volume 801, usually amounting to a few hundred cubic inches in modern sport boat applications, into which interrupted hot exhaust gas flows 803 are introduced by the engine at repetition rates generally in the 20 to 200 Hz range. Flows of hot exhaust into the header can amount to several cubic feet per second. Although usually cooled by injected water, the outlet flows 805 through the remainder of the exhaust system 800 still can amount to a few cubic feet per second.

To prevent objectionable header pressures from developing as a result of these large flows through a muffler 800, the minimum passage cross sections inside the muffler 800 must be at least a few square inches. The upstream pressures developed by gases entering a passage from a chamber within a muffler 800 are dynamic in nature and principally result from the acceleration of the gas. Very little of that pressure rise can be recovered when the gas leaves the passage and decelerates, however, so it is important to limit the number of serial accelerating restrictions within a muffler 800 to limit the total header pressure rise resulting from the exhaust flow.

Considering the header and exhaust pipe volume, and the volume of gas 803 which enters that exhaust system volume during the blowdown through an engine exhaust valve, it is clear that the resulting header pressure rise will be less than the engine cylinder pressure was immediately before blowdown by approximately the ratio of the cylinder volume divided by the header and piping volume. Therefore, the first feature one should incorporate in the design of a muffler system 800 is to make the header plus piping volume large as compared to the engine individual cylinder volumes. If the ratio of the header plus piping volume to the engine cylinder volume is too small; i.e., less than about 25:1, it may be advantageous from the standpoint of overall muffler size to add part of the muffler volume to the piping and header system.

The header, exhaust piping, and muffler input piping can, in a simplified view, be considered as a single chamber having both a steady-flow throughput 804 and a fluctuating pressure. The invention restricts the variable effects of the fluctuating pressure on the output stream 805 while interfering with the steady flow 804 as little as possible. These dual goals can be accomplished by causing the exhaust to exit the foregoing chamber through one or more long tubes having small cross-sectional areas. The gas in the tubes constitutes a mass which is proportional to the cross-sectional area of the tubes times the tube lengths. For the fluctuating flow component, the driving force is proportional to the cross-sectional area of the tubes times the magnitude of the pressure fluctuation. For frequencies corresponding to gaseous wavelengths long compared to the tubes, the kinetic energies imparted to the gas columns in the tubes are inversely proportional to the mass, and thus to the lengths, of those columns (tube lengths).

From the foregoing, it is seen that the variable kinetic energies in the gas columns, which are the sources of downstream acoustical energies, can be limited through the use of long tubes having small flow cross-sections. The effect of tube length on the steady component of the exhaust gas flow 804 is minimal, however, consisting only of surface drag. The major component of steady-flow pressure drop is the pressure required to accelerate the gas to the velocity it attains within the tubes, and even that component can be minimized by bell-mouthing the inlet ends of the tubes for good streamlining.

For some purposes, the above single-stage muffler 800 consisting of a chamber combining the volumes of the engine exhaust header, piping, and perhaps an inlet volume 801 in the muffler 800 itself, together with a section of long exit tubes (up to approximately one-quarter gas wavelength of the highest frequency of interest) may provide sufficient noise reduction. The tube cross-sectional areas should be sized to provide internal velocities of 150 to 200 feet per second at maximum exhaust throughput for maximum muffling effect without degrading engine performance appreciably.

Such a muffler 800 will also perform fairly well if the physical lengths of the tubes are reduced to essentially zero. In that case, the effective lengths of the gas columns are reduced, but do not become zero, however, because of the continuity of flow at each end of the resulting apertures. Such a device is known in the literature as a Helmholtz resonator, and in common with the single-stage muffler 800 described above, could be driven to resonate at a frequency determined by the physical dimensions of the components used in its fabrication. For use as mufflers 800, however, both devices are operated at frequencies far above their acoustical resonant frequencies. Such acoustical devices have electrical analogues which behave similarly. The electrical analogues of these devices are single-stage R-L-C low-pass filters.

Single-stage mufflers 800 are most economical when noise amplitude reductions by factors of about 50 or less are needed. For multi-stage mufflers 800, in which the output from each internal velocity stage enters the chamber of a following stage, it is important to correctly choose the reduction factor for the beginning single-stage device in order to yield the most cost-effective and smallest muffler 800. If one begins with a single-stage muffler 800 with a noise reduction factor of 50, for example, and redivides that volume to optimize the noise reduction at constant overall pressure drop, one finds the optimum with three stages and an overall noise amplitude reduction ratio of 171. If one begins with a single-stage amplitude reduction factor of only 25, however, the optimum reduction factor is for two stages and is only 39.

The introduction of water into the exhaust headers is common in many types of boats as a safety measure. Its purpose is to cool the exhaust system 800, thereby removing a potential source of fire. However, that practice results in the production of wet steam in the exhaust 805, which greatly reduces the pressure fluctuations within the muffler chambers though rapid condensation and evaporation in response to pressure fluctuations. That process tends to hold chamber pressures very close to the saturation pressure of steam at the exhaust temperature and markedly improves the noise reduction behavior of mufflers. Because of this improvement, single-stage mufflers 800 can be used for most purposes when wet steam is present in the exhaust. One should make provisions in such cases for liquid water to exit the muffler chambers 800 through small diameter, long tubes, however. Pressure rises due to high mass flows through the velocity stages could otherwise result if the cooling water were to pass through those stages in the muffler designs described here.

The drawing of FIG. 35 shows a typical two (2)-stage L C Muffler 800 incorporated in the present outdrive 30'. In principle, each time the exhaust energy is changed from pressure to velocity, the pulsations are attenuated. Some frequencies are blocked almost entirely depending on the specific geometry of the device. The important dimensions are the volume of the separate chambers 801, 802, etc. and the length and cross-sectional area of the velocity tubes 803, 804, 805, etc.

Eccentric Tensioner (FIGS. 22–24, 36 and 37)

Belts 37 that transmit power require large tensile preloads. In operation, there is a tension leg of the belt 37 and a slack leg. Generally, it is desirable to hold the slack side tension at some positive value to prevent belt 37 "cogging," a destructive episode wherein the slack side teeth crawl up the sprocket teeth and eventually slip or jump to the next tooth, causing the whole belt 37 to "slip" one tooth in serial fashion.

The preload tension must be large enough to provide the slack side positive tension while the belt 37 is transmitting maximum design torque. At rest, the preload tension is shared equally by both legs 40, 41 of the belt 37. When torque is applied, one leg tension increases and the other decreases a like amount. As can be seen by this explanation, the maximum torque that can be supplied is governed by the belt preload 901, if slack side tensions are to remain finite and positive. As a result, the preload tensions are large on the order of 2,000 or 3,000 pounds.

The present drive 30' of FIGS. 21–25, for example, utilizes an aluminum crutch 900 to carry the belt loads, and a simple and effective preload device 901. This device 901 is cost effective, has enough adjustment to allow the belt 37 to slacken enough to assemble the drive 30', and can easily adjust the belt preload tension. It consists of an input sprocket 710 bearing carrier 901, cylindrical in nature, which has an outside diameter 902 eccentric with the inside diameter 903. The bearings 904 are mounted at the inside diameter 903 and the outside diameter 902 rides in the aluminum crutch. As the cylinder is rotated, the bearing rotational center 905 will be caused to move in a direction to tighten or loosen the belt 37. Total movement of the prototype eccentric 901 is 0.150 inches; however, only 0.050 approximately, is required to produce the tension in the belt 37. The remainder of the motion will produce clearance to allow assembly.

In order to keep the rotational center of the sprocket 710, 711 reasonably in line with the engine driveline, the eccentric 901 geometry is placed such that under anticipated tension, the centers coincide. The only misalignment would come from minor variation due to manufacturing tolerances, especially belt 37 lengths. These small misalignments are accommodated by the universal joint which is between the engine and the drive 30'.

Experience has shown that a digital rotation of the eccentric 901 of about 4 degrees is sufficient to allow necessary adjustment. Various techniques could be used to effect this adjustment. In the present prototype, a series of holes 906 (FIG. 23), radially spaced and differentially placed by 4 degrees allows for a pin to engage each 4 degrees of rotation. Visual alignment is used prior to engaging the pin. In production, a toothed circumference is visualized with features every 4 degrees and a zero position witness for visual location.

Figure 36:
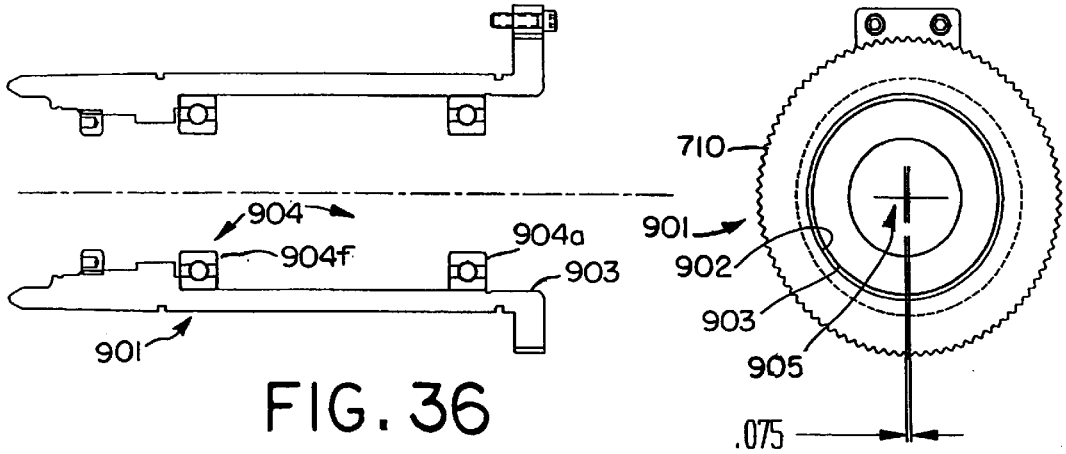
FIGS. 36 and 37 are schematic views of two embodiments of an eccentric tensioner, one is a dual piece and one is a single piece.
Figure 37:
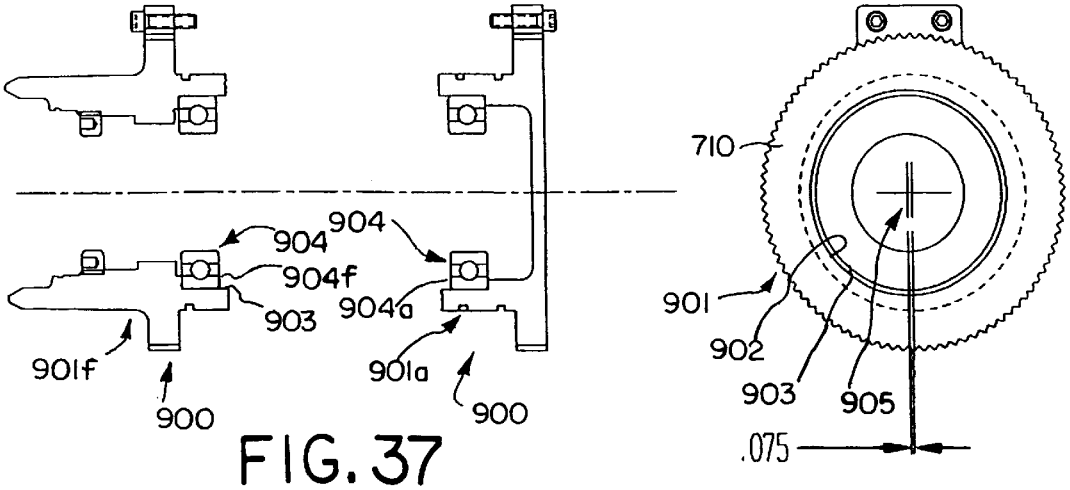

The eccentric 901 may be a single piece as in FIG. 36 with both forward and aft bearings 904*f*, 904*a* being accommodated. If, however, the bearing carrier is split as in FIG. 37 into forward and aft parts 901*f*, 901*a*, these parts can be molded of plastic and adjusted separately. Care must be given to adjust the pair synchronously. Belt Tensioning It is desirable, and in many instances necessary, to apply tension to the belt 37. The invention employs a pretensioning mechanism. The tension should be appropriate to assure that the belt 37 remains securely mounted on the upper and lower sprocket assemblies 710, 711 and that it does not slip during operation of the outdrive 30 to transfer the appropriate amount of power. Also, the belt 37 needs to be pretensioned to offset the torque developed by the engine on the power leg 180. Specifically, as torque is applied, one side of the belt 37 would tend to become slack. The tension helps to prevent this from occurring. The appropriate amount of tension may be from several hundred to several thousand pounds of tension, depending on the torque developed by or in the outdrive 30'.

Referring to FIG. 22, the mechanical eccentric 901 provides the belt tensioning and holds the upper sprocket 710 in place. The eccentric 901 is a piece that is a cylinder. The outside diameter 902 is a cylinder with a center of its own. The inside diameter 903 has a different center that is off by, in this case, 150 thousandths, but any distance will do depending on what ratios and forces are needed and the distance the belt 37 is to be drawn up. There is a piece running on the inside of the housing 12*a*, in a certain diameter circle which has an eccentric 901 outside diameter 902, but the inside diameter 903 where the bearings 904*a–f* are runs on a different circle. Then as the piece is rotated, that center will move, thereby drawing the inside circle away from or toward another location to tension the belt 37 or to lengthen the belt 37 out of tension. The bearings 904*a–f* and the upper sprocket 710 are on the inside diameter 903 of the eccentric 901, and the outside diameter 902 runs in a hole (crutch) that is in the housing 701 itself. To tension the belt 37, the eccentric 901 is rotated and draws up the belt 37 by virtue that it brings the bearings 904*a–f* in the sprocket 711 away from the lower sprocket 711 as it is rotating. It is a simple device that avoids gearing and other components that were used in the past for belt tensioning.

The eccentric 901 also contains or is coupled to the universal joint. The eccentric 901 is rotated from the outside. There is a cap (FIG. 23) that goes on it and the cap may be originally rotated with a torque wrench. Then, one can rotate a number degrees beyond that in order to control the amount of the stretch or displacement that is put into the belt 37. The initial torque is put on to initially tension the belt 37 to make sure it is up snug and straight. That is done as described with a torque wrench. The rest of the adjustment is a forced displacement of so many thousandths of an inch, due to the relationship between the rotation and the displacement in view the eccentric 901. As the eccentric 901 is rotated, the center line of the shaft "X" of the sprocket 710, 711 is going to move up slightly thereby increasing belt tension.

Note the center line of the inside diameter 903 of the eccentric 901 and the center line of the outside diameter 902 of the eccentric 901. The eccentric 901 rotates about its outside diameter 902 as it is rotated in the housing 12*a*. The center line of the sprocket 710, 711 nevertheless is connected to the center line of the drive shaft 14 from the engine.

The eccentric 901 is a bearing carrier. It carries the upper sprocket 710 so this is a complete upper assembly.

The eccentric 901 has a hole in the center for the drive belt 37 to pass through. As it is torqued, there is a lot of friction that occurs between the eccentric 901 and the housing 12*a*, enough that when it is at full tension, it tends not to move. That is convenient but is not necessary. It would be acceptable if it could move, for it can be locked as is described below. The cap (FIG. 23) on the back of the eccentric 901 has a set of holes, for example, five holes, through which a screw may be passed and the screw will line up with one of several for example, 8 or 10, threaded holes in the housing. Those threaded holes will line up with one of the holes 910 (FIG. 23) in the cap every two degrees as the cap is rotated, which is the equivalent of a prescribed amount of belt tensioning, for example 0.002 inch tensioning of the belt 37 per hole so the belt 37 can be tensioned fairly accurately. Then a small screw through a hole tightens it up. That adjustment gives enough friction to keep the belt 37 from losing its tension during storage and shipment. Once the outdrive 30' is on the boat, the eccentric 901 is held in place by using clamps that are underneath the studs that are used to hold the whole outdrive 30' against the gimbal housing, and four of those six studs hold the clamps to give additional clamping of the eccentric 901 in place relative to the housing 12*a*. Therefore, the final clamping may be done when the outdrive 30' is actually secured to the boat.

In a two piece design of the eccentric 901 there would be two caps, one on each side. The cap would be an integral part with eccentric portion 901, so there would be two eccentrics 901.

A two piece design rather than a one piece design is more cost effective to build.

Figure 38:
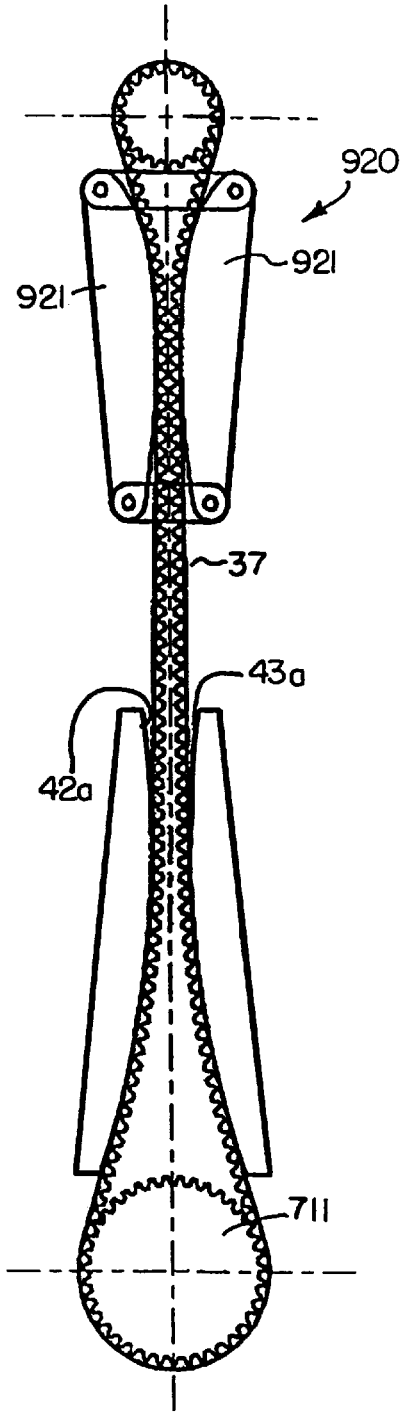
FIGS. 38 and 39 are schematic views of an active tensioner.
Figure 39:
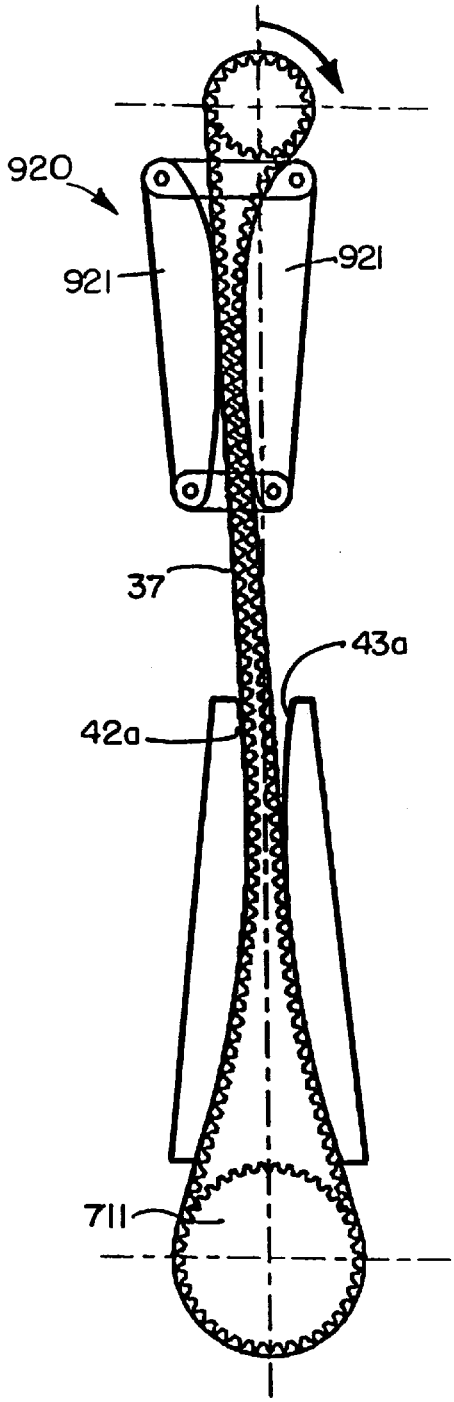

Active Tensioner (FIGS. 38–39)

Because the tensions on the belt 37 are so large, and especially when considering a plastic housing subject to creep from sustained tension, it is desirable to have a means whereby tension is an active function of torque. Such a device 920, is schematically depicted in FIGS. 38–39.

As can be seen, a separate set of back benders 921 are placed just below the upper or input sprocket 710. These back benders 921 are arranged for free lateral translation. When input torque is present, the tension or tight side of the Belt 37 will pull the tensioner back benders 921 to the left (FIG. 39), as the belt 37 tries to assume a line tangent to the lower back benders 921 and the upper sprocket 710. The more torque that is supplied, the more the tight side straightens causing slack to be taken up on the opposite leg.

Tests have shown that for the ratios such as those mentioned above, the upper sprocket 710 may be too small to account for the entire tensioning required. It is desirable for reasons described above to use a preload tension of approximately one-half the design tension in order that this mechanism 920, belt 37 and associated apparatus of the outdrive 30' will track required tension all the way through design values.

Transmission Design (FIGS. 40–50)

Figure 40:
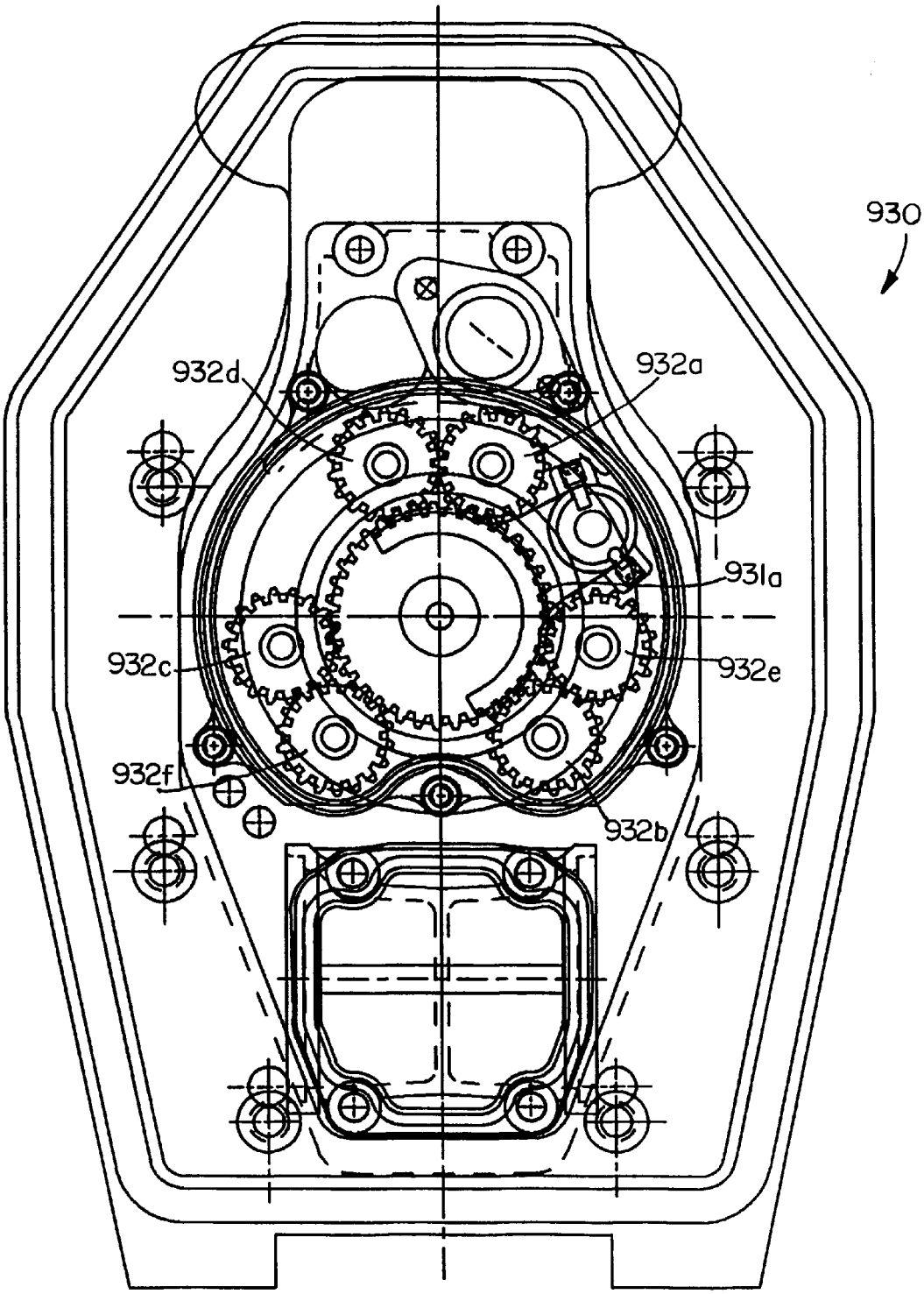
FIG. 40 is a broken away plan elevation view of the transmission looking aft.

In the transmission 930 there are two sun gears 931*a*, 931*b*, which are, respectively, relatively forward and aft. Forward and aft are, for convenience, typically more forward or relatively more aft in the transmission relative to use of the transmission in a water craft. There also are six planet gears 932*a–f*, three relatively forward and three relatively aft. There also are two dog clutches or dog clutch members 933*a*, 933*b* (one relatively forward and the other aft) which have teeth or dogs 934*a*, 934*b* or the like for inter-meshing type engagement, as is conventional for dog clutches, the operation of which is described below. The advantage of the dog clutch arrangement is that there is positive meshing of gear teeth without slippage and this connection is used in particular in the forward drive state of the transmission. The shift mechanism assures that the gears strongly pop into engagement or out of engagement, as is described further below. The planet gears 932*a–f* are arranged in respective pairs; the forward planet gears 932*a–c* cooperate with aft planet gears 932*d–f*. The forward planet gears 932*a–c* are spaced about the axis of the sun gear 931*a* at approximately 120° spacing. The aft planet gears 932*d–f* also are spaced about a sun gear, namely 931*b*, also at approximately 120° spacing, but as is seen in FIG. 40, angularly shifted about such axis relative to the forward planet gears 932*a–c*. Respective pairs of forward and aft planet gears are in meshed engagement so under appropriate conditions, namely, for reverse drive, described below the forward planet gears turn the aft planet gears. Therefore, when planet gear 932*a* is turned by a dog clutch member and sun gear in one direction, it turns the paired planet gear 932*d* in the opposite direction; so, too, with the respective pairs of planet gears 932*b–c* with planet gears 932*e–f* paired therewith.

Figure 41:
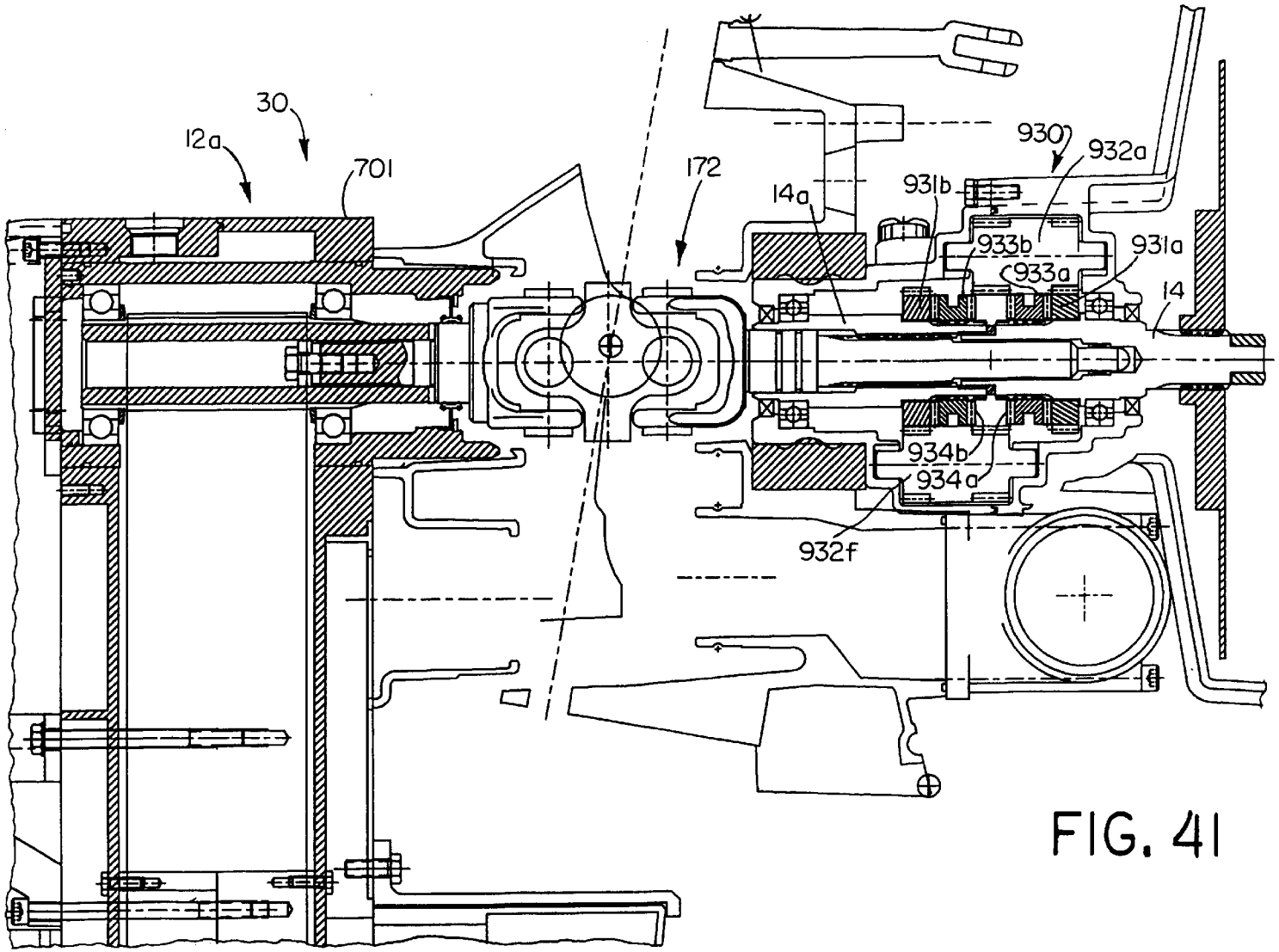
FIG. 41 is a side elevation section view relative to the plan elevation view of FIG. 40 of the transmission coupled to the outdrive.

In FIG. 40, which is a view looking aft, the dog clutch members 933*a*, 933*b* are hidden behind the forward sun gear 931*a* and are not seen. FIG. 41 shows the transmission coupled to the outdrive 30' shifted for reverse operation or driving of the water craft.

It will be appreciated that relative to the view looking aft in FIG. 40, the side views of FIGS. 41–44 cut through a section line of FIG. 40 that is not completely vertical, but rather is somewhat angular to show the functional relationship and arrangement of parts of the transmission 930.

The forward and aft sun gears 931*a*, 931*b* are held in place, so they do not drop out of position, by the respective three planet gears 932 surrounding them. The dog clutch members also can provide a retention/centering effect for the sun gears 931*a*, 931*b*.

Figure 42:
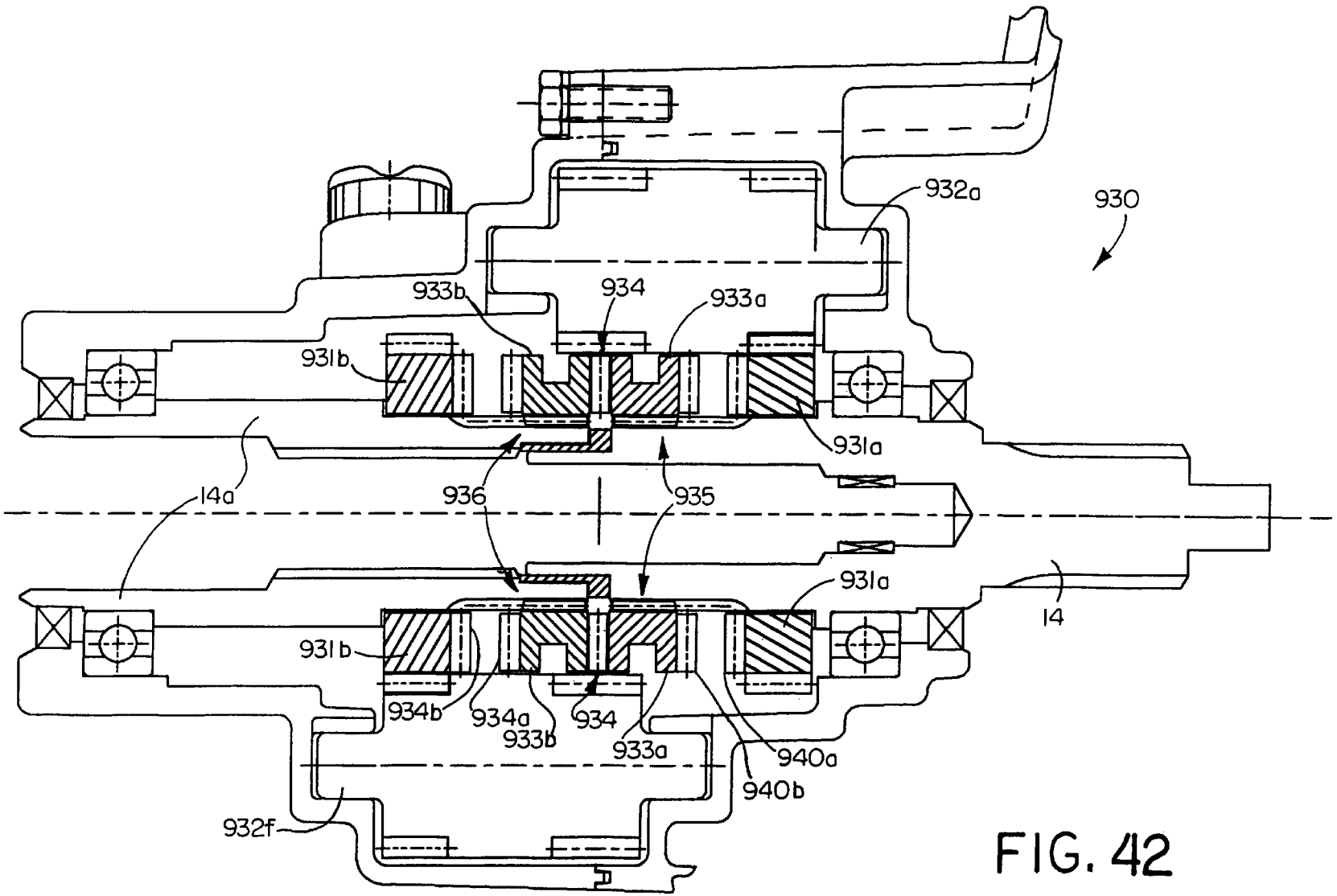
FIGS. 42–47 are schematic section views of a transmission and shift, respectively, in forward, reverse and neutral states, conditions or modes.

In the forward shifted condition of the transmission 930 shown in FIG. 42, the dog clutch member 933*a* is directly meshed with and turned by the drive shaft 14 at a splined connection 935, is directly connected to the dog clutch member 933*b* at the direct connection 934 of interengaged teeth 934*a*, 934*b* (seen separated in FIG. 41), and turns the dog clutch member 933*b*. The dog clutch member 933*b* is meshed at a splined connection 936 with the transmission output shaft 14*a* and causes it to turn, thus causing a forward rotation of the propeller 15 via the outdrive 30'. The sun gears 931*a*, 931*b* and the planet gears 932*a–f* do not directly couple power in the forward direction and preferably they just idle' and either do not rotate or possibly may rotate depending on weak fluid coupling with the drive shaft 14 and/or the transmission output shaft 14*a*.

Figure 43:
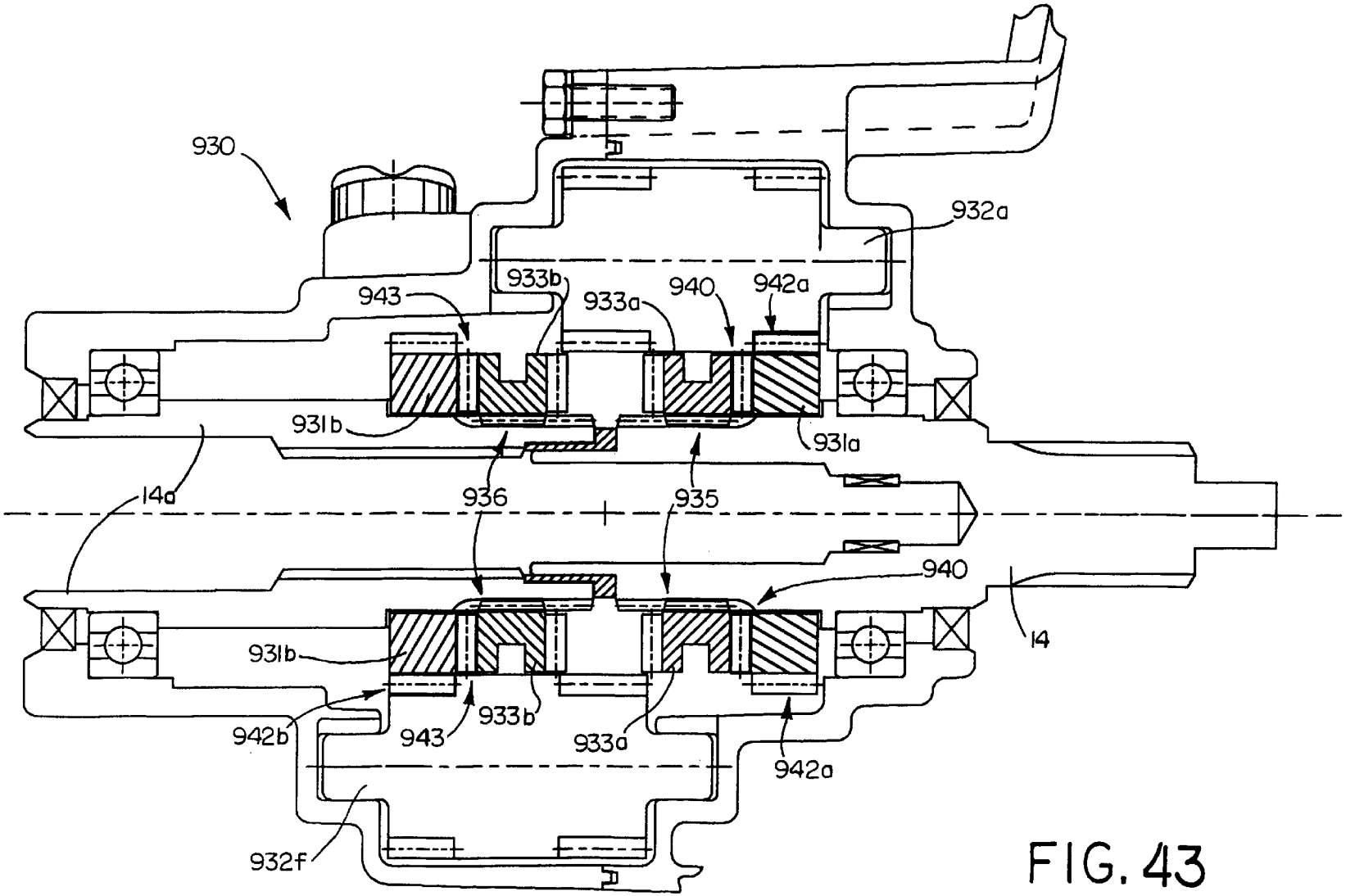

In the reverse shifted condition of the transmission 930 shown in FIG. 43, the dog clutch member 933*a* is meshed by teeth or dogs 940*a*, 940*b* (shown separated in FIG. 42) at 940 with sun gear 931*a*. The sun gear 931*a* is meshed at 942 with respective planet gears 932*a–c* and turn such planet gears 932*a–c*, which respectively mesh with and turn respective paired planet gears 932*d–f*. The planet gears 932*d–f* mesh with sun gear 932*b*, which is meshed by teeth or dogs 943*a*, 943*b* (shown separated in FIG. 42) at 943 with and turn the dog clutch member 933*b*. The dog clutch member 933*b* meshes with the transmission output shaft 14*a* at a splined connection 936 and rotates it in a direction opposite the rotational direction of the drive shaft 14, thus causing a reverse rotation of the propeller 15 via the outdrive 30'.

Figure 44:
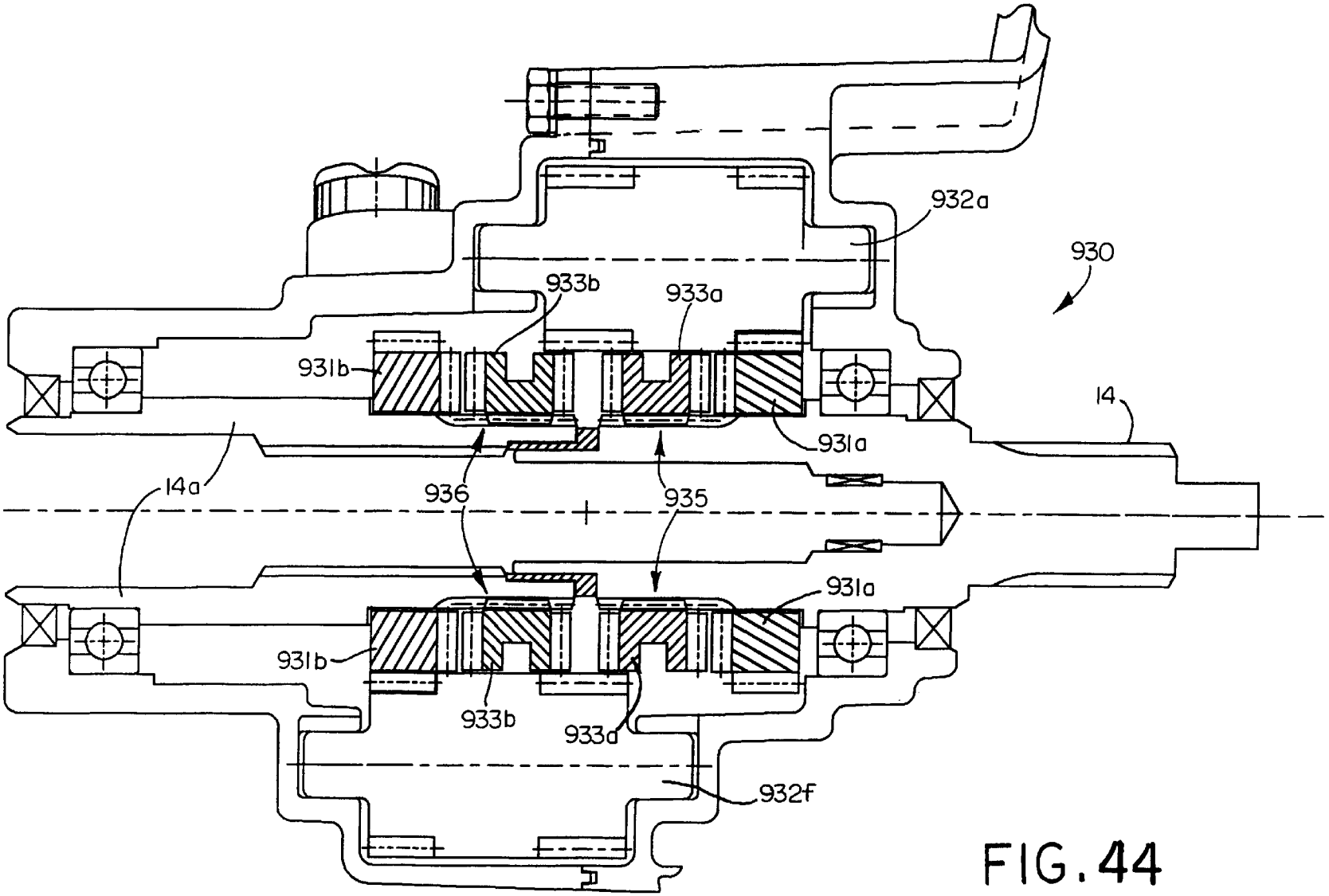

In the neutral shifted condition of the transmission 930 shown in FIG. 44, the dog clutch member 933*a* is meshed with the drive shaft 14, but the dog clutch member 933*a* is not meshed with any other gears, dog clutch type or planet type; therefore, the rotation of the drive shaft 14 is not coupled through to the transmission output shaft 14*a*. Similarly, dog clutch member 933*b* is meshed with the transmission output shaft 14*a* but is not meshed with any other gears or clutches. Therefore, in neutral the transmission does not couple power between the drive shaft 14 and the transmission output shaft 14*a*.

The Transmission 930 has been designed as a cost-effective means to provide forward running, neutral and reverse running. Reverse gear is at a 1:1 ratio. The drawings of FIGS. 40–44 show the intended design. It is a compact planetary arrangement with unique features to provide these functions:

Two (2) clutches are provided to allow no gears turning in either neutral or forward.

The above feature allows powdered metal construction throughout.

Reverse is accomplished by a novel arrangement of the planet gears 932, clutches and sun gears.

Fewer bearings 904 are required since the sun gears float on the planet gears at the centers of the shafts.

Summarizing operation of the transmission 930 with respect to the schematic illustrations of FIGS. 40–44, FIGS. 41 and 43 depict reverse operation to drive the water craft in reverse. The drive shaft 14 turns the forward dog clutch through a spline connection to rotate with the drive shaft as one unitary part. Through a dog clutch dog or teeth connection to the forward sun gear, the forward dog clutch drives the forward sun gear with the drive shaft as a unitary part. The forward sun gear then rotates the forward planet gear. The forward planet gear rotates the aft planet gear. The aft planet gear rotates the aft sun gear. The aft sun gear is engaged by a dog or teeth connection with the aft dog clutch and turns it. The aft dog clutch is in splined connection to the transmission output shaft 14a and turns it in a direction opposite to the direction of rotation of the drive shaft 14.

In the neutral state, the two dog clutches are relatively close together so they are out of engagement with each/either respective sun gear, yet the dog clutches are sufficiently far apart as not to be engaged with each other.

In forward operation the forward and aft dog clutches are moved closer together. Therefore, the dogs or teeth thereof engage or mesh with each other. Both dog clutches still are splined to respective shafts 14, 14*a*. Therefore, there is the direct forward drive without any gears spinning needlessly, which reduces losses that would be encountered if one or more gears were rotating. Note, in the illustrated embodiment, if a sun gear is not rotated, then the planet gears associated therewith also will not rotate; when they rotate, the respective sun gears and the associate planet gears always rotate in concert with each other, but in opposite directions.

Since forward operation is with a direct connection via the dog clutch members 933*a*, 933*b*, power coupling is very efficient with minimal loss since there are no extra gears required to be turned. Usually a water craft is operated in reverse at relatively slow speed for short periods of time. Therefore, the sun and planet gears do not have to transmit substantial loads and can be relatively inexpensive parts, for example, being made using powdered metal technology.

Transmission Shift Mechanism 950 (FIGS. 45–50)

The shift mechanism 950 of the transmission 930 shifts the dog clutches 933*a*, 933*b* among forward, neutral and reverse modes for operation as described above. When shifting dog clutches 933*a*, 933*b*, care must be taken by the operator to move the shifting lever 951 so the shift mechanism 950 operates swiftly to achieve full engagement of the dog clutches 933*a*, 933*b* with each other or with respective sun gears 931*a*, 931*b* or to neutral. In the past, if an operator is not decisive, the dog clutches 933*a*, 933*b* would partially engage and cause the clutch members to skip issuing a grinding noise. This type of operation can be destructive and is to be avoided. This is a common occurrence, and has given a generally bad connotation to dog-clutch design. The present invention is meant to avoid this problem.

Briefly, the lever 951 imparts rotational motion to wind up a torsional spring 952 within a hollow shaft 953. When the force in the spring 952 is sufficiently great and a mechanical direct engagement of the lever 951 or an associated mechanism with the shaft 953 overcomes the retention force of a detent mechanism 954, the spring 952 is operable to cause a snap or pop action to quickly urge (slam) the shaft 953 to the desired "shifted" position which drives shifting forks 955 via balls 956 and slots 957 on the shaft 953 into the desired position. The shifting forks 955 drive the dog clutch members 933*a*, 933*b* toward or away from each other to the new "shifted" position.

Figure 45:
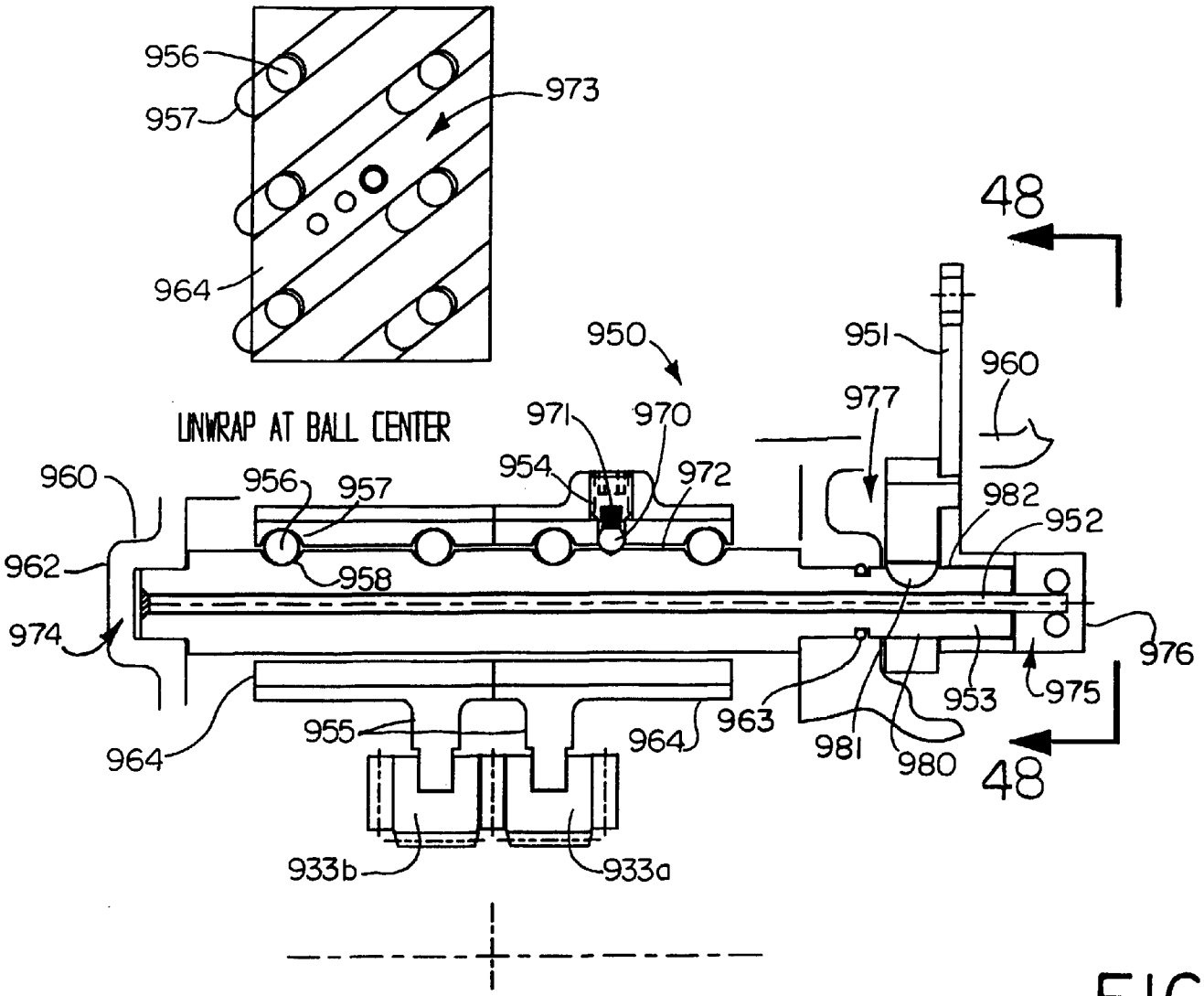
Figure 46:
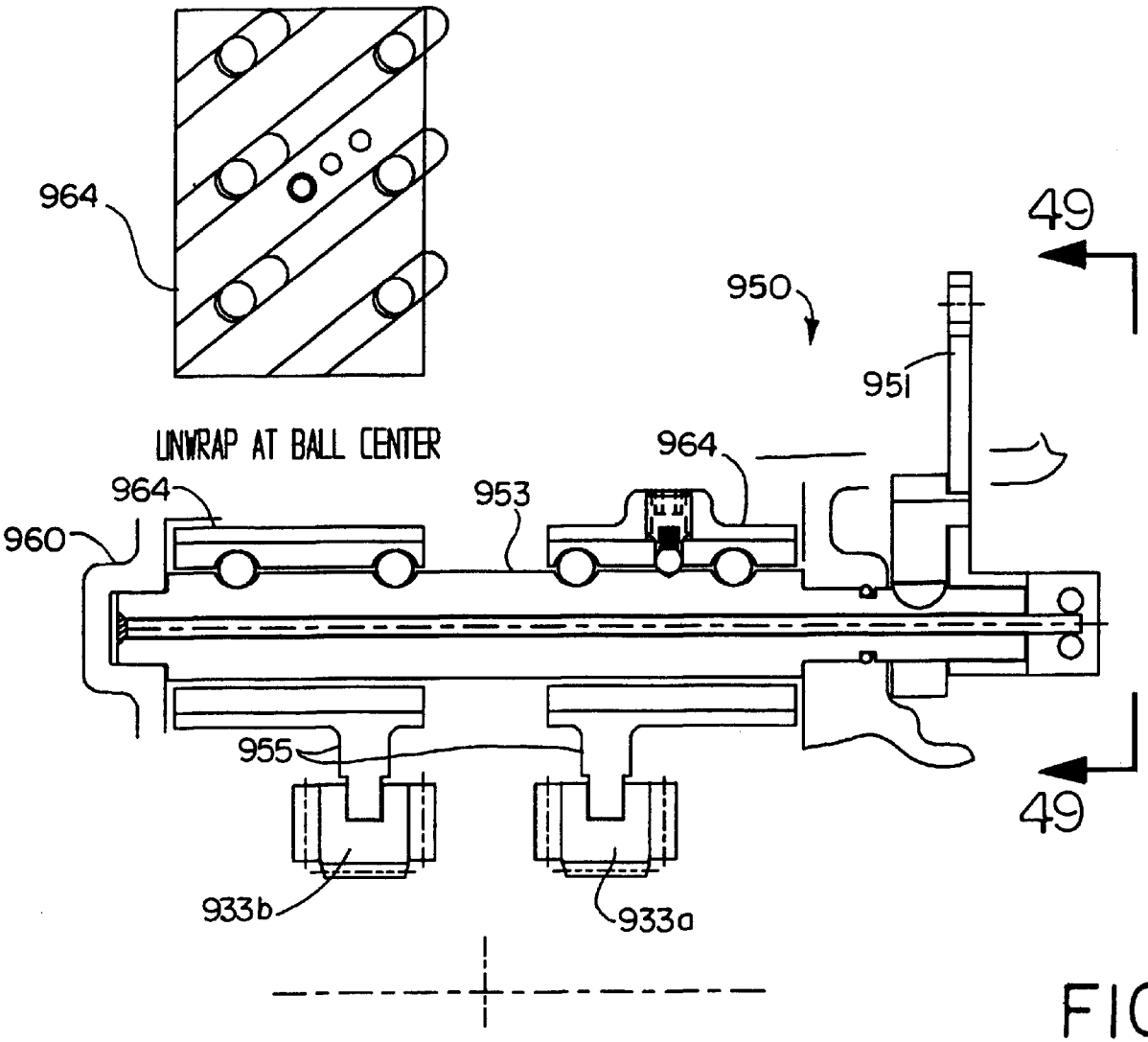
Figure 47:
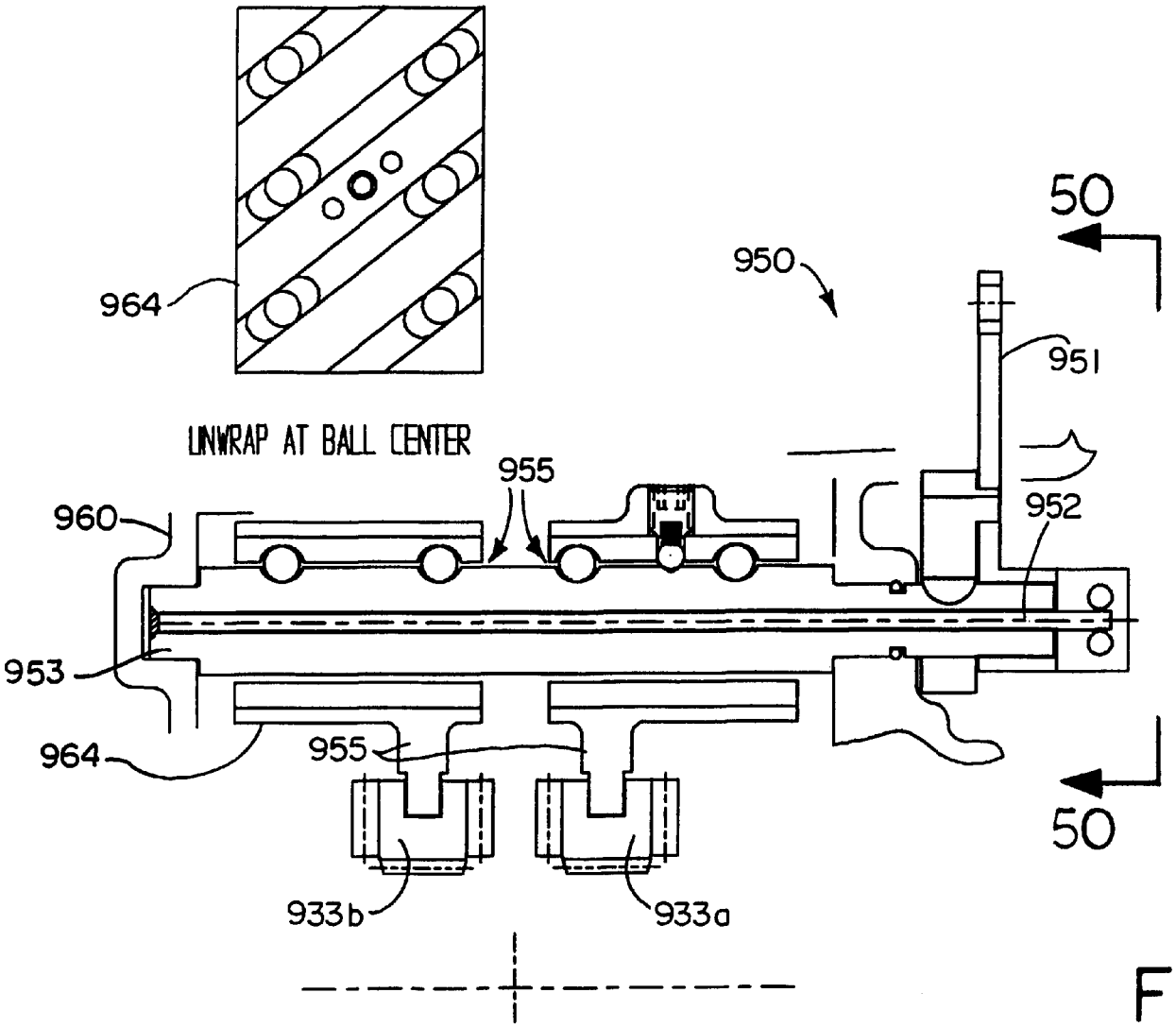
Figure 48:
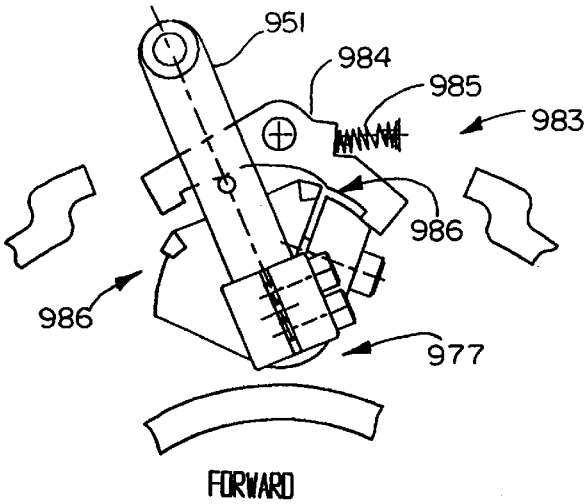
FIGS. 48–50 are schematic illustrations of the shift mechanism for the transmission.
Figure 49:
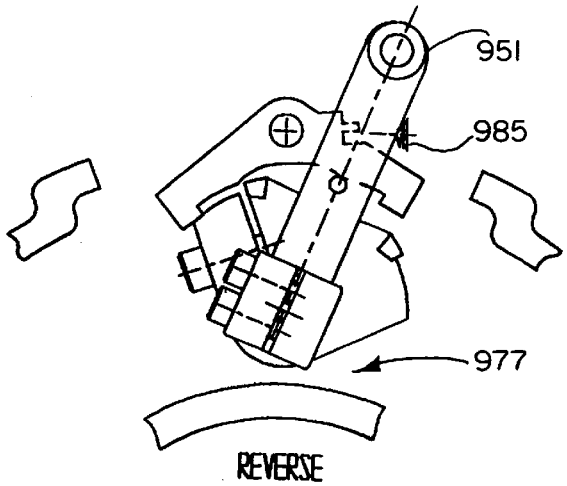
Figure 50:
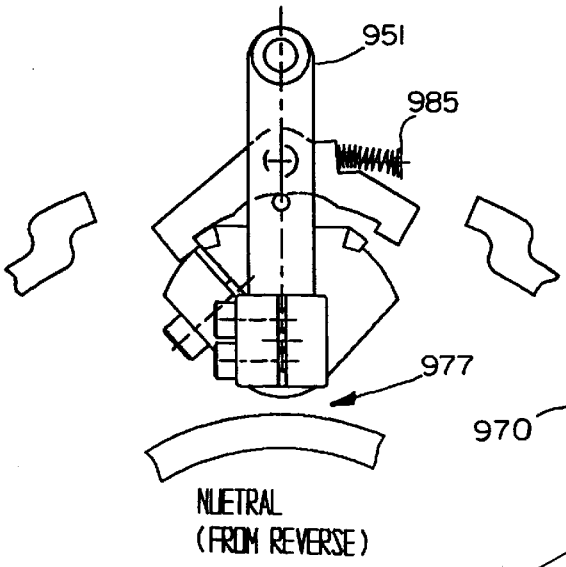

The detent mechanism 954 holds the shift mechanism 950 in a given mode until motion of lever 951 causes contact with tabs on lever 986 to force its movement to overcome the detent mechanism 954 releasing built up spring energy to slam the shift mechanism 950 and clutch members 933*a*, 933*b* to the desired condition or operational mode. FIGS. 45–50 shown the shift mechanism in the respective forward, reverse and neutral modes corresponding to the transmission 930 modes shown in respective FIGS. 42–44 to throw or to move the movable dog clutch members 933*a*, 933*b* relative to each other. FIGS. 45, 48 show forward; FIGS. 46, 49 show reverse; and FIGS. 47, 50 show neutral.

The shifting mechanism 950 includes a housing 961 in which various portions are mounted. For example, the shaft 953 is mounted in respective receptacles or bearings 962 and one or more seals, such as the o-ring seal 963, may be provided to keep the area within the housing clean and/or appropriately lubricated. The shifting forks 955 are mounted on part of shifting fork carriers 964 which may be cylindrical rings about the shaft 953. The grooves 957 are on the inside surface of the carriers 964 and face corresponding aligned grooves 965 in the exterior surface of the shaft 953. Preferably there are two carriers 964 one of which has left-handed threads and the other of which has right-handed threads; and the grooves 965 on the shaft 953 correspond. Therefore, as the shaft 953 is rotated, the balls 956 in respective grooves follow the rotation of the shaft and cause the carriers 964 to move toward or away from each other, thus moving the shifting forks 960 and the dog clutch members 933*a*, 933*b* respectively toward or away from each other. Although the carriers 964 move axially, preferably they are constrained by the housing 961 or otherwise as not to rotate.

In one or both of the shifting fork carriers 964 is the detent mechanism 954. The detent mechanism may be a ball 970 urged by a spring 971 toward an outside surface 972 of the shaft 953. Three respective recesses 973 in the shaft 953 are aligned with the path of the ball 970 as the ball follows a somewhat helical travel path relative to the shaft 953 as the shaft is rotated and the carrier 964 is moved axially relative to the shaft 953. The three recesses correspond to rotational/angular orientation of the shaft 953 and, thus, axial orientation of the carriers 964 for the respective forward, neutral and reverse modes of operation of the transmission 930.

The spring 952 may be welded or otherwise fixed to the shaft 953, e.g., as at the connection 974, which is located at one end of the shaft and spring. The spring 952 also is coupled as at 975 to the shift lever 951 so upon rotating the shift lever the spring is wound relative to the shaft 953. For this purpose, a cover or clamp 976 may be fastened to the spring 952, fixedly connected to the shift lever 951, and relatively rotationally movable relative to the shaft 953 about the axis thereof. The shift lever 951 and the cover 976 are retained on the shaft 953 by a key 977, which includes a partial concave surface 980 about at least part of the shaft and a protrusion 981 which holds in a recess or other lock point 982 of the shaft.

In FIGS. 48–50 a spring-loaded motion limiter 983 is shown. The motion limiter includes a spring loaded pawl 984, bias spring 985, and detent surfaces 986 with which the pawl may engage to prevent motion of the shift lever 951 beyond desired extent. Thus, the pawl avoids overshoot when the shift is shifted.

In operation of the shift mechanism 950, as the operator manually rotates the input lever 951, the torsion spring 952 is wound up to store energy in the torsion spring 952. When enough energy is stored to cause swift shifting action, the input lever 951 mechanically abuts the shifting lever to cause it to start a rotation of the hollow shaft 953, which releases the detent mechanism 954. The hollow shaft then rotates quickly and hard under the influence of the torsion spring 952; that rotation is stopped by the pawl 984. Rotation of the hollow shaft 953 moves the shifting forks 960 by the interaction of the right and left-handed ball threads 956, 957, 965 to rapidly move the dog clutch members 933*a*, 933*b* to a desired relative location for forward, neutral or reverse transmission and drive operation.

Figure 51:
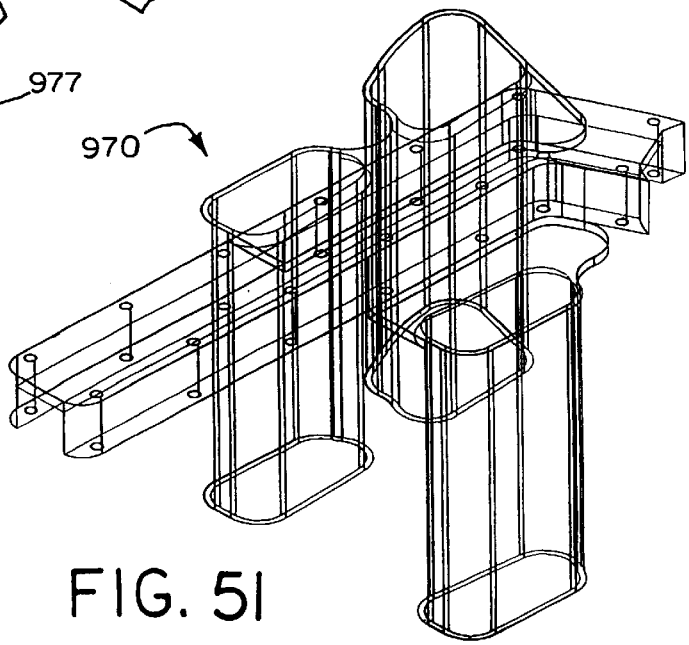
FIG. 51 is a schematic view of an exhaust thermal barrier.

Exhaust Thermal Barrier (FIG. 51)

The current drive 30' has been designed to be both a source to ventilate the propeller hub 15 and a muffler 800 to attenuate the exhaust sound. Hot water laden exhaust products are directed through the aluminum housing 701 to connect the various passages that form the muffling chambers described above. As the exhaust impinges on the aluminum housing 701 and is accelerated though the transit passages, heat is transferred to the cooler aluminum. This is undesirable since this heat must be removed by the drive's heat exchangers, in this case, the back benders 42*a*, 43*a*, 921 and the system oil 712.

Since the belt 37 is manufactured from polymers, its life is adversely affected by elevated temperature. It is, therefore, desirable to keep the incident heat load as small as possible.

A plastic heat barrier 970 which is an extension of the cooling water passage cover is shown in FIG. 51. This barrier 970 causes the exhaust to impinge directly on the plastic surface of the barrier 970, while heat transfer is discouraged by the poor conductivity of the plastic and the air gap that inevitably exists between the barrier 970 and the aluminum housing 701.

Aluminum Housing 701

The aluminum housing 701 serves multiple design functions. It is the surface that forms the back benders 42*a*, 43*a*, 921 and, subsequently, also performs the heat exchange function, carrying heat directly to the water from the oil 712 trapped between the back benders 42*a*, 43*a*, 921 and the belt 37. Also, as has been mentioned, the large preload forces are supported by the aluminum. There is, however, one function that has not been revealed, and is considered proprietary.

Since the belt 37 has a Kevlar7 construction, and since Kevlar has a negative coefficient of thermal expansion, temperatures in the drive 30' above room temperature, or above the temperature that the preload was set, cause more preload to be added to the belt 37.

Large preloads are necessary at high powers because it keeps the teeth engaged and because it promotes smooth engagement and disengagement of the teeth, minimizing the scrubbing action that promotes wear. However, at light loads, a high preload, while necessary for high powers, will actually promote premature wearing on the belt teeth 183. It is, therefore, very desirable to employ some active preload device. The aluminum housing 701 does just that. Since the preload added by the differential expansion is a function of the bulk temperature of the drive 30' and since the temperature tracks roughly the power being expended, the aluminum housing 701 acts as an active tensioner, yielding a preload that increases with increasing power.

Belts 37 may be statically tensioned below recommended values and yield a better wear profile. No start-up cogging problems have been observed, probably because the nature of a propeller load is one of hydrodynamic slip when too much torque is applied.

We claim:

1. An outdrive for a water vessel comprising an hybrid housing including a plastic portion and a heat conducting portion, at least part of the heat conducting portion constituting an exposed external surface of the housing, a chamber area in the heat conducting portion, a belt at least partly in the chamber for coupling power from an input drive to a propulsion device, the belt being at least partly in thermal transfer relation with said heat conducting portion, wherein at least part of said heat conducting portion is operatively configured to be exposed to water external of the outdrive when the outdrive is immersed.

2. The outdrive of claim 1, further comprising a fluid in said chamber providing thermal transfer between said belt and said heat conducting portion and providing lubrication between said belt and said heat conducting portion.

3. The outdrive of claim 1, further comprising a preload device for adjusting tension in the belt, the preload device including a wheel which engages the belt, and a carrier operatively coupled to the wheel, an outer surface of the carrier being eccentric with an inner surface of the carrier, rotation of the carrier causing the wheel to move, thereby adjusting tension in the belt.

4. The outdrive of claim 1, wherein the propulsion device includes a propeller shaft which protrudes from the housing, and further comprising a deflection limiter attached to the housing which limits deflection of the propeller shaft.

5. The outdrive of claim 1, wherein the housing includes a region between the input drive and the propulsion device which has a thickness-to-chord ratio of less than 10 percent.

6. The outdrive of claim 1, further comprising a preload device for adjusting tension in the belt, the preload device including a wheel which engages the belt, and a carrier operatively coupled to the wheel, an outer surface of the carrier being eccentric with an inner surface of the carrier, rotation of the carrier causing a center of the wheel to move, thereby adjusting tension in the belt.

7. The outdrive of claim 1, further comprising an active tensioner which actively adjusts the tension of the belt.

8. The outdrive of claim 1, further comprising a transmission which includes:

a direct drive connection for connecting a power source to an output device to drive the output device in a primary direction, the output device being operatively coupled to the input drive;

gearing for indirectly connecting the power source to drive the output device in a secondary direction; and a shifting mechanism for selectively decoupling the direct drive connection and connecting the gearing between the power source and the output device.

9. The outdrive of claim 2, further comprising a stuffer in the chamber area, between legs of the belt.

10. The outdrive of claim 2, wherein the heat conducting portion is made of metal.

11. The outdrive of claim 2, wherein the heat conducting portion is made of aluminum.

12. The outdrive of claim 2, wherein the heat conducting portion is between 30% and 50% of the hybrid housing.

13. The outdrive of claim 2, wherein the belt is made of a material which has a negative coefficient of thermal expansion.

14. The outdrive of claim 13, wherein the material which has a negative coefficient of thermal expansion includes a Kevlar cord material.

15. The outdrive of claim 1, wherein the chamber area has oil therein.

16. A transmission for a water vessel drive system capable of selectively coupling power in plural operational modes, comprising dog clutch members, sun gears, and planet gears, a shifting mechanism to move the dog clutch members to direct engagement with each other for one operational mode, to engagement with respective San gears for interaction with respective planet gears for another operational mode, and out of engagement with each other and with sun gears and planet gears for a third mode.

17. A transmission for a water vessel drive comprising:

a direct drive connection for connecting a power source to an output device to drive the output device in a primary direction;

gearing for indirectly connecting the power source to drive the output device in a secondary direction; and a shifting mechanism for opening the direct drive connection and connecting the gearing between the power souce and the output device;

wherein the direct drive connection includes a pair of dog clutch members each coupled to a respective shaft, and the gearing includes a pair of sun gears coupled to one another by planet gears; and wherein the shafts rotate in a first relative way when the dog clutch members are directly engaged, the shafts rotate in a second relative way when the dog clutch members are engaged with respective of the sun gears, and in a neutral mode the shafts are not connected and one of the shafts is not driven directly or indirectly by the other of the shafts to rotate relative to the other of the shafts when the dog clutch members are neither directly engaged nor coupled to the respective sun gears.

18. The transmission of claim 17, wherein the primary direction is a forward direction and the secondary direction is a reverse direction.

19. The transmission of claim 17, wherein the planet gears and the sun gears are made of powdered metal.

20. The transmission of claim 17, wherein each of the dog clutch members is slidably meshed to its respective shaft by a splined connection.

21. The transmission of claim 17, wherein the planet gears and the sun gears rotate only when the dog clutch members engage the sun gears.

22. The transmission of claim 17, wherein the shifting mechanism is coupled to the dog clutch members for moving the dog clutch members.

23. The transmission of claim 22, wherein the shift mechanism includes a shifting lever coupled to a spring and a detent mechanism, and shifting forks coupled to the spring and the detent mechanism, the shifting forks coupled to the dog clutch members for moving the dog clutch members along the respective shafts.

24. The transmission of claim 22, wherein the shift mechanism includes a shifting lever rotatably coupled to a hollow shaft and coupled to a torsional spring within the hollow shaft, and shifting fork carriers coupled to respective of the dog clutch members to move the dog clutch members along the respective shafts, the carriers also coupled to the hollow shaft such that rotation of the shaft causes the carriers to move toward or away from each other.

25. The transmission of claim 24, wherein the shift mechanism further includes a detent mechanism between the carriers and the shaft.

26. A water vessel belted outdrive spacer for use in an ontdrive having a chamber in which at least part of a transmitting belt is located, the spacer having a configuration for positioning between legs of the belt which is at least partially immersed in fluid, the spacer displacing some of the fluid and reducing flow in the fluid.

27. The outdrive of claim 26, wherein the spacer is made of plastic.

28. An outdrive for a water vessel comprising a housing having a chamber, a belt which moves within the chamber for transferring power from an input shaft to an output shaft, a fluid at least partially filling the chamber, and a spacer between legs of the belt which reduces the formation of vortices in the fluid.

29. The outdrive of claim 28, wherein the spacer is made of plastic.

30. The outdrive of claim 28, wherein the spacer is made of metal.

31. The outdrive of claim 28, wherein the spacer has a portion of an external surface with a shape substantially conforming to a portion of the belt.

32. The outdrive of claim 31, wherein the portion of the external surface of the spacer are approximately 0.030" inches from the belt.

33. The outdrive of claim 28, further comprising a transmission which includes:

a direct drive connection for connecting a power source to an output device to drive the output device in a primary direction, the output device being operatively coupled to the input shaft;

gearing for indirectly connecting the power source to drive the output device in a secondary direction; and a shifting mechanism for opening the direct drive connection and connecting the gearing between the power source and the output device.

34. The outdrive of claim 28, further comprising an active tensioner which actively adjusts the tension of the belt.

35. The outdrive of claim 28, further comprising a preload device for adjusting tension in the belt, the preload device including a wheel which engages the belt, and a carrier operatively coupled to the wheel, an outer surface of the carrier being eccentric with an inner surface of the carrier, rotation of the carrier causing a center of the wheel to move, thereby adjusting tension in the belt.

36. The outdrive of claim 28, wherein the housing includes a region between the input shaft and the output shaft which has a thickness-to-chord ratio of less than 10 percent.

37. A rotational shock absorber for a propopulsion system of a water vessel, comprising:

a stator;

a rotor coaxial with and within the stator, the rotor and stator defining chambers therebetween, the rotor having circumferenially-spaced vanes, each of the vanes dividing respective of the chambers into portions;

restrictions connecting the portions of respective of the chambers to allow fluid flow between portions of each of the chambers; and means for coupling the stator and the rotor in the propulsion system of the water vessel.

38. The shock absorber of claim 37, further comprising chamber-chamber seals which prevent fluid flow between the chambers.

39. The shock absorber of claim 37, further comprising seals between the vanes and the stator for preventing flow between the portions along the respective vane.

40. The shock absorber of claim 37, further comprising a heavy oil in the portions.

41. The shock absorber of claim 37, wherein the rotational shock absorber is rotationally symmetric.

42. The shock absorber of claim 37, wherein the restrictions give increasing resistance to rotary motion with increasing rotational displacement.

43. The shock absorber of claim 37, further comprising a biasing device which biases the rotor to a central position.

44. The shock absorber of claim 43, wherein the biasing device is a torsional spring.

45. The shock absorber of claim 37, wherein the restrictions are passages in an end plate coupled to the rotor and the stator.

46. The shock absorber of claim 37, as part of an outdrive for a water vessel.

47. A deflection limiter for a water vessel outdrive comprising a member with a shaft hole through which a shaft may protrude, and means for attaching the deflection limiter to the outdrive, wherein the means for attaching includes a collar attached to the member, the collar having holes therethrough.

48. The deflection limiter of claim 47, wherein the member is conical and the shaft hole is centrally located in the conical member.

49. The deflection limiter of claim 47, wherein the member has a drain hole therein.

50. The deflection limiter of claim 47, wherein the deflection limiter is made of aluminum.

51. An outdrive for a water vessel comprising a propeller shaft protruding from a housing, and a deflection limiter attached to the housing which limits deflection of the propeller shaft, wherein there is a clearance gap between the shaft and the deflection limiter during normal running, and wherein the deflection limiter is made of a metal and the propeller shaft is made of a different metal, the deflection limiter functioning as a sacrificial anode.

52. The outdrive of claim 51, wherein the deflection limiter is made of aluminum and the propeller shaft is made of stainless steel.

53. An outdrive for a water vessel comprising a propeller shaft protruding from a housing, and a deflection limiter attached to the housing which limits deflection of the propeller shaft, wherein there is a clearance gap between shaft and the deflection limiter during normal running, and wherein the housing is a hybrid housing including a plastic portion, and the deflection limiter attaches to and is structurally supported by hybrid housing.

54. An outdrive for a water vessel comprising a belt which moves within the chamber for transferring power from an input shaft to an output shaft, and a preload device for adjusting tension in the belt, the preload device including a wheel which engages the belt, and a carrier operatively coupled to the wheel, an outer surface of the carrier being eccentric with an inner surface of the carrier, rotation of the carrier causing a center of the wheel to move, thereby adjusting tension in the belt.

55. The outdrive of claim 54, wherein the carrier is mounted within the wheel.

56. The outdrive of claim 54, wherein the wheel is a sprocket.

57. The outdrive of claim 54, wherein the preload device further includes an adjustment mechanism.

58. The outdrive of claim 54, wherein the inner surface is oriented such that the belt is in tension when the wheel is rotationally aligned with an engine driveline operatively coupled to the input shaft.

59. The outdrive of claim 54, further comprising a mechanism for adjusting the preload device and locking the preload device.

60. The outdrive of claim 54, wherein the carrier has a toothed circumference for locking the preload device into place.

61. The outdrive of claim 54, further comprising an overdrive housing having a series of holes therein and a pin for selectively engaging the holes, thereby locking the preload device in a desired position.

62. The outdrive of claim 54, further comprising a housing having a series of holes therein, and a lQcking device insertable through the holes to engage the carrier and thereby lock the carrier in place, preventing it from being rotated.

63. The outdrive of claim 62, wherein the locking device is a pin.

64. The outdrive of claim 62, wherein the holes are threaded and the locking device is a threaded fastener.

65. The outdrive of claim 54, wherein the preload device is a two-piece preload device, further including another carrier operatively coupled to the wheel.

66. An outdrive for a water vessel comprising a belt which moves within a chamber for transferring power from an input shaft to an output shaft, and an active tensioner which actively adjusts the tension of the belt, wherein the active tensioner includes a device having a set of back benders slidably in contact with both legs of the belt, the device operatively configured to laterally translate relative to the belt.

67. The outdrive of claim 66, wherein the device freely moves substantially perpendicular to the travel of the belt.

68. The outdrive of claim 66, wherein the back benders are slidably in contact with outward-facing surfaces of the legs.

69. The outdrive of claim 66, wherein surfaces of the back benders in contact with the legs are mirror images of one another.

70. The outdrive of claim 66, wherein the chamber area has oil therein.

71. A muffler for an internal combustion engine for marine use, the muffler comprising:

a chamber; and tube means for providing noise reduction, said tube means being attached to the chamber;

wherein tie tube means includes exit tubes having a length of up to approximately one-quarter an exhaust gas wavelength corresponding to a highest frequency of exhaust noise to be muffled.

72. A muffler for an internal combustion engl for marine use, the muffler comprising:

a chamber; and tube means for providing noise reduction, said tube means being attached to the chamber;

wherein the tube means includes exit tubes having a length of up to approximately one-quarter an exhaust gas wavelength corresponding to approximately 200 Hz.

73. A muffler for an internal combustion engine for marine use, the muffler comprising:

a chamber; and tube maeans for providing noise reduction, said tube means being attached to the chamber;

wherein the tube means are tube means sized to provide internal velocities of 150 to 200 feet per second at maximnum exhaust throughput.

74. A mnuffler for an internal combustion engine for marine use, the muffler comprising:

a chamber; and tube meansfor providing noise reduction, said tube means being attched to the chamber;

wherein the tube means include aperture means for allowing the muffler to function as a Helmholtz resonator.

* * * * *